US006074810A

United States Patent [19]

Kawagishi et al.

[11] Patent Number: 6,074,810

[45] Date of Patent: Jun. 13, 2000

[54] SILVER HALIDE COLOR LIGHT-SENSITIVE MATERIAL

[75] Inventors: Toshio Kawagishi; Hideaki Naruse, both of Minami-ashigara, Japan

[73] Assignee: Fuji Photo Film Co., Ltd., Kanagawa-ken, Japan

[21] Appl. No.: 09/168,171

[22] Filed: Oct. 8, 1998

[30] Foreign Application Priority Data

| | | | |
|---|---|---|---|
| Oct. 8, 1997 | [JP] | Japan | 9-290544 |
| Jan. 13, 1998 | [JP] | Japan | 10-005195 |
| Apr. 6, 1998 | [JP] | Japan | 10-093666 |

[51] Int. Cl.[7] ..... G03C 1/00; G03C 7/26; G03C 7/32

[52] U.S. Cl. ..... 430/558; 430/306; 430/415; 430/440; 430/404

[58] Field of Search ..... 430/558, 386, 430/387, 415, 448, 484

[56] References Cited

U.S. PATENT DOCUMENTS

| | | | |
|---|---|---|---|
| 3,761,270 | 9/1973 | de Mauriac et al. | 430/484 |
| 4,021,240 | 5/1977 | Cerquone et al. | 430/484 |
| 5,302,504 | 4/1994 | Kida et al. | 430/558 |
| 5,543,275 | 8/1996 | Makuta | 430/558 |

FOREIGN PATENT DOCUMENTS

| | | |
|---|---|---|
| 59-231539 | 12/1984 | Japan . |
| 60-128438 | 7/1985 | Japan . |

*Primary Examiner*—Geraldine Letscher
*Attorney, Agent, or Firm*—Birch, Stewart, Kolasch & Birch, LLP

[57] ABSTRACT

There is disclosed a silver halide color light-sensitive material, which comprises a coupler of the formula (1), (2), or (3) in at least one layer on a base:

(I)

(II)

(III)

(IV)

wherein $R_1$ is a hydrogen atom, a halogen atom, or a substituent, $R_2$ is a group of formula (4), $R_3$ and $R_4$ each are a hydrogen atom, a halogen atom, or a substituent, with the proviso that at least one of $R_3$ and $R_4$ is a group of the formula (4), $R_5$ and $R_6$ each are an alkyl group, an amino group, a carbonamido group, an alkoxycarbonylamino group, a sulfonamido group, and the like, $R_7$ represents a group capable of substitution on a benzene ring; n is an integer of 0 to 3. This light-sensitive material can give a magenta image excellent in discrimination, and it is excellent in preservability before and after processing.

20 Claims, No Drawings

SILVER HALIDE COLOR LIGHT-SENSITIVE MATERIAL

FIELD OF THE INVENTION

The present invention relates to a silver halide color light-sensitive material, and particularly to a heat development color light-sensitive material excellent in preservability before and after the processing thereof.

BACKGROUND OF THE INVENTION

The photographic process, in which silver halides are used is conventionally most widely used, since it is excellent in photographic characteristics, such as sensitivity and gradation adjustment, in comparison with another photographic process such as, for example, electrophotography and diazo photography. It is still vigorously investigated because the highest image quality as, in particular, color hard copies can be obtained.

In recent years, from the image-formation processing method of light-sensitive materials in which silver halides are used, a system that can give an image simply and quickly by using, for example, an instant photographic system having a built-in developing solution or a dry-process heat development processing using heating or the like, has been developed in place of the conventional wet process. As heat development color light-sensitive materials, products called PICTROGRAPHY and PICTROSTAT (trade names) have been marketed by Fuji Photo Film Co., Ltd. This simple, quick processing method uses a redox compound having a preformed dye linked (hereinafter referred to as a coloring material), to carry out the color image formation. On the other hand, as the method for the color image formation for photographic light-sensitive materials, one in which a coupling reaction of a coupler with the oxidized product of a developing agent is used, is most popular. Heat development color light-sensitive materials that employ that method are disclosed, for example, in U.S. Pat. Nos. 3,761, 270, 4,021, 240 and JP-A-59-231539 ("JP-A" means unexamined published Japanese patent application) and JP-A-60-128438, wherein p-sulfonamidophenol is used as a developing agent. Since, in the light-sensitive materials that employ a coupling system, the couplers do not have absorption in the visible region before they are processed, the light-sensitive materials that employ a coupling system are advantageous over light-sensitive materials that use a coloring material in view of sensitivity. Further, it is considered that the light-sensitive materials that employ a coupling system have the advantage that they can be used not only as printing materials but also as photographing (shooting) materials.

SUMMARY OF THE INVENTION

Taking the above into account, study of p-sulfonamidophenol-type developing agents was further conducted, and European published patent No. 0764876 disclosed a p-sulfonamidophenol-type developing agent that, when built into a light-sensitive material, gives a color image excellent in discrimination. It was found, however, that when a conventional magenta coupler is used to obtain a magenta dye image, not only can a magenta color image having a satisfactory density not be obtained, but also the yellow density is increased, imagewise, to cause color contamination when the light-sensitive material, before development, is stored in the presence of an active gas, such as formalin. Further, it was found that there is a problem that the stability of the magenta dye image under heat and humidity after development processing, is low.

Thus, the present inventors have been intensively investigated the designs of the molecules of magenta couplers in the case in which p-sulfonamidophenol is used as a developing agent, and it has been found that couplers represented by the following formula (1), (2), or (3) for use in the present invention are effective in solving these problems.

An object of the present invention is to provide a silver halide color light-sensitive material, particularly a heat development color light-sensitive material, that gives a magenta image excellent in discrimination, and that is excellent in preservability before and after the processing of the light-sensitive material.

Other and further objects, features, and advantages of the invention will appear more fully from the following description.

DETAILED DESCRIPTION OF THE INVENTION

The object of the present invention has been attained by the following means:

(1) A silver halide color light-sensitive material, which comprises a coupler represented by the following formula (1), (2), or (3) in at least one layer on a base:

Formula (1)

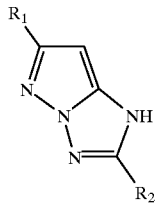

wherein $R_1$ represents a hydrogen atom, a halogen atom, or a substituent, and $R_2$ represents a group represented by the following formula (4), Formula (2)

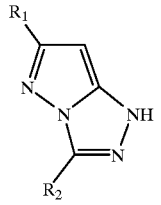

wherein $R_1$ and $R_2$ have the same meanings as those of $R_1$ and $R_2$ in formula (1), Formula (3)

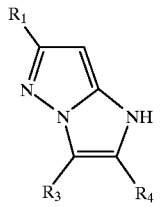

wherein $R_1$ has the same meaning as that of $R_1$ in formula (1), and $R_3$ and $R_4$ each represent a hydrogen atom, a halogen atom, or a substituent, with the proviso that at least one of $R_3$ and $R_4$ represents a group represented by the following formula (4), Formula (4)

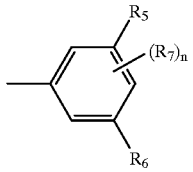

wherein $R_5$ and $R_6$ each represent an alkyl group, an aryl group, a heterocyclic group, an alkoxy group, an aryloxy group, an acyloxy group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl group, an aryloxycarbonyl group, a carbamoyl group, an amino group, an anilino group, a heterocyclic amino group, a carbonamido group, an alkoxycarbonylamino group, an aryloxycarbonylamino group, a ureido group, a sulfonamido group, a sulfamoylamino group, an imido group, an alkylthio group, an arylthio group, a heterocyclic thio group, a sulfinyl group, an alkanesulfonyl group, an arenesulfonyl group, a sulfamoyl group, or a phosphinoylamino group; $R_7$ represents a group capable of substitution on a benzene ring; n is an integer of 0 to 3, and when n is 2 or more, $R_7$'s are the same or different.

(2) The silver halide color light-sensitive material as stated in the above (1), wherein, in the group represented by formula (4), $R_5$ and $R_6$ each represent an alkoxycarbonyl group, a cycloalkyloxycarbonyl group, an aryloxycarbonyl group, a carbamoyl group, a carbonamido group, an alkoxycarbonylamino group, an aryloxycarbonylamino group, a ureido group, a sulfonamido group, a sulfamoylamino group, an imido group, an alkylthio group, an arylthio group, a heterocyclic thio group, an alkanesulfonyl group, an arenesulfonyl group, a sulfamoyl group, or a phosphinoylamino group.

(3) The silver halide color light-sensitive material as stated in the above (1) or (2), wherein, in the group represented by formula (4), the total number of carbon atoms in the groups represented by $R_5$ and $R_6$ is 10 or more, but 80 or less.

(4) The silver halide color light-sensitive material as stated in the above (1), wherein the said coupler is a coupler represented by the following formula (5):

Formula (5)

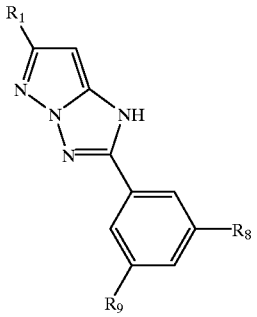

wherein $R_1$ represents an alkyl group, a cycloalkyl group, an alkenyl group, an aryl group, a heterocyclic group, an alkoxy group, or an aryloxy group, and $R_8$ and $R_9$ each represent an alkoxycarbonyl group, a cycloalkyloxycarbonyl group, an aryloxycarbonyl group, a carbamoyl group, an amino group, an anilino group, a carbonamido group, an alkoxycarbonylamino group, an aryloxycarbonylamino group, a ureido group, a sulfonamido group, a sulfamoylamino group, an imido group, or a phosphinoylamino group.

(5) The silver halide color light-sensitive material as stated in the above (1), wherein the said coupler is a coupler represented by the following formula (6):

Formula (6)

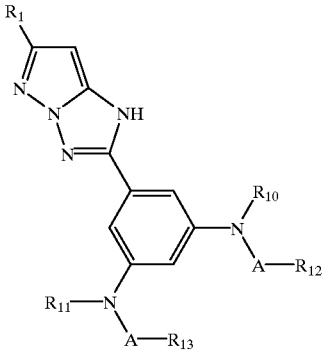

wherein $R_1$ represents a tertiary alkyl group or a tertiary cycloalkyl group, $R_{10}$ and $R_{11}$ each represent a hydrogen atom or an alkyl group, A represents —CO— or —$SO_2$—, and $R_{12}$ and $R_{13}$ each represent an alkyl group or an aryl group.

(6) The silver halide color light-sensitive material as stated in one of the above (1) to (5), wherein the said silver halide color light-sensitive material is a heat development color light-sensitive material having at least a light-sensitive silver halide, a binder, and a color-developing agent, in addition to the coupler represented by the above-described formula (1), (2), or (3), on the base.

(7) The silver halide color light-sensitive material as stated in the above (6), which contains, as the said developing agent, a compound represented by the following formula (7):

Formula (7)

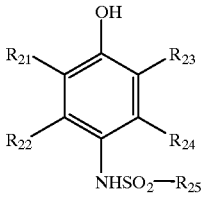

wherein $R_{21}$, $R_{22}$, $R_{23}$, and $R_{24}$ each represent a hydrogen atom or a substituent with the total of the Hammett substituent constant $\sigma_p$ values thereof being 0 or more, and $R_{25}$ represents an alkyl group, an aryl group, or a heterocyclic group.

Hereinbelow, the present invention is described in detail.

In the coupler represented by formula (1), $R_1$ represents a hydrogen atom, a halogen atom, or a substituent, and preferably $R_1$ represents a hydrogen atom, a halogen atom (e.g., fluorine, chlorine, and bromine), an alkyl group (preferably a straight-chain or branched-chain alkyl group having 1 to 32 carbon atoms, e.g., methyl, ethyl, propyl, isopropyl, butyl, t-butyl, 1-octyl, and tridecyl), a cycloalkyl group (preferably a cycloalkyl group having 3 to 8 carbon atoms, e.g., cyclopropyl, cyclopentyl, cyclohexyl, 1-norbornyl, and 1-adamantyl), an alkenyl group (preferably an alkenyl group having 2 to 32 carbon atoms, e.g., vinyl, allyl, and 3-buten-1-yl), an aryl group (preferably an aryl group having 6 to 32 carbon atoms, e.g, phenyl, 1-naphthyl, and 2-naphthyl), a heterocyclic group (preferably a 5- to 8-membered heterocyclic group having 1 to 32 carbon atoms, e.g., 2-thienyl, 4-pyridyl, 2-furyl, 2-pyrimidinyl, 1-pyridyl, 2-benzothiazolyl, 1-imidazolyl, 1-pyrazolyl, and benzotriazol-2-yl), a cyano group, a silyl group (preferably a silyl group having 3 to 32 carbon atoms, e.g., trimethylsilyl, triethylsilyl, tributylsilyl, t-butyldimethylsilyl, and t-hexyldimethylsilyl), a hydroxyl group, a nitro group, an alkoxy group (preferably an alkoxy group having 1 to 32 carbon atoms, e.g., methoxy, ethoxy, 1-butoxy, 2-butoxy, isopropoxy, t-butoxy, and dodecyloxy), a cycloalkyloxy group (preferably a cycloalkyloxy group having 3 to 8 carbon atoms, e.g., cyclopentyloxy and cyclohexyloxy), an aryloxy group (preferably an aryloxy group having 6 to 32 carbon atoms, e.g., phenoxy and 2-naphthoxy), a heterocyclic oxy group (preferably a heterocyclic oxy group having 1 to 32 carbon atoms, e.g., 1-phenyltetrazol-5-oxy, 2-tetrahydropyranyloxy, and 2-furyloxy), a silyloxy group (preferably a silyloxy group having 1 to 32 carbon atoms, e.g., trimethylsilyloxy, t-butyldimethylsilyloxy, and diphenylmethylsilyloxy), an acyloxy group (preferably an acyloxy group having 2 to 32 carbon atoms, e.g., acetoxy, pivaloyloxy, benzoyloxy, and dodecanoyloxy), an alkoxycarbonyloxy group (preferably an alkoxycarbonyloxy group having 2 to 32 carbon atoms, e.g., ethoxycarbonyloxy, and t-butoxycarbonyloxy), a cycloalkyloxycarbonyloxy group (preferably a cycloalkyloxycarbonyloxy group having 4 to 9 carbon atoms, e.g., cyclohexyloxycarbonyloxy), an aryloxycarbonyloxy group (preferably an aryloxycarbonyloxy group having 7 to 32 carbon atoms, e.g., phenoxycarbonyloxy), a carbamoyloxy group (preferably a carbamoyloxy group having 1 to 32 carbon atoms, e.g., N,N-dimethylcarbamoyloxy and N-butylcarbamoyloxy), a sulfamoyloxy group (preferably a sulfamoyloxy group having 1 to 32 carbon atoms, e.g., N,N-diethylsulfamoyloxy and N-propylsulfamoyloxy), an alkanesulfonyloxy group (preferably an alkanesulfonyloxy group having 1 to 32 carbon atoms, e.g., methanesulfonyloxy and hexadecanesulfonyloxy), an arenesulfonyloxy group (preferably an arenesulfonyloxy group having 6 to 32 carbon atoms, e.g., benzenesulfonyloxy), an acyl group (preferably an acyl group having 1 to 32 carbon atoms, e.g., formyl, acetyl, pivaloyl, benzoyl, and tetradecanoyl), an alkoxycarbonyl group (preferably an alkoxycarbonyl group having 2 to 32 carbon atoms, e.g., methoxycarbonyl, ethoxycarbonyl, and octadecyloxycarbonyl), a cycloalkyloxycarbonyl group (preferably a cycloalkyloxycarbonyl group having 2 to 32 carbon atoms, e.g., cyclohexyloxycarbonyl), an aryloxycarbonyl group (preferably an aryloxycarbonyl group having 7 to 32 carbon atoms, e.g., phenoxycarbonyl), a carbamoyl group (preferably a carbamoyl group having 1 to 32 carbon atoms, e.g., carbamoyl, N,N-dibutylcarbamoyl, N-ethyl-N-octylcarbamoyl, and N-propylcarbamoyl), an amino group (preferably an amino group having 32 or less carbon atoms, e.g., amino, methylamino, N,N-dioctylamino, tetradecylamino, and octadecylamino), an anilino group (preferably an anilino group having 6 to 32 carbon atoms, e.g., anilino and N-methylanilino), a heterocyclic amino group (preferably a heterocyclic amino group having 1 to 32 carbon atoms, e.g., 4-pyridylamino), a carbonamido group (preferably a carbonamido group having 2 to 32 carbon atoms, e.g., acetamido, benzamido, and tetradecanamido), a ureido group (preferably a ureido group having 1 to 32 carbon atoms, e.g., ureido, N,N-dimethylureido, and N-phenylureido), an imido group (preferably an imido group having 10 or less carbon atoms, e.g., N-succinimido and N-phthalimido), an alkoxycarbonylamino group (preferably an alkoxycarbonylamino group having 2 to 32 carbon atoms, e.g., methoxycarbonylamino, ethoxycarbonylamino, t-butoxycarbonylamino, and octadecyloxycarbonylamino), an aryloxycarbonylamino group (preferably an aryloxycarbonylamino group having 7 to 32 carbon atoms, e.g., phenoxycarbonylamino), a sulfonamido group (preferably a sulfonamido group having 1 to 32 carbon atoms, e.g., methanesulfonamido, butanesulfonamido, benzenesulfonamido, and hexadecanesulfonamido), a sulfamoylamono group (preferably a sulfamoylamino group having 1 to 32 carbon atoms, e.g., N,N-dipropylsulfamoylamino and N-ethyl-N-dodecylsulfamoylamino), an azo group (preferably an azo group having 1 to 32 carbon atoms, e.g., phenylazo), an alkylthio group (preferably an alkylthio group having 1 to 32 carbon atoms, e.g., ethylthio and octylthio), an arylthio group (preferably an arylthio group having 6 to 32 carbon atoms, e.g., phenylthio), a heterocyclic thio group (preferably a heterocyclic thio group having 1 to 32 carbon atoms, e.g., 2-benzothiazolylthio, 2-pyridylthio, and 1-phenyltetrazolylthio), an alkylsulfinyl group (preferably an alkylsulfinyl group having 1 to 32 carbon atoms, e.g., dodecanesulfinyl), an arenesufinyl group (preferably an arenesulfinyl group having 6 to 32 carbon atoms, e.g., benzenesulfinyl), an alkanesulfonyl group (preferably an alkanesulfonyl group having 1 to 32 carbon atoms, e.g., methanesulfonyl and octanesulfonyl), an arenesulfonyl group (preferably an arenesulfonyl group having 6 to 32 carbon atoms., e.g., benzenesulfonyl and 1-naphthalenesulfonyl), a sulfamoyl group (preferably a sulfamoyl group having 32 or less carbon atoms, e.g., sulfamoyl, N,N-dipropylsulfamoyl, and N-ethyl-N-dodecylsulfamoyl), a sulfo group, a phosphonyl group (preferably a phosphonyl group having 1 to 32 carbon atoms, e.g., phenoxyphosphonyl, octyloxyphosphonyl, and phenylphosphonyl), or a phosphinoylamino group (preferably a phosphinoylamino group having 2 to 32 carbon atoms, e.g., diethoxyphosphinoylamino and dioctyloxyphosphinoylamino).

In the coupler represented by formula (1), $R_2$ represents a group represented by the above formula (4). In the group represented by formula (4), $R_5$ and $R_6$ each represent an alkyl group, an aryl group, a heterocyclic group, an alkoxy group, an aryloxy group, an acyloxy group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl group, an aryloxycarbonyl group, a carbamoyl group, an amino group, an anilino group, a heterocyclic amino group, a carbonamido group, an alkoxycarbonylamino group, an aryloxycarbonylamino group, a ureido group, a sulfonamido group, a sulfamoylamino group, an imido group, an alkylthio group, an arylthio group, a heterocyclic thio group, a sulfinyl group, an alkanesulfonyl group, an arenesulfonyl group, a sulfamoyl group, or a phosphinoylamino group, and preferable numbers of carbon atoms of these groups and specific examples of these groups are the same as those described for the groups represented by $R_1$. In the group represented by formula (4), $R_7$ represents a group capable of substitution on a benzene ring, and specifically the group represented by $R_7$ represents a group having the same meaning as that of the group represented by $R_1$ other than a hydrogen atom, with preferable numbers of carbon atoms and specific examples being the same as those described for the group represented by $R_1$. n is an integer of 0 to 3.

$R_1$ and $R_2$ in the coupler represented by formula (2) have the same meanings as those of $R_1$ and $R_2$ in the coupler represented by formula (1).

$R_1$ in the coupler represented by formula (3) has the same meaning as that of $R_1$ in the coupler represented by formula (1). In the coupler represented by formula (3), $R_3$ and $R_4$ each represent a hydrogen atom, a halogen atom, or a substituent, and at least one of $R_3$ and $R_4$ represents a group represented by formula (4). When $R_3$ or $R_4$ represents a group other than the group represented by formula (4), the group represented by $R_3$ or $R_4$ represents the above-described group having the same meaning as that of $R_1$ in the coupler represented by formula (1). When $R_3$ or $R_4$ represents a group represented by formula (4), the group represented by $R_3$ or $R_4$ represents a group having the same meaning as that of $R_2$ in the coupler represented by formula (1) described above.

In the group represented by formula (4) in the coupler represented by formula (1), (2), or (3), $R_5$ and $R_6$ preferably each represent an alkoxycarbonyl group, a cycloalkyloxycarbonyl group, an aryloxycarbonyl group, a carbamoyl group, a carbonamido group, an alkoxycarbonylamino group, an aryloxycarbonylamino group, a ureido group, a sulfonamido group, a sulfamoylamino group, an imido group, an alkylthio group, an arylthio group, a heterocyclic thio group, an alkanesulfonyl group, an arenesulfonyl group, a sulfamoyl group, or a phosphinoylamino group. Further, preferably the group represented by formula (4) is a ballasting group for immobilizing the coupler, and preferably the total number of carbon atoms of the group represented by formula (4) is 14 or more, but 80 or less, and more preferably 20 or more, but 60 or less.

The coupler represented by formula (1), (2), or (3) may form a dimer or more higher polymer through its substituent, which polymer may be a homopolymer or copolymer coupler.

Out of the couplers represented by formula (1), (2), or (3), the coupler represented by formula (1) is most preferable in view of the color forming property, and the coupler represented by the following formula (5) is particularly preferable:

Formula (5)

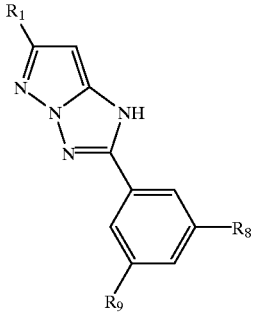

wherein $R_1$ represents an alkyl group, a cycloalkyl group, an alkenyl group, an aryl group, a heterocyclic group, an alkoxy group, or an aryloxy group, and $R_8$ and $R_9$ each represent an alkoxycarbonyl group, a cycloalkyloxycarbonyl group, an aryloxycarbonyl group, a carbamoyl group, an amino group, an anilino group, a carbonamido group, an alkoxycarbonylamino group, an aryloxycarbonylamino group, a ureido group, a sulfonamido group, a sulfamoylamino group, an imido group, or a phosphinoylamino group; the preferable number of carbon atoms of these groups and preferable specific examples of these groups are the same as those described for the group represented by $R_1$, and preferably the total number of carbon atoms of the groups represented by $R_8$ and $R_9$ is 8 or more, but 74 or less, and more preferably 14 or more, but 54 or less.

Out of the couplers represented by formula (5), the coupler represented by the following formula (6) is more preferable in view of the color-forming property and the fastness to heat and humidity of a dye image:

Formula (5)

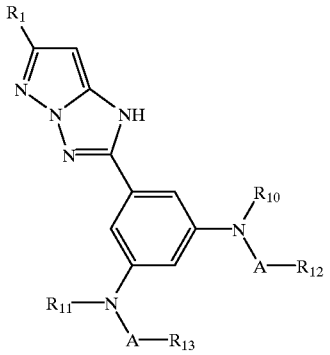

wherein $R_1$ represents a tertiary alkyl group (preferably a tertiary alkyl group having 4 to 32 carbon atoms, e.g., t-butyl, t-amyl, t-hexyl, 1,1,3,3-tetramethylbutyl, and 1,1-dimethyldecyl) or a tertiary cycloalkyl group (preferably a tertiary cycloalkyl group having 4 to 32 carbon atoms., e.g., 1-methylcyclopropyl, 1-ethylcyclopropyl, and 1-benzylcyclopropyl), $R_{10}$ and $R_{11}$ each represent a hydrogen atom or an alkyl group (preferably a straight-chain or branched-chain alkyl group having 1 to 32 carbon atoms, e.g., methyl, ethyl, propyl, isopropyl, butyl, t-butyl, 1-octyl, and tridecyl), A represents —CO— or —$SO_2$—, and $R_{12}$ and $R_{13}$ each represent an alkyl group (preferably a straight-chain or branched-chain alkyl group having 1 to 32 carbon atoms, e.g., methyl, ethyl, propyl, isopropyl, butyl, t-butyl, 1-octyl, and tridecyl) or an aryl group (preferably an aryl group having 6 to 32 carbon atoms, e.g., phenyl, 1-naphthyl, and 2-naphthyl). Preferably the total number of carbon atoms of the groups represented by $R_{10}$, $R_{11}$, $R_{12}$, and $R_{13}$ is 8 or more, but 74 or less, and more preferably 14 or more, but 54 or less.

In the above, if the groups represented by any of $R_1$ to $R_{13}$ are groups capable of having a substituent, they may be further substituted, and preferable examples of the substituent are the same as those mentioned as $R_1$.

Specific compound examples of the magenta couplers represented by formula (1), (2), or (3) are shown below, but the present invention is not limited to them.

M-1
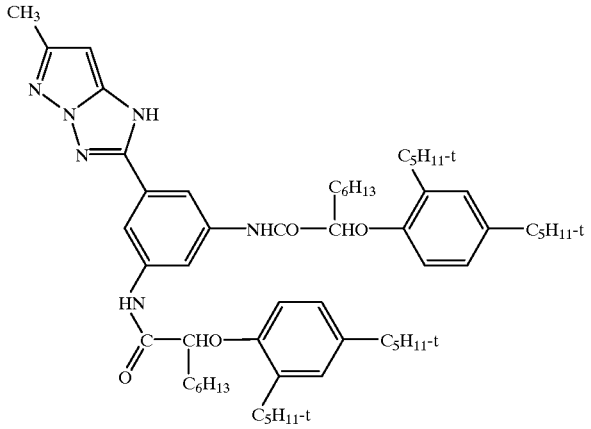
M-2
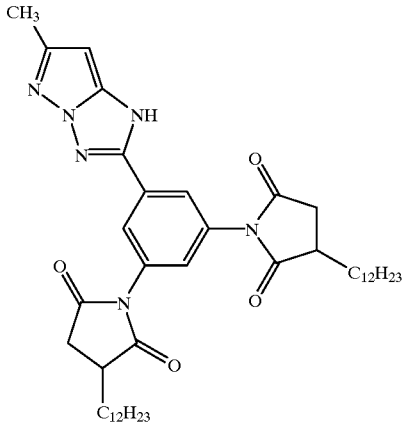
M-3
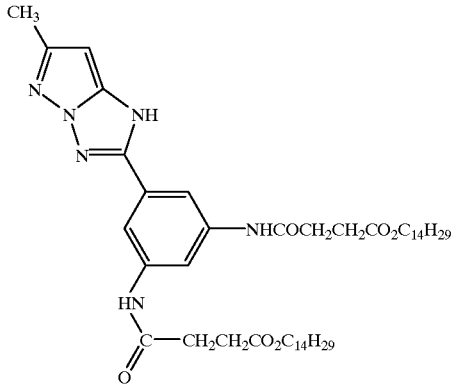

-continued
M-4
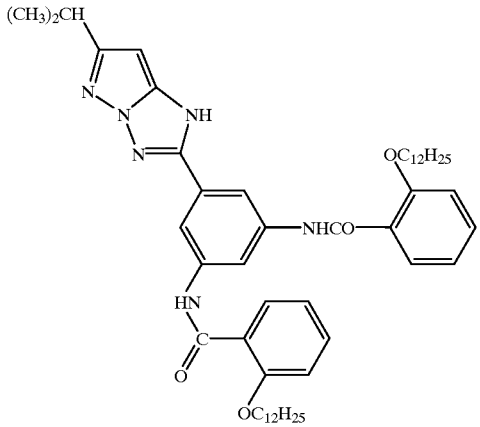
M-5
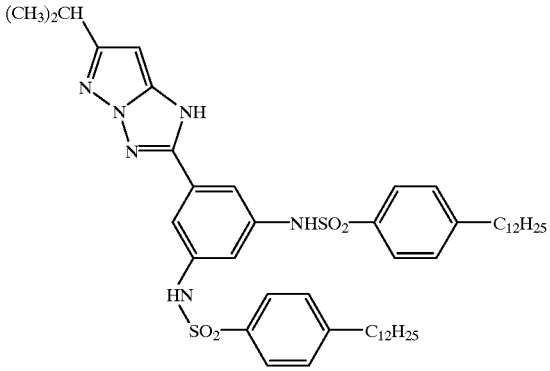
M-6
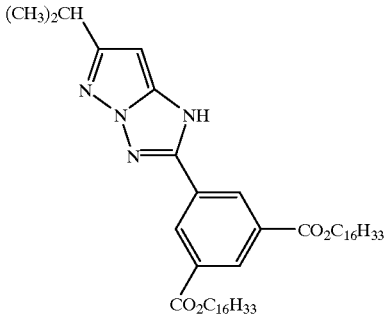
M-7
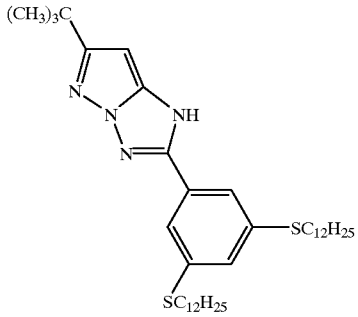

-continued
M-8
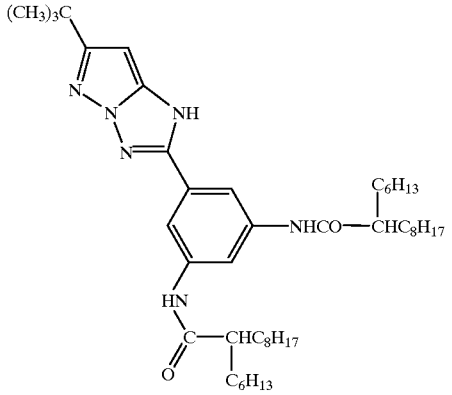
M-9
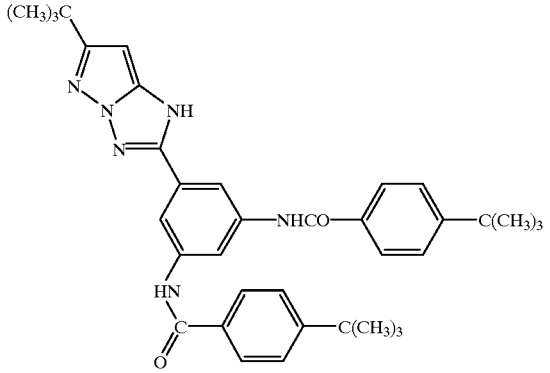
M-10
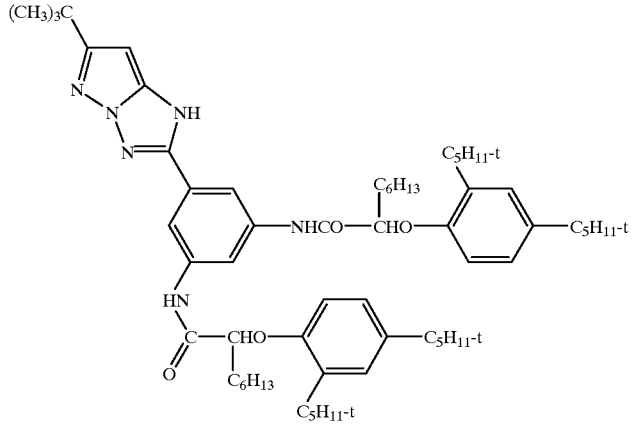
M-11
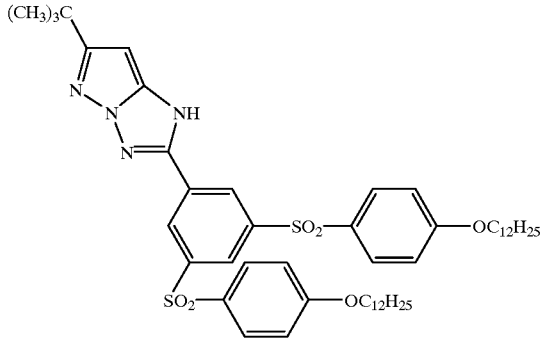

-continued
M-12
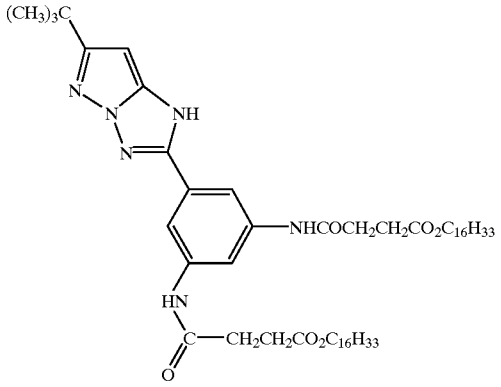
M-13
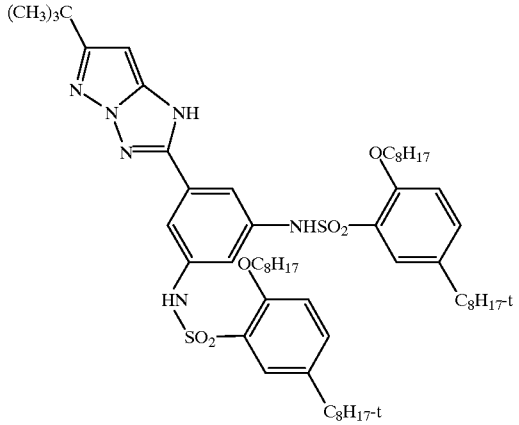
M-14
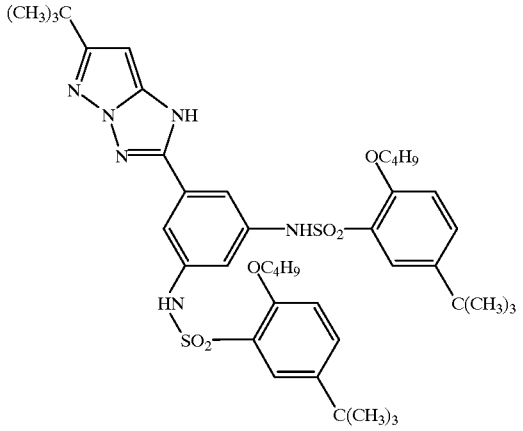

-continued
M-15
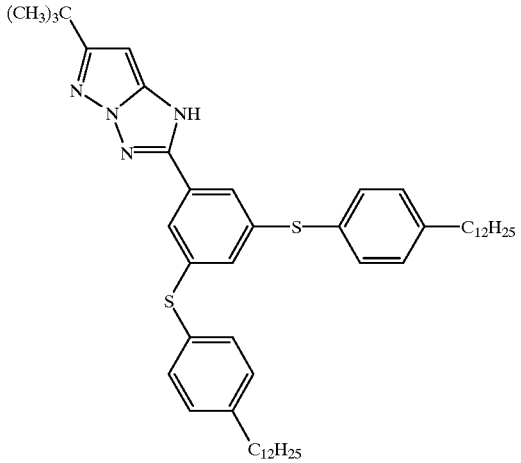
M-16
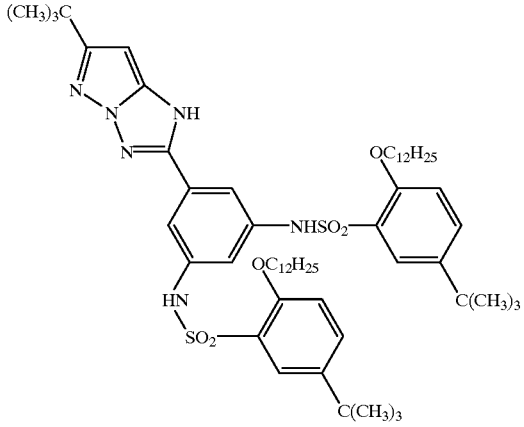
M-17
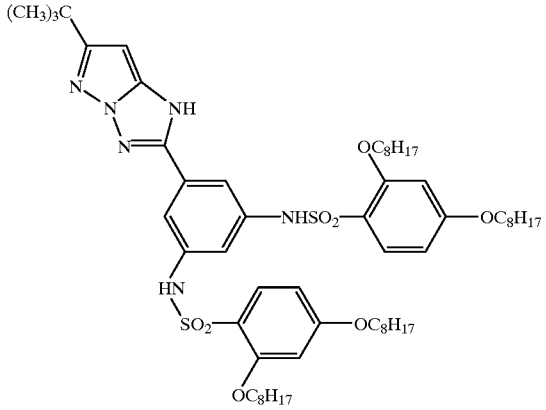

-continued
M-18
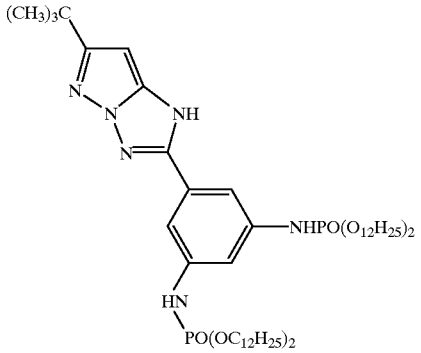
M-19
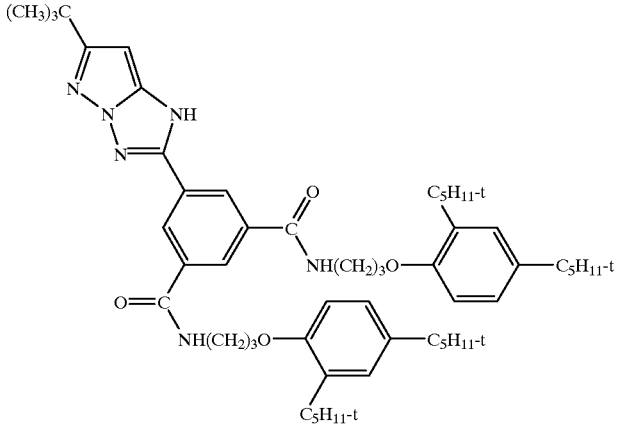
M-20
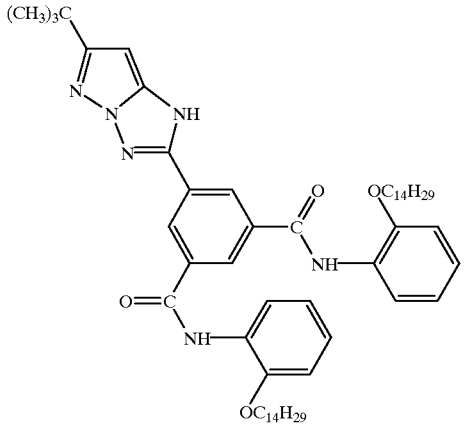

-continued
M-21
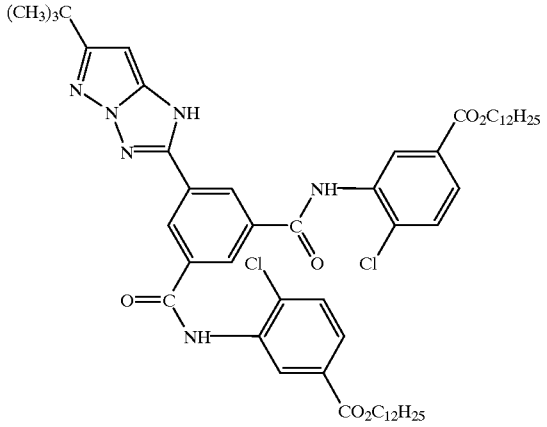
M-22
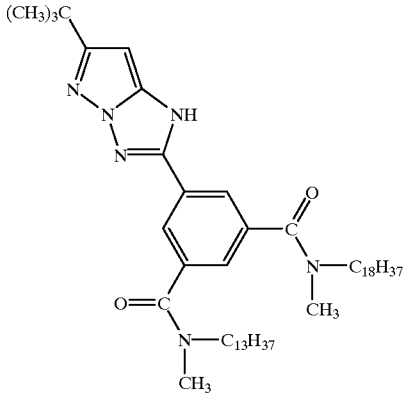
M-23
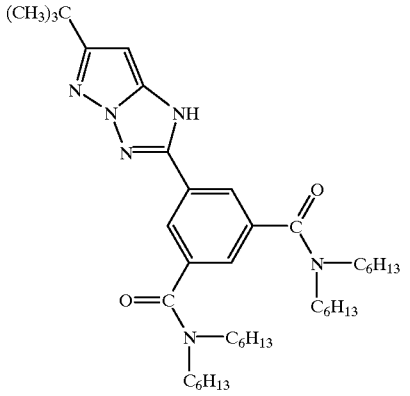

-continued
M-24
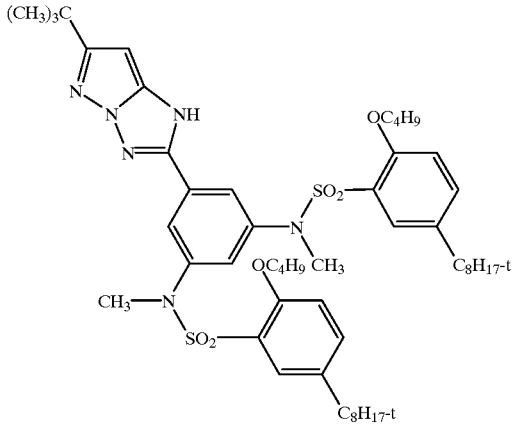
M-25
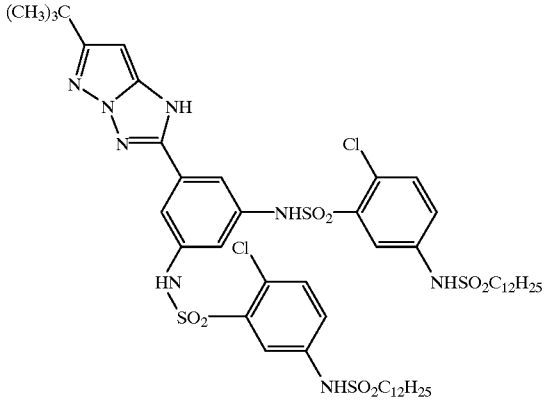
M-26
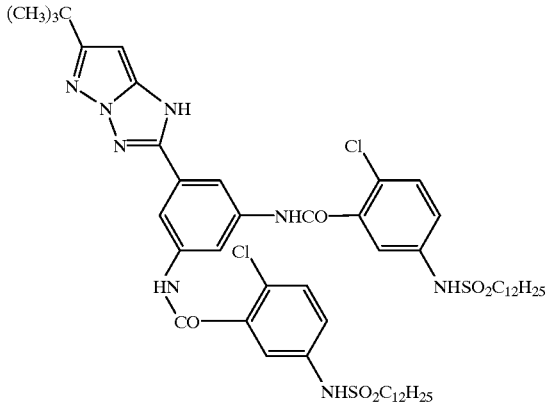

-continued
M-27
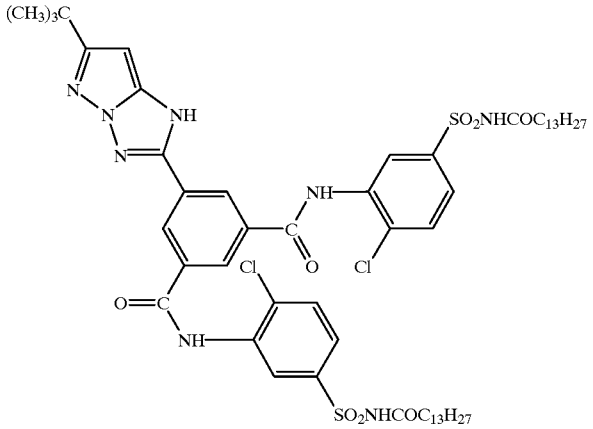
M-28
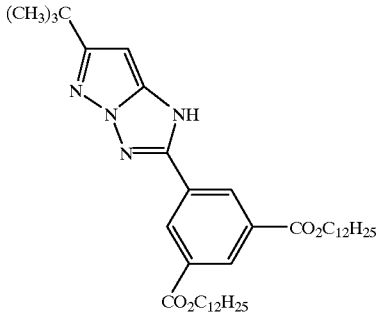
M-29
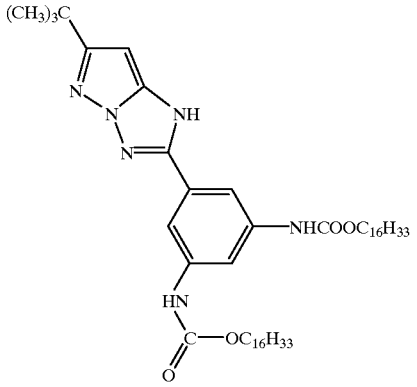
M-30
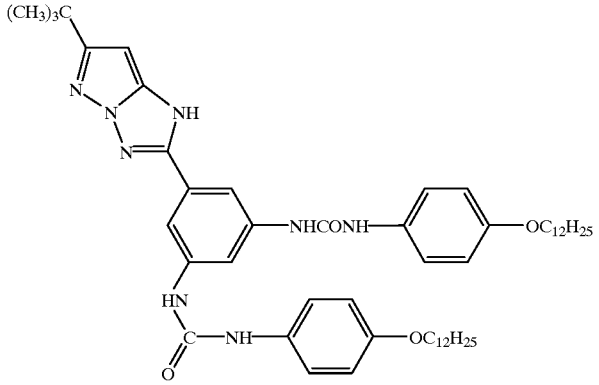

-continued
M-31
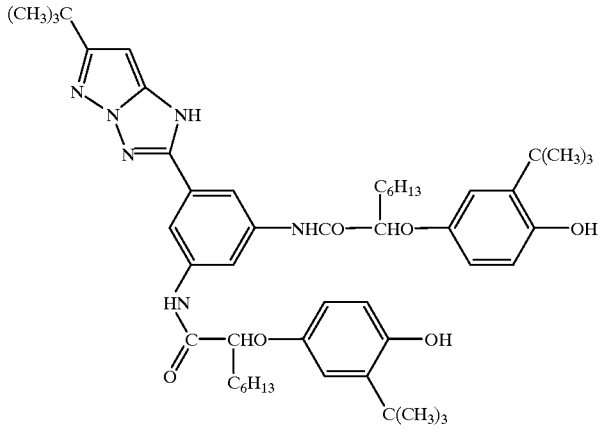
M-32
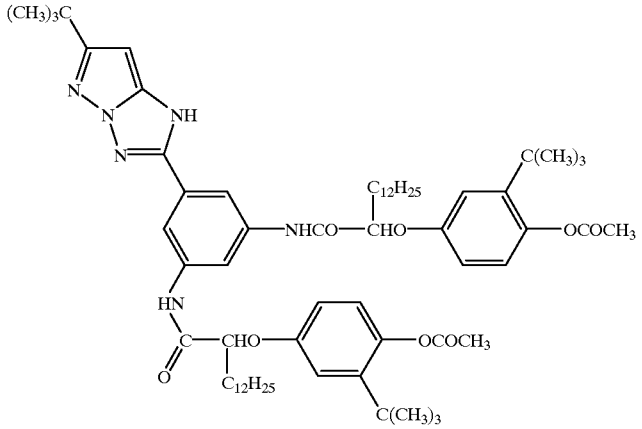
M-33
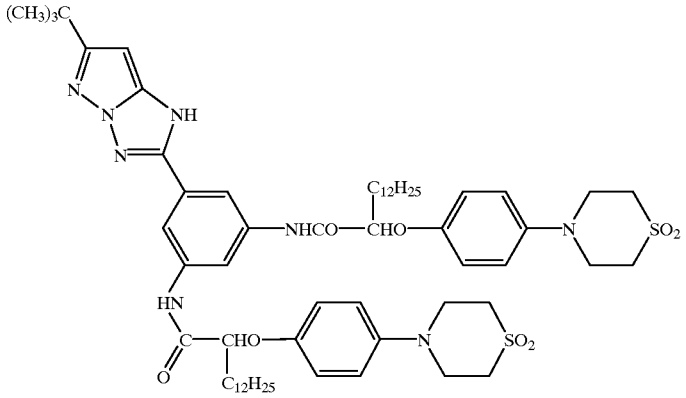

-continued
M-34
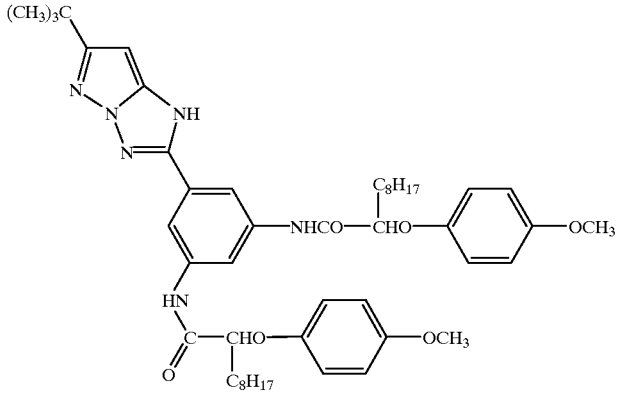
M-35
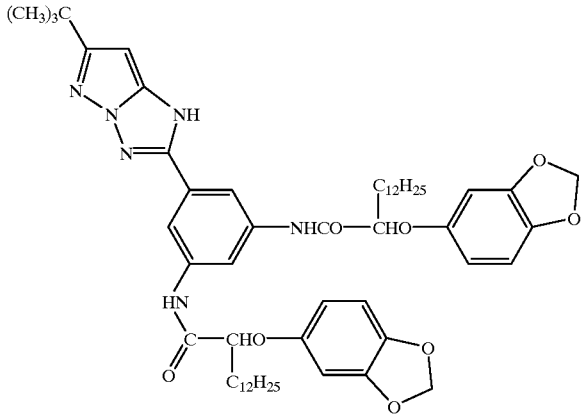
M-36
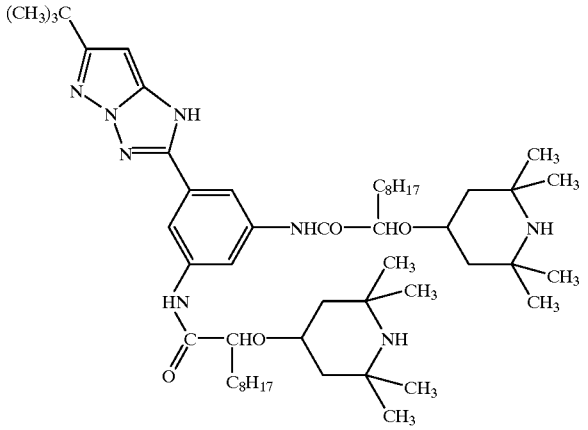

-continued
M-37
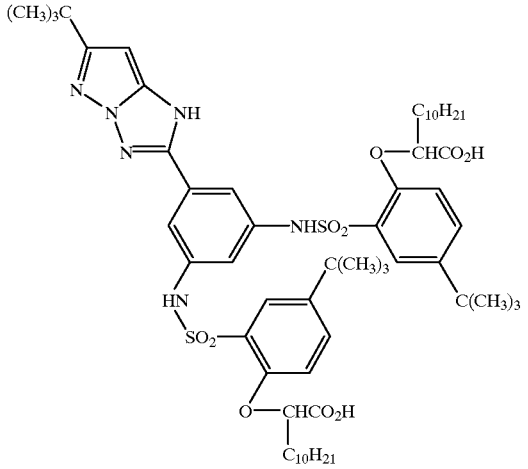
M-38
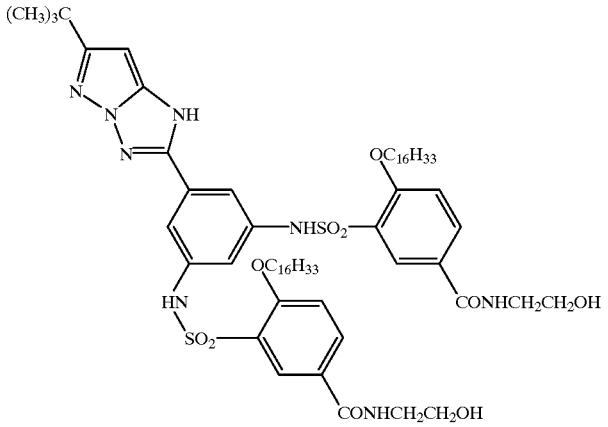
M-39
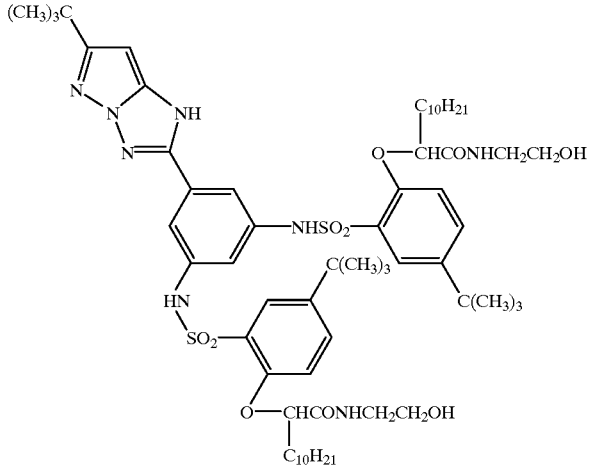

-continued
M-40
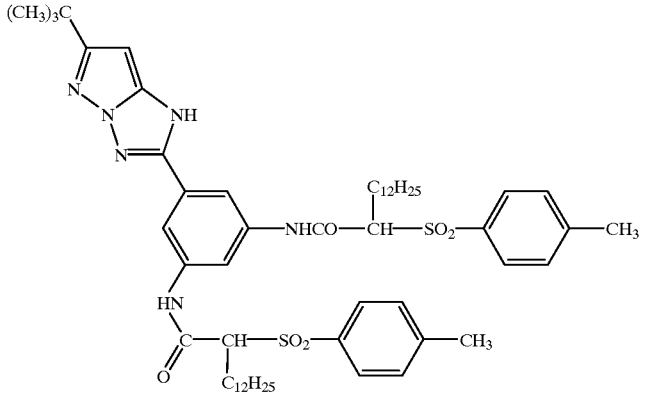
M-41
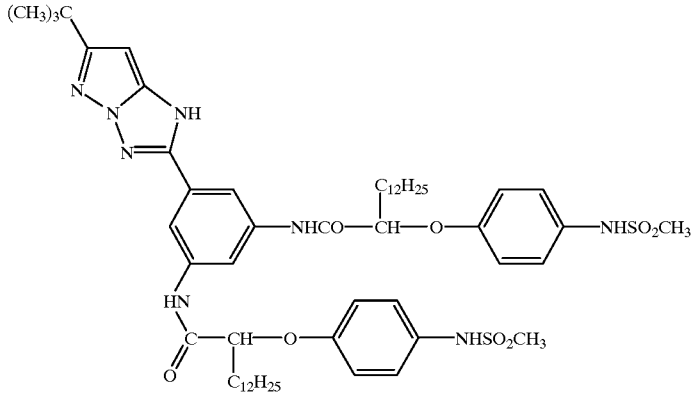
M-42
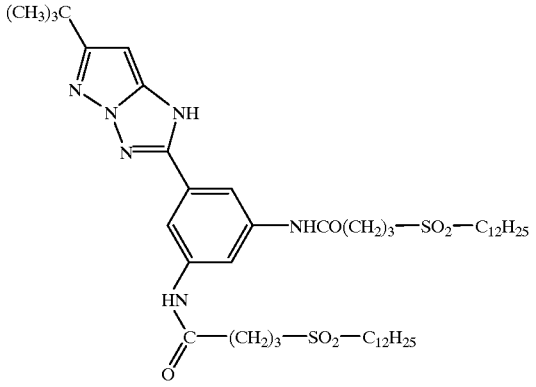
M-43
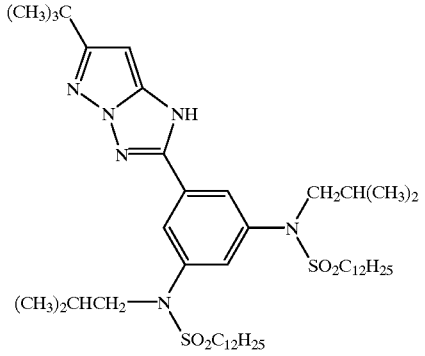

-continued
M-44
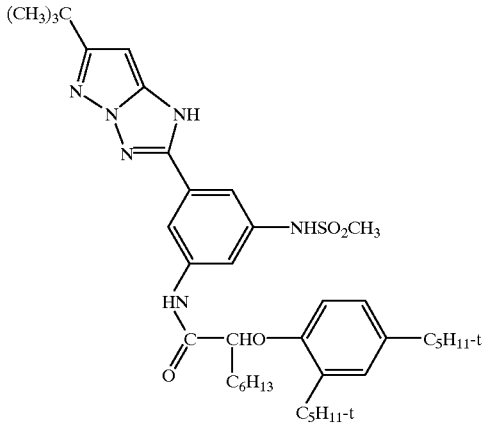
M-45
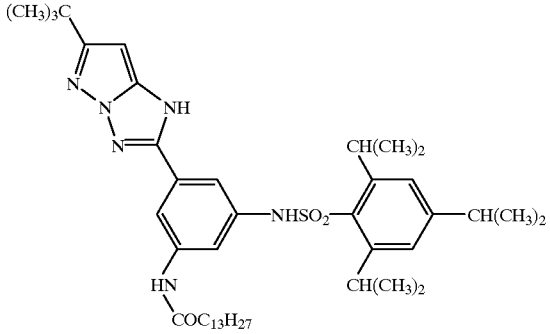
M-46
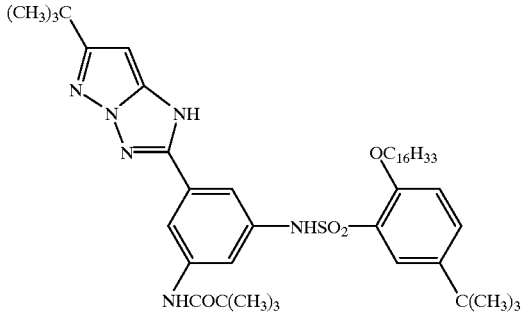
M-47
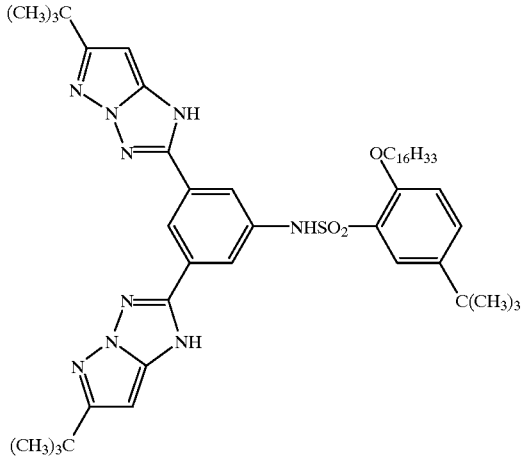

-continued
M-48
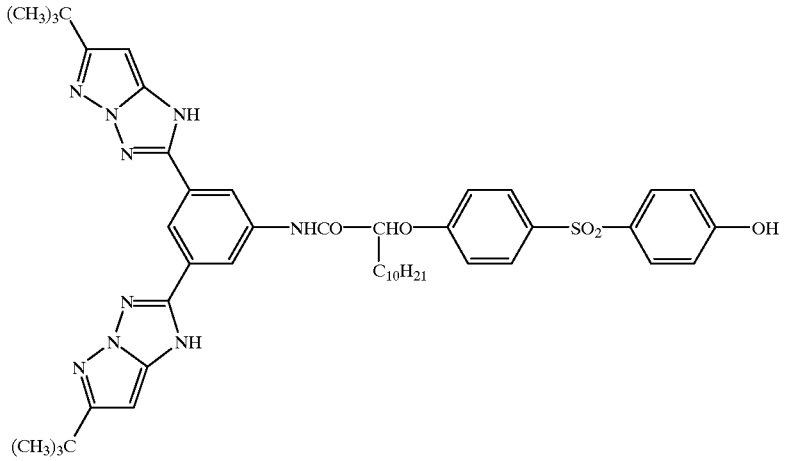
M-49
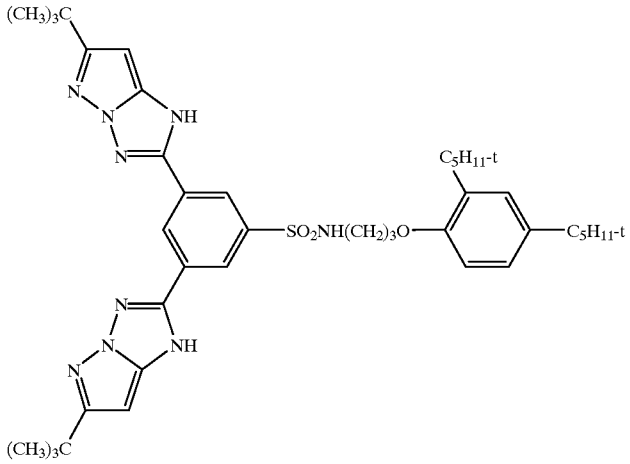
M-50
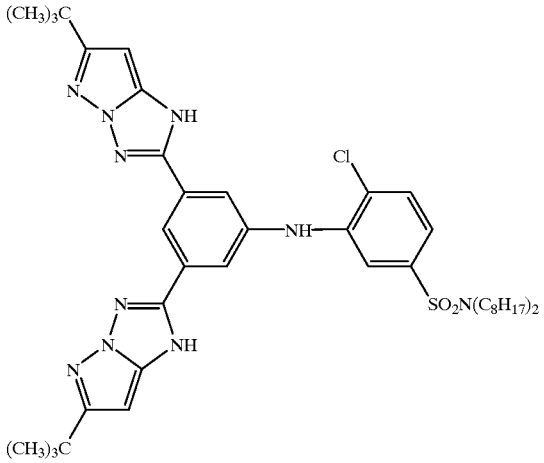

-continued
M-51
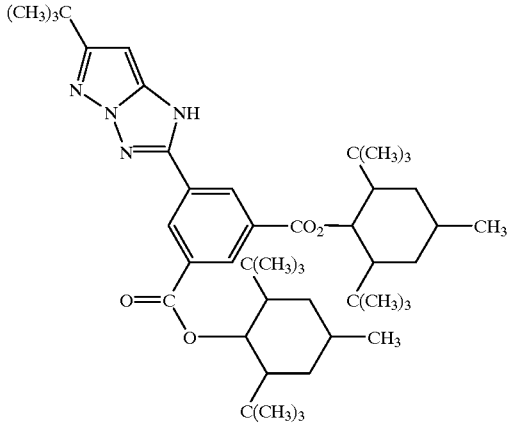
M-52
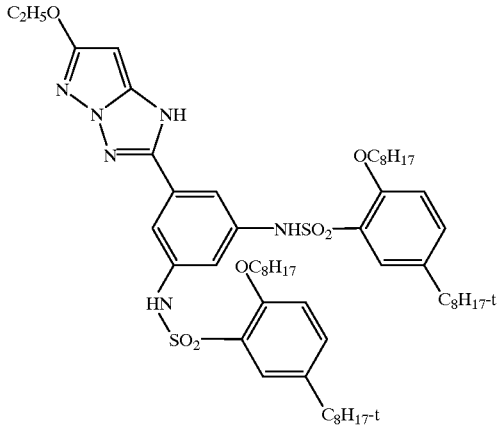
M-53
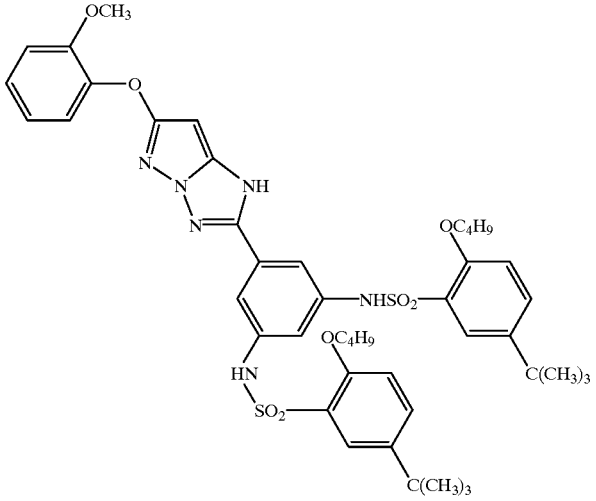

-continued
M-54
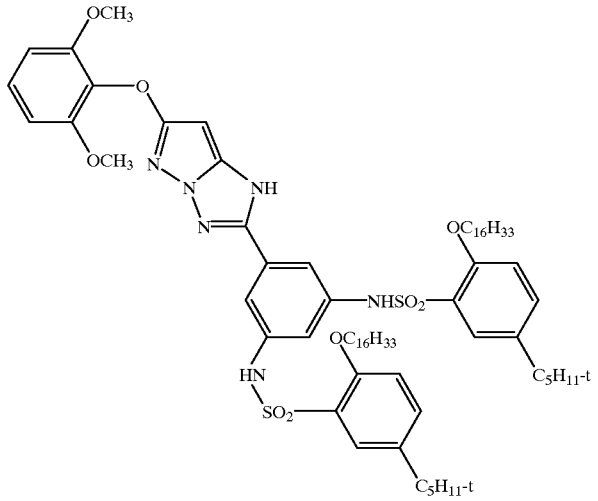
M-55
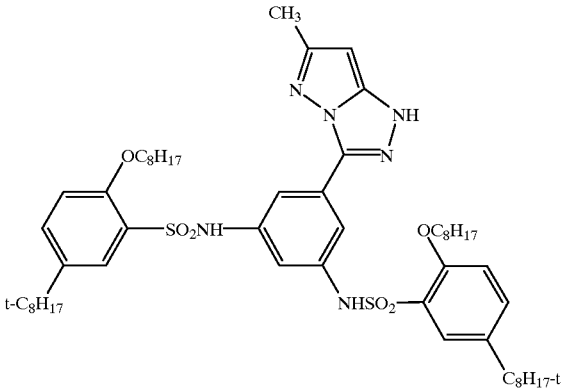
M-56
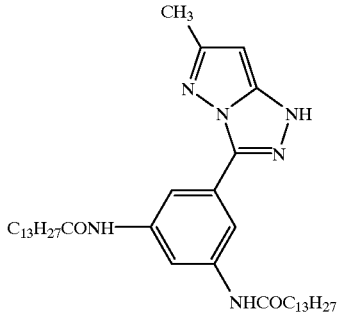
M-57
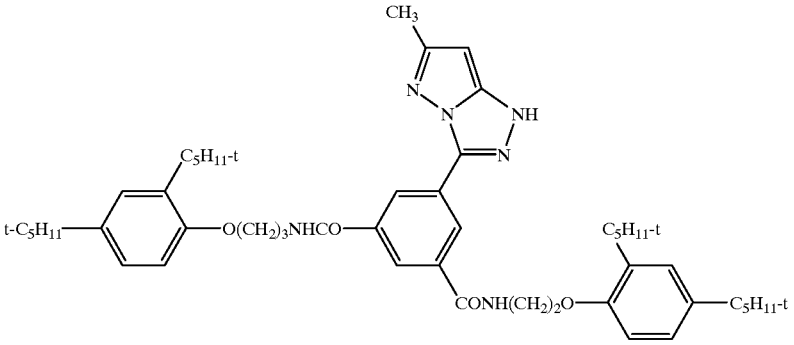

-continued
M-58
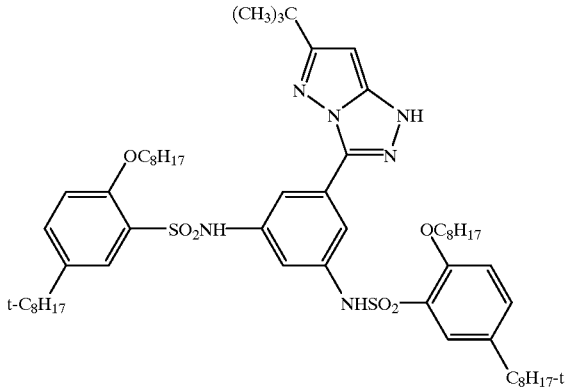
M-59
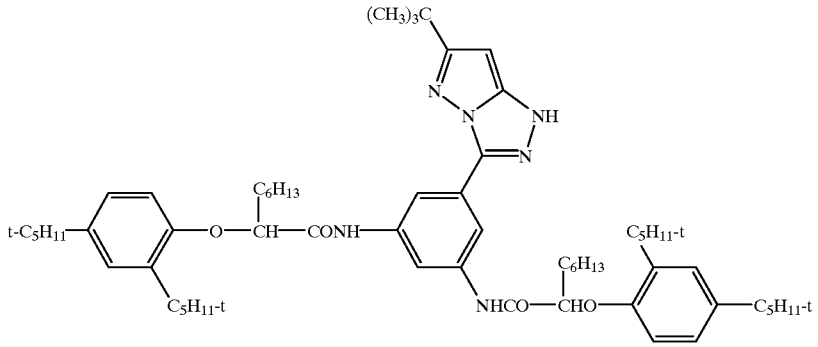
M-60
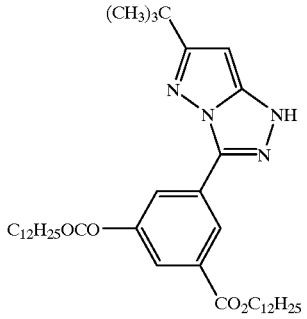
M-61
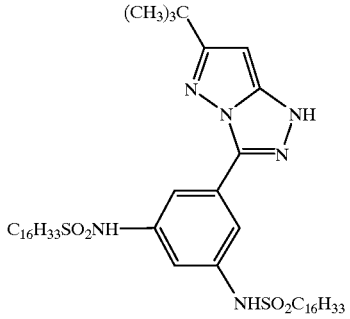

-continued
M-62
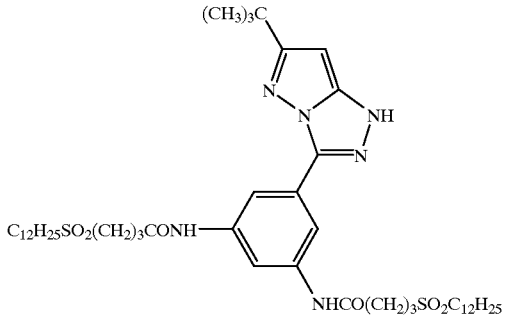
M-63
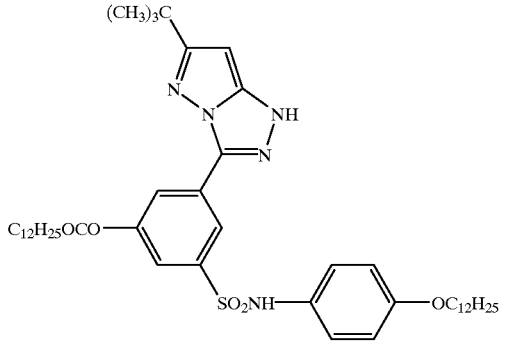
M-64
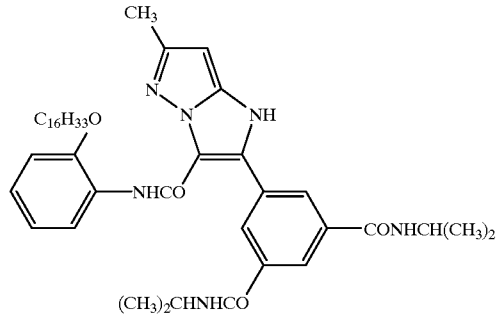
M-65
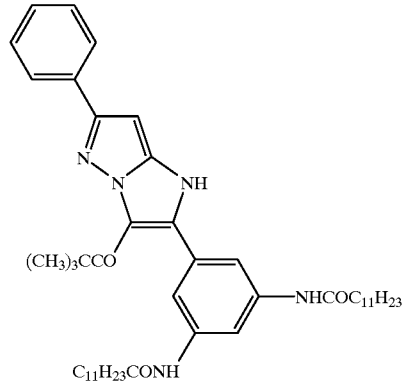

-continued
M-66
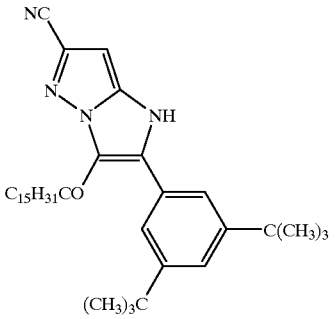
M-67
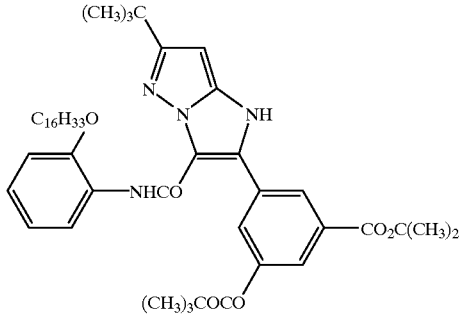
M-68
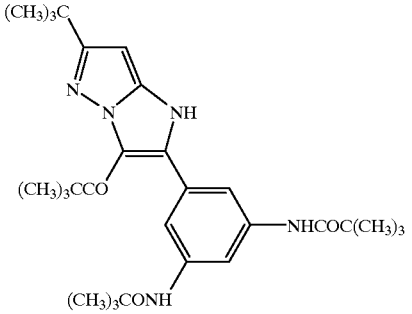
M-69
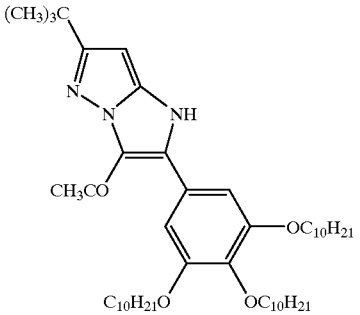

-continued
M-70
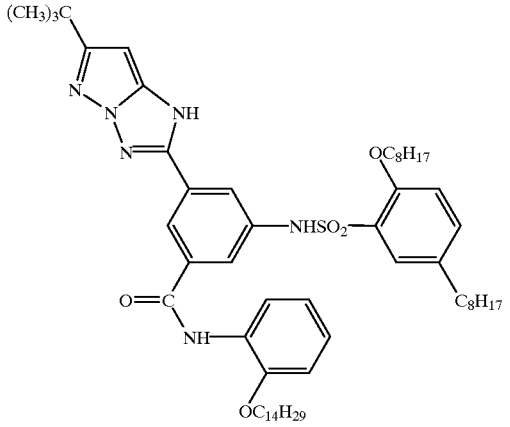
M-71
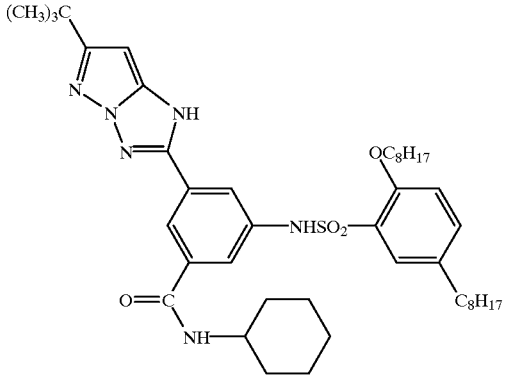
M-72
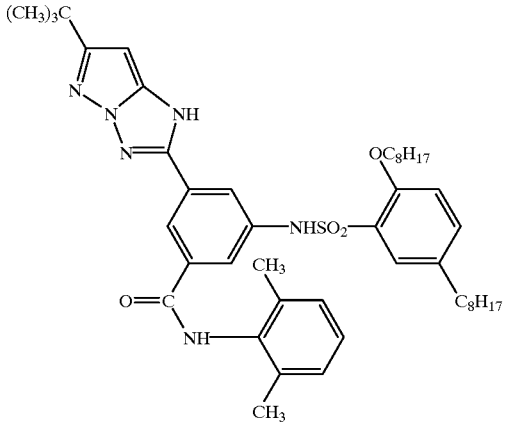

-continued

M-73

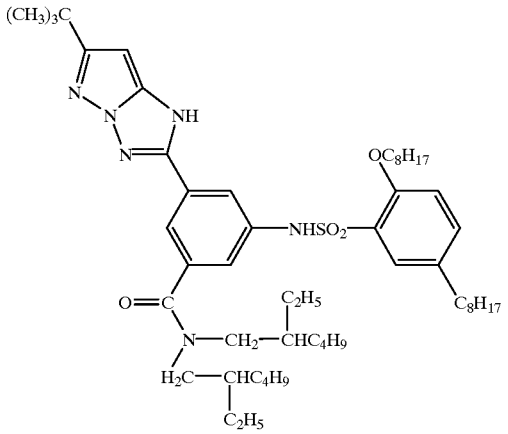

M-74

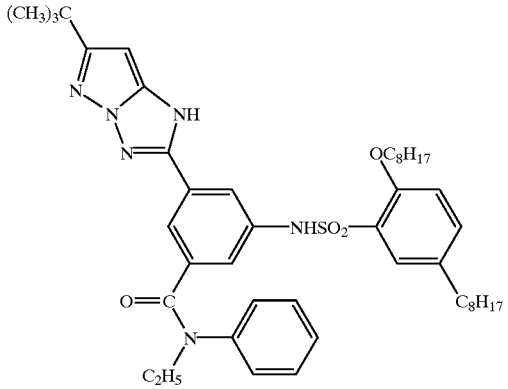

M-75

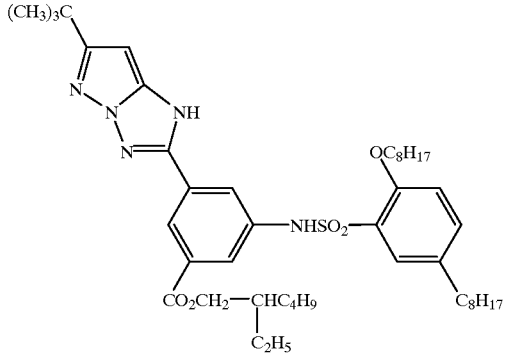

The couplers represented by formula (1), (2), or (3) used in the present invention can be synthesized in accordance with known methods described in the literature. Literature that describes methods for synthesizing couplers are shown below. Methods for synthesizing the couplers represented by formula (1) are described, for example, in U.S. Pat. Nos. 4,540,654, 4,705,863, JP-A-61-65245, JP-A-62-209457, JP-A-62-249155, JP-A-63-41851, JP-B-7-122744 ("JP-B" means examined Japanese patent publication), JP-A-5-105682, JP-A-7-13309, JP-A-7-82252, and U.S. Pat. No. 5,451,501; methods for synthesizing the couplers represented by formula (2) are described, for example, in JP-B-47-27411, U.S. Pat. No. 3,725,067, JP-A-63-101386, JP-A-63-101387, JP-A-2-201442, JP-A-2-101077, JP-A-3-125143, JP-A-4-242249, and U.S. Pat. No. 4,777,121, and methods for synthesizing the couplers represented by formula (3) are described, for example, in U.S. Pat. No. 4,500,630.

Examples of general synthesis schemes for the couplers represented by formula (1), (2), or (3) for use in the present invention are shown below:

Representative synthesis scheme for couplers represented by formula (1)

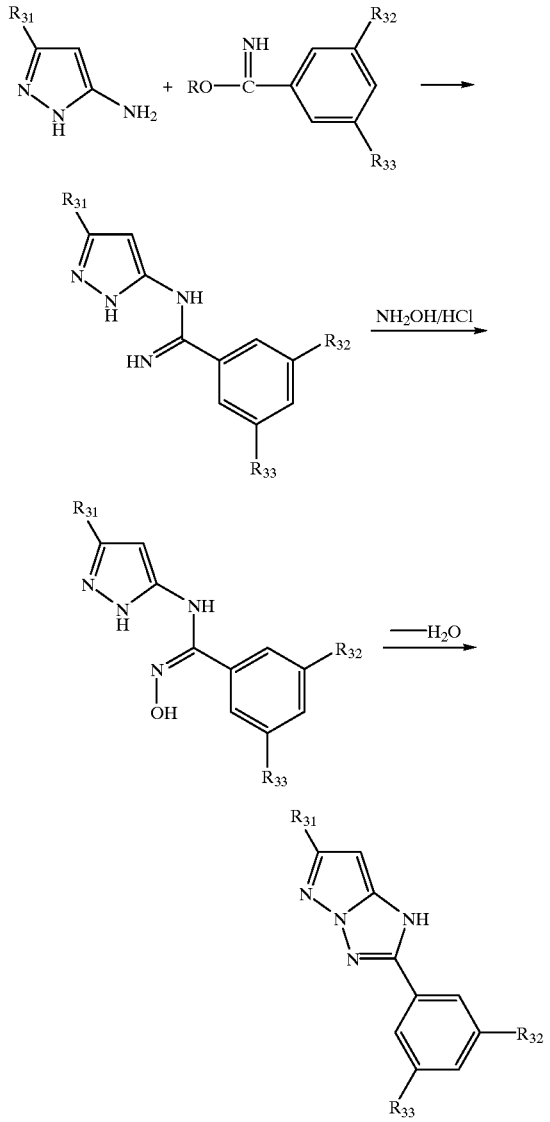

Representative synthesis scheme for couplers represented by formula (2)

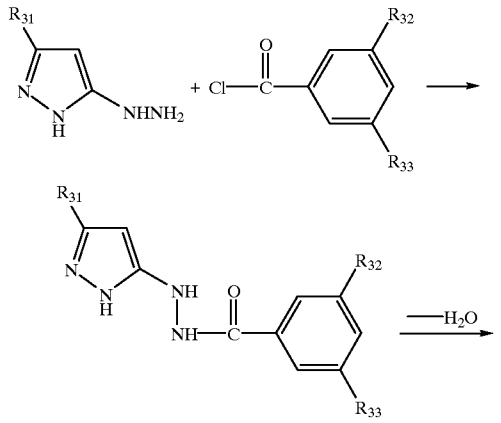

-continued

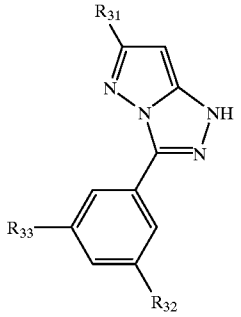

Representative synthesis scheme for couplers represented by formula (3)

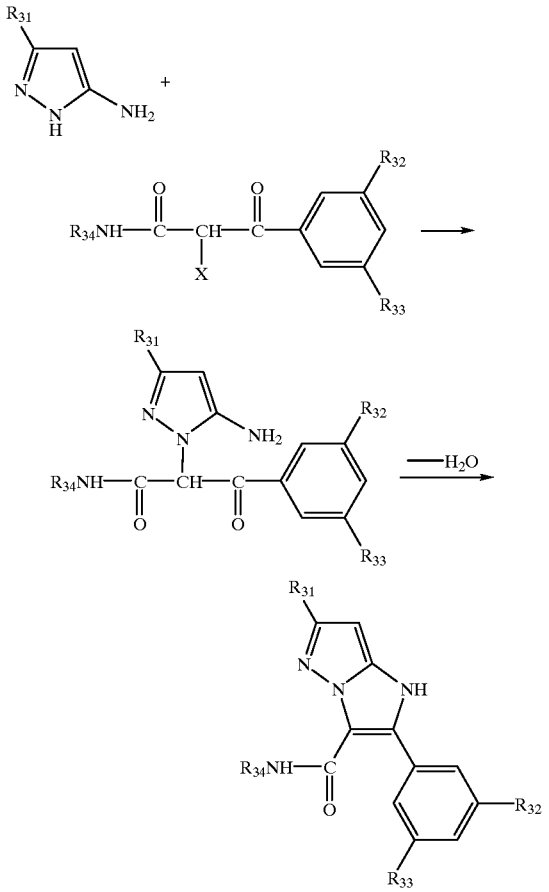

Specific synthetic examples of couplers used in the present invention are shown below:

Synthetic Example 1

(Synthesis of Exemplified Compound M-13)

Exemplified compound M-13 could be synthesized in accordance with the following scheme:

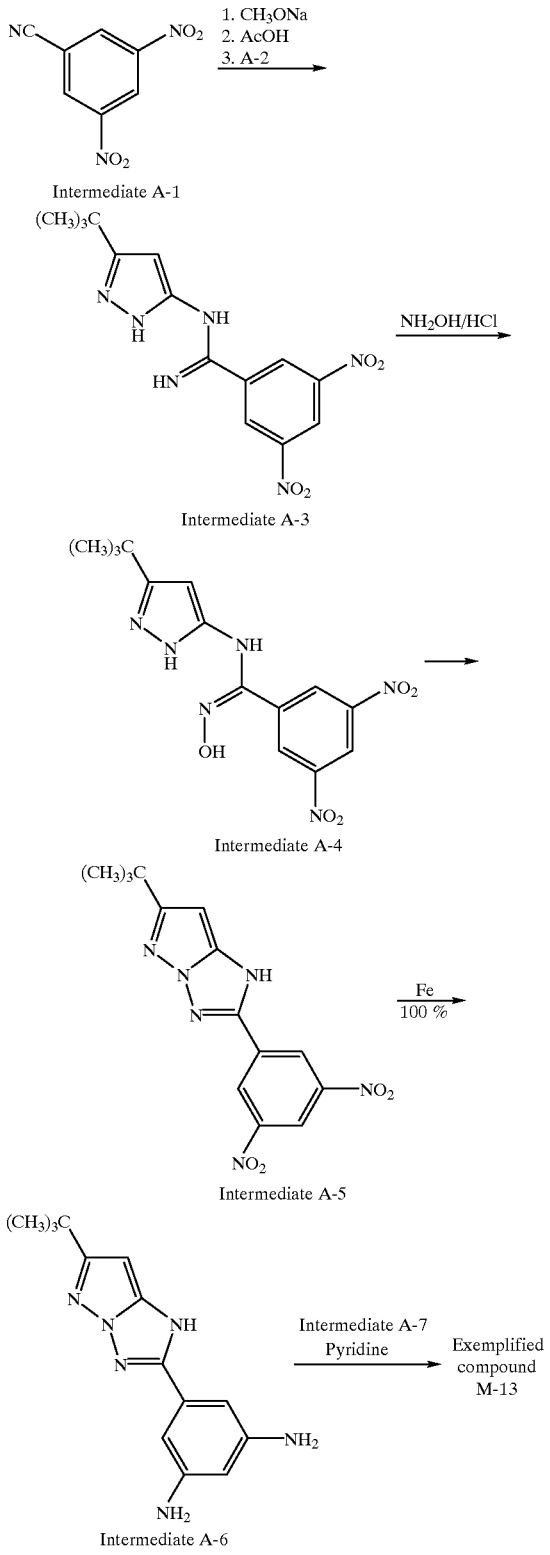

Synthesis of Intermediate A-4

19.3 g (0.100 mol) of 3,5-dinitrobenzonitrile (Intermediate A-1) was added to 100 ml of methanol; then 1.01 ml (5.00 mmol) of a 28% solution of sodium methoxide in methanol was added thereto, and the resultant mixture was stirred at room temperature for 30 min. After 6.28 ml (0.110 mol) of acetic acid was added thereto, followed by stirring for 10 min, 15 ml of N,N-dimethylacetamide (DMAC) and 13.9 g (0.100 mol) of 3-(t-butyl)-5-amino-1H-pyrazole (Intermediate A-2) were added, and the mixture was stirred at room temperature for 2.5 hours. Then, 13.9 g (0.200 mol) of hydroxylamine hydrochloride was added thereto, and the mixture was stirred at room temperature for 4 hours, and then at 50° C. for 3 hours. 75 ml of water was added thereto, dropwise, over 10 min, with cooling with water and stirring. The resultant crystals were collected by filtration and washed with water. After drying, 27.3 g (yield: 78.4%) of yellow crystals of Intermediate A-4 was obtained. Melting point: 214 to 223° C.

$^1$H NMR (DMSO-$d_6$) δ(ppm) 10.98 (s, 1H), 8.76 (s, 1H), 8.44 (s, 1H), 8.41 (s, 2H), 5.67 (s, 1H), 1.19 (s, 9H)

Synthesis of Intermediate A-5

25.0 g (71.8 mmol) of Intermediate A-4 was added to 100 ml of DMAC, and the mixture was cooled with a freezing medium, with stirring. 24.0 ml (151 mmol) of N,N-diethylaniline was added thereto, and 16.7 (75.4 mmol) of 4-chloro-3-nitrobenzenesulfonyl chloride was added, over 30 min in 6 portions, followed by stirring at 2 to 18° C. for 3 hours. After allowing the reaction mixture to stand overnight, 100 ml of methanol was added to the reaction mixture, and the reaction mixture was cooled with ice-water and stirred for 1 hour. The deposited crystals were filtered and washed with methanol. They were dried, to obtain 21.9 g (yield: 92.3%) of pale yellow crystals of Intermediate A-5.

Melting point: 143 to 155° C. (decomposed)

$^1$H NMR (DMSO-$d_6$) δ(ppm) 13.74 (brs, 1H), 9.13 (s, 2H), 8.90 (s, 1H), 5.89 (s, 1H), 1.32 (s, 9H)

Synthesis of Intermediate A-6

55.9 g (1.00 mol) of reduced iron, 2.68 g (50.0 mmol) of ammonium chloride, 130 ml of isopropyl alcohol, and 65 ml of water were placed in a three-necked flask; then 2.86 ml (50.0 mmol) of acetic acid was added thereto, and the mixture was heated under reflux for 15 min, with stirring. 33.0 g (0.100 mol) of Intermediate A-5 was added thereto, over 10 min, in portions, followed by stirring for 10 min. The reaction mixture was cooled to 45° C., and 16.0 g (0.400 mol) of sodium hydroxide dissolved in 50 ml of water was added. After stirring for 5 min, the reaction mixture was filtered through celite, and the celite was washed with 70 ml of water, and then 30 ml of isopropyl alcohol. 150 ml of water and 30 ml of isopropyl alcohol were added to the filtrate, and 22.8 ml (0.400 mol) of acetic acid was added, dropwise, with stirring. After stirring for 30 min, the deposited crystals were filtered, washed with water, and dried, to obtain 24.5 g (yield: 90.6%) of pale violet crystals of Intermediate A-6.

Melting point 243 to 254° C. (decomposed)

$^1$H NMR (DMSO-$d_6$) δ(ppm) 12.63 (brs, 1H), 6.36 (s, 2H), 5.96 (s, 1H), 5.63 (s, 1H), 5.02 (brs, 4H), 1.31 (s, 9H)

Synthesis of Exemplified Compound M-13

5.41 g (20.0 mmol) of Intermediate A-6 was added to 22 ml of DMAC, followed by stirring at room temperature. 18.4 g (44.0 mmol) of Intermediate A-7 (2-octyloxy-5-t-octylbenzenesulfonyl chloride) was added thereto, dropwise, over 15 min, and then 3.72 ml (46.2 mmol) of pyridine was added, dropwise, over 10 min. After the reaction mixture was stirred at room temperature for 1 hour, it was allowed to stand for a whole day and night. The reaction mixture was added to a mixed liquid of 100 ml of ethyl acetate and 100 ml of warm water, to carry out extraction. The organic layer was washed with 80 ml of warm water and 80 ml of brine, and then it was dried over anhydrous magnesium sulfate. It was then concentrated under reduced pressure in a rotary evaporator; 140 ml of methanol was added to the residue, and they were heated to dissolve the residue. 10 ml of water was added to the resulting solution, slowly, followed by stirring at room temperature for 4 hours. The deposited crystals were filtered, washed with a mixed solvent of methanol/water (70 ml/5 ml)., and dried, to obtain 14.0 g (yield: 68%) of colorless crystals of Exemplified compound M-13.

Melting point: 99 to 107° C.

$^1$H NMR (DMSO-$d_6$) δ(ppm) 12.90 (s, 1H), 10.01 (s, 2H), 7.74 (s, 2H), 7.49 (d, 2H), 7.27 (s, 2H), 7.02 (m, 3H), 5.58 (s, 1H), 4.01 (t, 4H), 1.67 (m, 4H), 1.58 (s, 4H), 1.4–1.2 (m, 40H), 0.85 (t, 6H), 0.43 (s, 18H)

Synthetic Example 2

(Synthesis of Exemplified Compound M-10)

Exemplified compound M-10 could be synthesized in accordance with the following scheme:

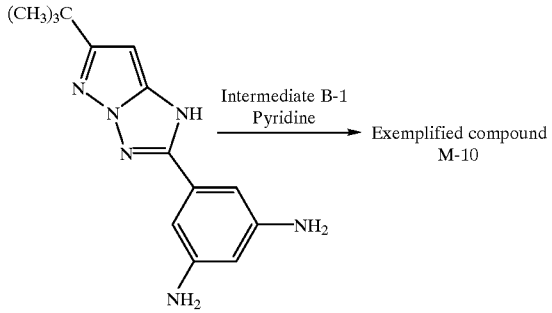

5.80 g (21.5 mmol) of Intermediate A-6 was added to 22 ml of DMAC, followed by stirring with cooling with water. 16.9 g (42.9 mmol) of Intermediate B-1 [2-(2,5-di-tert-amylphenoxy)octanoyl chloride] was added thereto, dropwise, over 15 min. After the reaction mixture was stirred at room temperature for 1.5 hour, it was allowed to stand for a whole day and night. The reaction mixture was added to a mixed liquid of 120 ml of ethyl acetate and 100 ml of water, to carry out extraction. The organic layer was washed with 100 ml of water and 100 ml of brine, and then it was dried over anhydrous magnesium sulfate. It was then concentrated under reduced pressure in a rotary evaporator, and the residue was purified by silica gel column chromatography, using hexane/ethyl acetate (15/1 to 10/1) as an eluent, to obtain 13.1 g (yield: 62%) of light-orange solid of Exemplified compound M-10.

Synthetic Example 3

(Synthesis of Exemplified Compound M-14)

Exemplified compound M-14 could be synthesized in accordance with the following scheme:

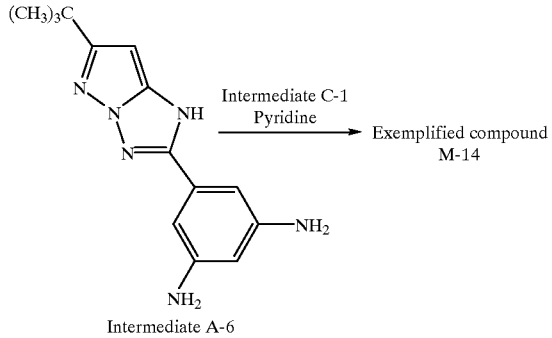

8.11 g (30.0 mmol) of Intermediate A-6 was added to 40 ml of DMAC, followed by stirring at room temperature. 5.33 ml (66.0 mmol) of pyridine was added thereto, and then 18.3 g (60.0 mmol) of crystals of Intermediate C-1 (2-butoxy-5-t-butylbenzenesulfonyl chloride) was added thereto. After the reaction mixture was stirred at room temperature for 3 hour, it was allowed to stand for a whole day and night. The reaction mixture was added to a mixed liquid of 200 ml of ethyl acetate and 200 ml of warm water, to carry out extraction. The organic layer was washed with 200 ml of warm water and 150 ml of brine, and then it was dried over anhydrous magnesium sulfate. It was then concentrated under reduced pressure in a rotary evaporator, and the residue was dissolved in 100 ml of ethyl acetate. 3 g of activated charcoal was added to the resultant solution. After stirring for 5 min, the solution was filtered through celite, and then the filtrate was concentrated under reduced pressure in a rotary evaporator. 50 ml of ethyl acetate was added to the residue, and the residue was dissolved with heating; then 100 ml of hexane was added thereto, followed by stirring for 3 hours. The deposited crystals were filtered to collect, washed with a mixed solvent of hexane/ethyl acetate (2/1), to obtain 17.0 g (yield: 70%) of slightly-violet crystals of Exemplified Compound M-14.

Melting point $^1$H NMR (DMSO-$d_6$) δ(ppm) 13.0 (s, 1H), 10.14 (s, 2H), 7.84 (s,2H), 7.53 (d, 2H), 7.36 (s, 2H), 7.08 (s, 1H), 7.04 (d, 2H), 5.64 (s, 1H), 3.94 (s, 4H), 1.58 (m, 4H), 1.33 (m, 4H), 1.30 (s, 9H), 1.22 (s, 18H), 0.83 (s, 6H)

The amount to be added of the coupler that is used in the present invention, varies according to its molar extinction coefficient (ε). In order to obtain an image density of 1.0 or more in terms of reflection density, in the case of the coupler wherein the ε of the dye that will be produced by coupling is of the order of 5,000 to 500,000, suitably the amount to be added, of the coupler that is used in the present invention, is of the order of generally 0.001 to 100 mmol/$m^2$, preferably 0.01 to 10 mmol/$m^2$, and more preferably 0.05 to 5 mmol/$m^2$, in terms of the coated amount.

The coupler for use in the present invention is contained in at least one layer on a base. Preferably, the coupler is contained in a light-sensitive silver halide emulsion layer, more preferably, it is contained in a green-sensitive silver halide emulsion layer. The light-sensitive silver halide emulsion layers are described later. The coupler for use in the present invention can be contained in at least one layer, by the usual method.

Next, the developing agent represented by formula (7) is described in detail.

The compounds represented by formula (7) represent developing agents collectively referred to as sulfonamidophenols. In the formula, $R_{21}$, $R_{22}$, $R_{23}$, and $R_{24}$ each represent a hydrogen atom or a substituent, and preferably each represent a hydrogen atom, a halogen atom, an alkyl group, an aryl group, a carbonamido group, an alkanesulfonamido group, an arenesulfonamido group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an acyl group, an alkoxycarbonyl group, an aryloxycarbonyl group, an alkylcarbonyl group, an arylcarbonyl group, or an acyloxy group; and $R_{25}$ represents a substituted or unsubstituted alkyl group, aryl group, or heterocyclic group. Preferable numbers of carbon atoms and specific examples of these groups are the same as those described for the group represented by $R_1$.

Particularly, $R_{21}$, $R_{22}$, $R_{23}$, and $R_{24}$ preferably each represent a halogen atom, an alkyl group, a carbonamido group, an alkanesulfonamido group, an arenesulfonamido group, an alkoxy group, an alkylthio group, an arylthio group, a carbamoyl group, a sulfamoyl group, a cyano group, an alkanesulfonyl group, an arenesulfonyl group, an acyl group, or an alkoxycarbonyl group. Among $R_{21}$ to $R_{24}$, $R_{22}$ and $R_{24}$ preferably each represent a hydrogen atom. The sum of the Hammett $\sigma_p$ values of $R_{21}$ to $R_{24}$ is 0 or more, and preferably 0.2 or more, with the upper limit being preferably 1.2, and more preferably 0.8. When the group represented by $R_{21}$, $R_{22}$, $R_{23}$, or $R_{24}$ is a group capable of having a substituent, the group may be substituted, and examples of the preferable substituent are the same as those mentioned as $R_1$.

$R_{25}$ preferably represents an aryl group, and particularly preferably a substituted aryl group represented by the following formula (8):

Formula (8)

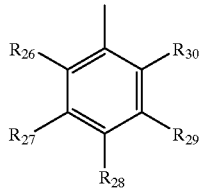

$R_{26}$, $R_{27}$, $R_{28}$, $R_{29}$, and $R_{30}$ in formula (8) each represent a hydrogen atom, a halogen atom, an alkyl group, an aryl group, a carbonamido group, an alkanesulfonamido group, an arenesulfonamido group, an alkoxy group, an aryloxy group, an alkylthio group, an arylthio group, a carbamoyl group, a sulfamoyl group, a cyano group, an alkanesulfonyl group, an arenesulfonyl group, an alkoxycarbonyl group, an aryloxycarbonyl group, or an acyl group, and at least one of $R_{26}$ to $R_{30}$ represents one of the above atoms or groups other than a hydrogen atom. Preferable numbers of carbon atoms and specific examples of the group represented by any of $R_{26}$ to $R_{30}$ are the same as those described for the group represented by $R_1$. $R_{26}$ and/or $R_{30}$ preferably have a substituent other than a hydrogen atom. $R_{26}$ and $R_{27}$, or $R_{29}$ and $R_{30}$ each may bond together to form a ring. When the group represented by any of $R_{26}$ to $R_{30}$ is a group capable of having a substituent, the group may be further substituted. Preferable examples of the substituent are the same as those described as $R_1$.

The compound represented by formula (7) is preferably an oil-soluble compound, when it is used for the purpose of the present invention. In view of that, the compound represented by formula (7) preferably contains at least one ballasting group. Herein, the ballasting group means a group capable of solubilizing in an oil, which is a group having an oil-soluble moiety structure with generally 8 or more, but 80 or less, carbon atoms, and preferably 10 or more, but 40 or less, carbon atoms. Therefore preferably there is a ballasting group having 8 or more carbon atoms in any of $R_{21}$ to $R_{24}$, or the sum of carbon atoms of $R_{26}$ to $R_{30}$ is 8 or more. The sum of carbon atoms of $R_{26}$ to $R_{30}$ is preferably 8 to 80, and more preferably 8 to 20.

The method for adding the coupler represented by formula (1), (2), or (3) and the developing agent represented by formula (7) can be carried out by mixing, first, the coupler, the developing agent, and a high-boiling organic solvent (e.g. an alkyl phosphate and an alkyl phthalate), dissolving the resultant mixture in a low-boiling organic solvent (e.g. ethyl acetate and methyl ethyl ketone), dispersing the resulting solution in water using an emulsifying and dispersing method known in the art, and adding the emulsified dispersion. The solid dispersion method described in JP-A-63-271339 can also be used for the addition.

The amount of the developing agent represented by formula (7) to be added may be in a wide range, but suitably it is preferably 0.01 to 100 times, and more preferably 0.1 to 10 times, the coupler in terms of mol.

The developing agent represented by formula (7) can be synthesized by known methods described, for example, in JP-A-9-146248.

Hereinbelow, specific examples of the compound represented by formula (7) are shown, but the compounds for use in the present invention are not limited to them.

D-1

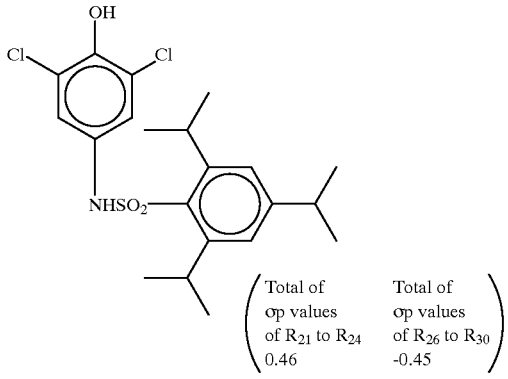

D-2

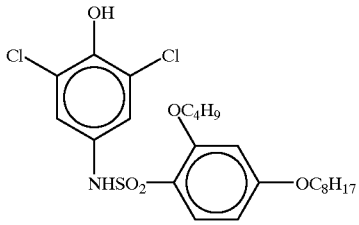

-continued
D-3
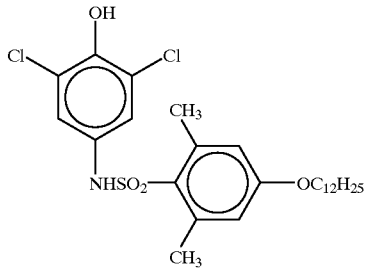
D-4
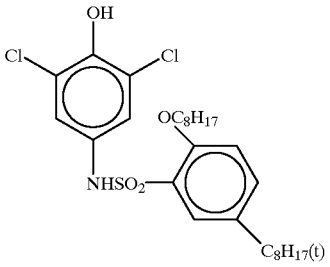
D-5
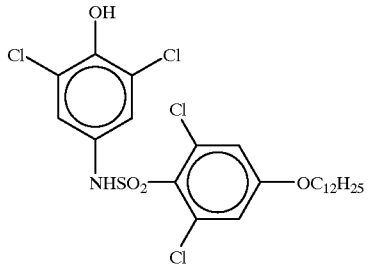
D-6
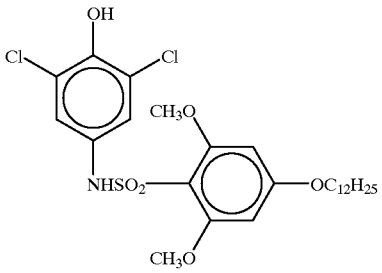
D-7
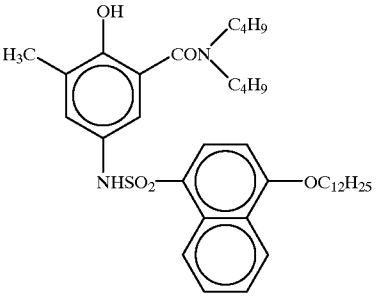
-continued
D-8
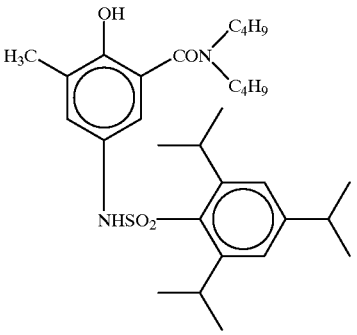
D-9
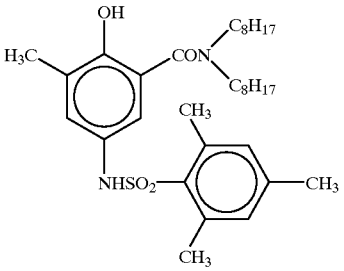
D-10
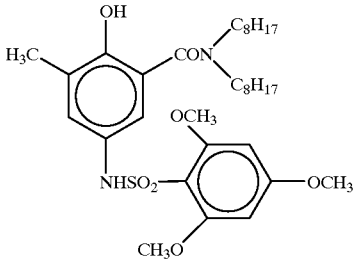
D-11
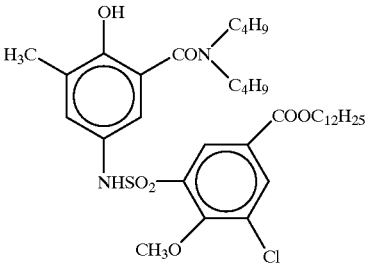
D-12
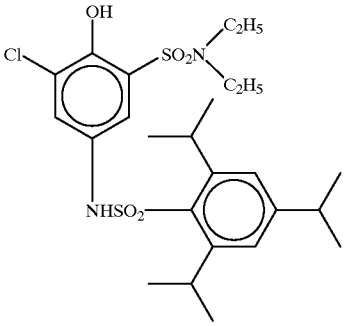

-continued
D-13
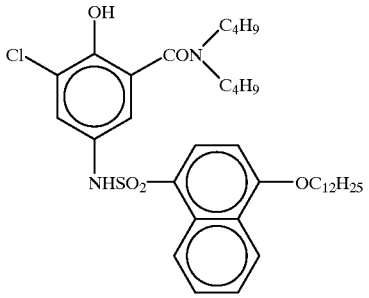
D-14
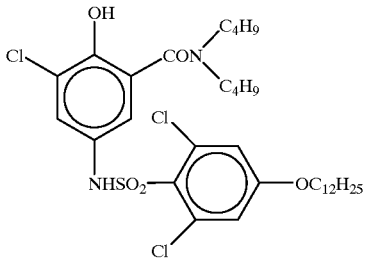
D-15
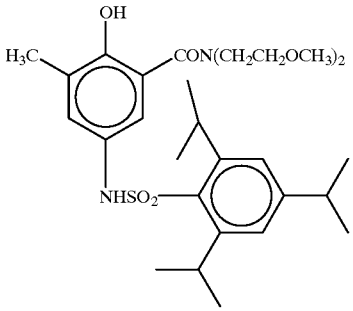
D-16
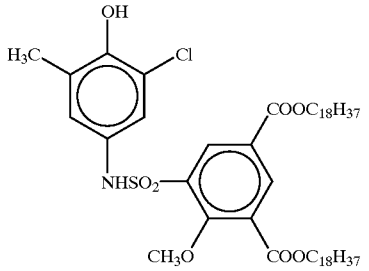
D-17
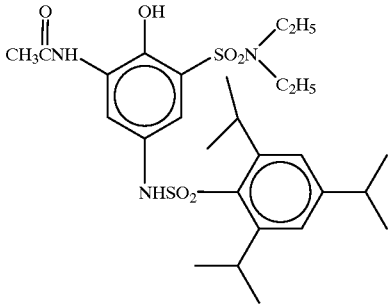
-continued
D-18
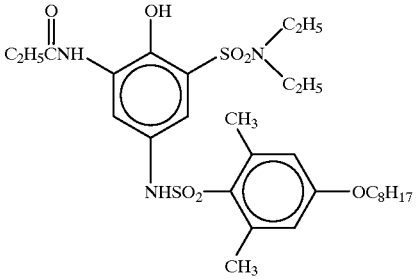
D-19
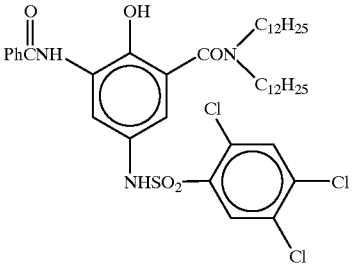
D-20
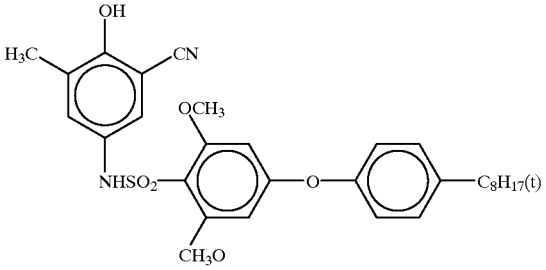
D-21
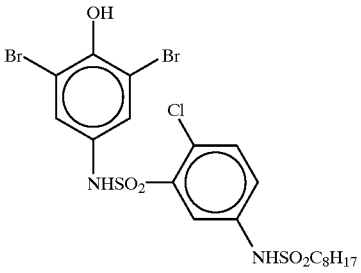
D-22
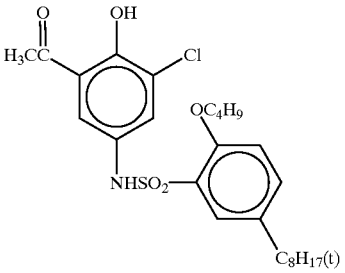

-continued
D-23
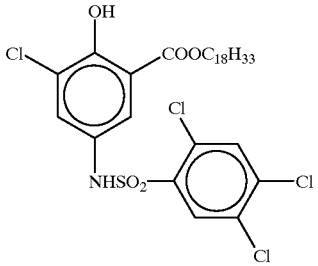
D-24
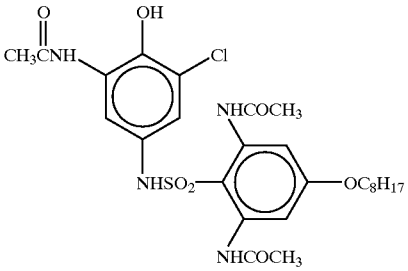
D-25
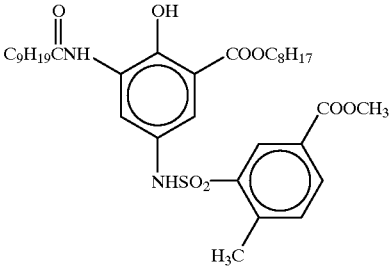
D-26
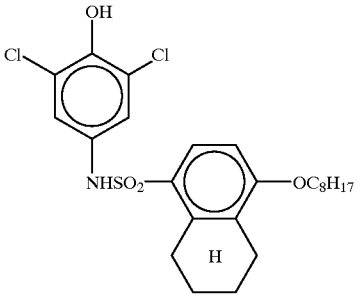
D-27
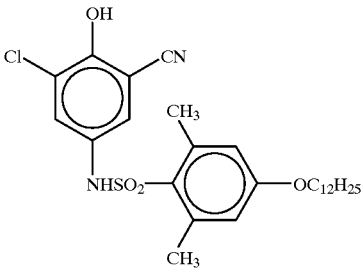
-continued
D-28
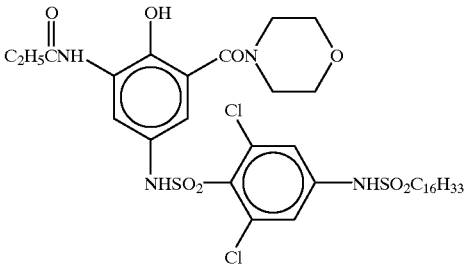
The coupler represented by formula (1), (2), or (3) used in the present invention may be used in a light-sensitive material that not.only contains the developing agent represented by formula (7) but also builds therein a developing agent, as shown below, that is described in Japanese patent application Nos. 8-357190 and 8-357191.
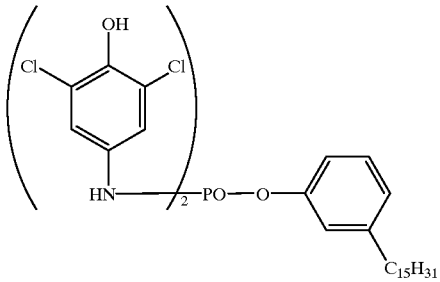
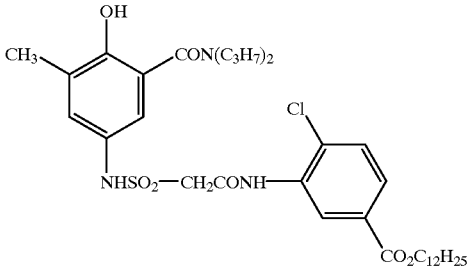
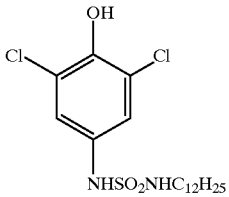
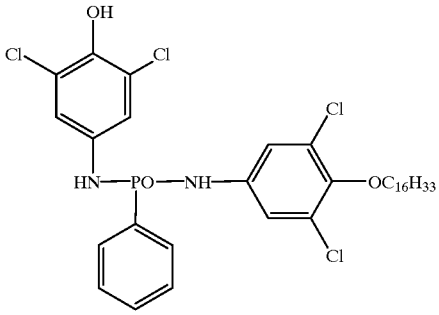

-continued

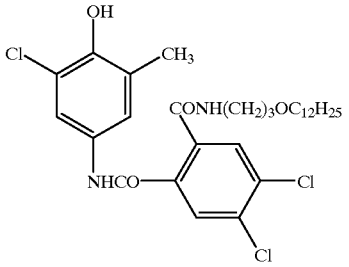

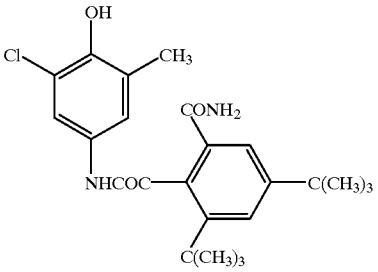

Further, the coupler represented by formula (1), (2), or (3) for use in the present invention may be used in a light-sensitive material that forms an image by subjecting it to development with a developer containing a developing agent, as shown below, that is described in Research Disclosure 37038 (February 1995), pages 102 and 111:

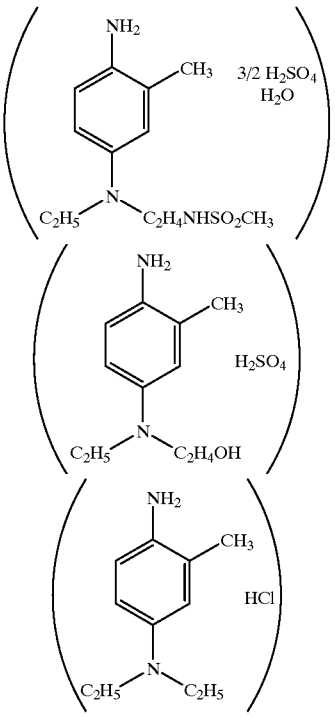

Further, the coupler represented by formula (1), (2), or (3) for use in the present invention may be used in the same layer or in a separate layer, in combination with a two-equivalent coupler and/or a four-equivalent coupler, described in JP-A-9-146248.

More preferably, the color light-sensitive material of the present invention basically has, on a base, a photosensitive silver halide, a coupler as a dye-providing material, a reducing agent, and a binder, to be contained, and it may contain, if required, an organic metal salt oxidant, and the like. In many cases, these components are added to the same layer of the photographic constitutional layers provided on a base, but they can be separately added to different layers of the photographic constitutional layers if the components are in reactive states.

In order to obtain colors ranging widely on the chromaticity diagram by using three primary colors: yellow, magenta, and cyan, use is made of a combination of at least three silver halide emulsion layers photosensitive to respectively different spectral regions. For examples, a combination of three layers of a blue-sensitive layer, a green-sensitive layer, and a red-sensitive layer, and a combination of a green-sensitive layer, a red-sensitive layer, and an infrared-sensitive layer, can be mentioned. The photosensitive layers can be arranged in various orders known generally for color photographic materials. Further, each of these photosensitive layers can be divided into two or more layers if necessary.

In the photographic material, various auxiliary layers can be provided, such as a protective layer, an underlayer, an intermediate layer, an antihalation layer, and a backing layer. Further, in order to improve the color separation, various filter dyes can be added.

Generally, in processing photographic light-sensitive materials, a base is needed, and in the light-sensitive material of the present invention, various methods for supplying a base can be employed. For example, to provide the light-sensitive side of the light-sensitive material with a function of generating a base, it is possible to introduce it as a base precursor into the light-sensitive material. Such a base precursor includes, for example, a salt of a base with an organic acid that can be decarboxylated by heat, and compounds that can release an amine by a intramolecular nucleophilic substitution reaction, Lossen rearrangement, or Backmann rearrangement. Examples thereof are described, for example, in U.S. Pat. Nos. 4,514,493 and 4,657,848.

Further, when the light-sensitive material is processed with it put together with a processing sheet, a method in which a base or a base precursor is introduced in the processing sheet can be used. In this case, as the base, in addition to an inorganic base, an organic base, such as an amine derivative, can be used.

The base precursors may be contained in the light-sensitive material and a processing sheet, respectively, with a base being generated by the reaction between them. Examples of the base-generating method of a two-agent reaction type like this to be used, are a reaction between a hardly soluble basic metal salt and a chelate agent, and a reaction between a nucleophilic agent and an epoxy compound. Examples thereof are described, for example, in JP-A-63-198050.

In this case, the light-sensitive material and the processing sheet may be heated with a small amount of a solvent (e.g. water) contained between them. The method for providing that solvent is described later. Further, as that solvent, a polar liquid, particularly water, is preferable.

As the base (support) of the light-sensitive material of the present invention, a base known in the art, particularly known as a base of heat development light-sensitive materials, can be used. Examples of such a base include a paper base laminated with a polyethylene and a base made of a polyester, such as a polyethylene terephthalate and a polyethylene naphthalate. Examples of these bases are described in JP-A-63-189860 in detail.

As the base of the light-sensitive material of the present invention, in addition to those mentioned above, a base obtained by stretching a styrene-series polymer having the syndiotactic configuration, can preferably be used. This polymer base may be made of a homopolymer or a copolymer, like the above-mentioned bases. Such a polymer base is described in Japanese patent application No. 7-45079 in detail. A preferable one in the light-sensitive material of the present invention is a transparent base.

The silver halide emulsion that is used in the present invention may be a surface-latent-image-type emulsion or an internal-latent-image-type emulsion. The internal-latent-image-type emulsion is used in combination with a nucleator or a light-fogging agent to be used as a direct reversal emulsion. A so-called core-shell emulsion, wherein the grain inside and the grain surface layer have different phases, and an emulsion wherein silver halides different in composition are joined epitaxially, may be used. The silver halide emulsion may be a monodisperse or a polydisperse emulsion. A technique is preferably used wherein the gradation is adjusted by mixing monodisperse emulsions, as described in JP-A-1-167743 or 4-223463. The grain size is preferably 0.1 to 2 $\mu$m, and particularly preferably 0.2 to 1.5 $\mu$m. The crystal habit of the silver halide grains may be any of regular crystals, such as cubic crystals, octahedral crystals and tetradecahedral crystals; irregular crystals, such as spherical crystals and tabular crystals having a high aspect ratio; crystals having crystal defects, such as twin planes, or other composite crystals of these.

Specifically, any of silver halide emulsions can be used that are prepared by methods described, for example, in U.S. Pat. No. 4,500,626, column 50; U.S. Pat. No. 4,628,021, Research Disclosure (hereinafter abbreviated to as RD) No. 17,029 (1978), RD No. 17,643 (December 1978), pages 22 to 23; RD No. 18,716 (November 1979), page 648; RD No. 307,105 (November 1989), pages 863 to 865; JP-A-62-253159, JP-A-64-13546, JP-A-2-236546, and JP-A-3-110555; by F. Glafkides in *Chemie et Phisique Photographique*, Paul Montel (1967); by G. F. Duffin in *Photographic Emulsion Chemistry*, Focal Press, 1966; and by V. L. Zelikman et al., in *Making and Coating Photographic Emulsion*, Focal Press, 1964.

In the process for preparing the light-sensitive silver halide emulsion for use in the present invention, so-called desalting, for removing excess salts, is preferably carried out. As a means for attaining it, the noodle water-washing method, which is carried out with the gelatin gelled, can be used, and also the sedimentation method, in which inorganic salts comprising polyvalent anions (e.g. sodium sulfate), an anionic surfactant, an anionic polymer (e.g. polystyrene-sulfonic acid sodium salt), or a gelatin derivative (e.g. an aliphatic-acylated gelatin, an aromatic-acylated gelatin, and an aromatic-carbamoylated gelatin) is employed, can be used, with the sedimentation method preferred.

The light-sensitive silver halide emulsion that is used in the present invention may contain a heavy metal, such as iridium, rhodium, platinum, cadmium, zinc, thallium, lead, iron, and, osmium, for various purposes. The compounds of the heavy metal may be used singly or in the form of a combination of two or more. The amount to be added varies depending on the purpose of the application; but the amount is generally on the order of $10^{-9}$ to $10^{-3}$ mol per mol of the silver halide. When they are incorporated, they may be incorporated uniformly in the grains, or they may be localized in the grains or on the surface of the grains. Specifically, emulsions described, for example, in JP-A-2-236542, 1-116637, and 5-181246 are preferably used.

In the step for forming grains of the light-sensitive silver halide emulsion for use in the present invention, as a silver halide solvent, a rhodanate, ammonia, a tetrasubstituted thioether compound, an organic thioether derivative described in JP-B-47-11386, or a sulfur-containing compound described in JP-A-53-144319 can be used.

As other conditions employed to prepare the emulsion in the present invention, the description, for example, by F. Glafkides in "Chemie et Phisique Photographique," Paul Montel, 1967; by G. F. Duffin in "Photographic Emulsion Chemistry," Focal Press, 1966; or by V. L. Zelikman et al. in "Making and Coating Photographic Emulsion," Focal Press, 1964, can be referred to. That is, any of the acid process, the neutral process, the ammonia process, and the like can be used; and to react a soluble silver salt with a soluble halogen salt, any of the single-jet method, the double-jet method, a combination thereof, and the like can be used. To obtain monodispersed emulsion, the double-jet method is preferably used.

A method wherein grains are formed in the presence of excess silver ions (the so-called reverse precipitation process) can also be used. As one type of the double-jet method, a method wherein pAg in the liquid phase, in which a silver halide will be formed, is kept constant, that is, the so-called controlled double-jet method, can also be used.

Further, to quicken the growth of the crystals, the concentrations, the amounts, and the speeds of the silver salt and the halide to be added may be increased (e.g. JP-A-55-142329 and 55-158124, and U.S. Pat. No. 3,650,757).

As the method of stirring the reaction liquid, any of known stirring methods may be used. The temperature and the pH of the reaction liquid during the formation of the silver halide grains may be set arbitrarily to meet the purpose. Preferably the pH range is 2.2 to 8.5, and more preferably 2.5 to 7.5.

The light-sensitive silver halide emulsion is generally a chemically sensitized silver halide emulsion. To chemically sensitize the light-sensitive silver halide emulsion for use in the present invention, a known method for emulsions used in general light-sensitive materials, for example, a chalcogen sensitization method, such as the sulfur sensitization method, the selenium sensitization method, and the tellurium sensitization method; the noble metal sensitization method, wherein gold, platinum, or palladium is used; and the reduction sensitization method, can be used alone or in combination (e.g. JP-A-3-110555 and 5-241267). These chemical sensitizations can be carried out in the presence of a nitrogen-containing heterocyclic compound (JP-A-62-253159). Further, the below-mentioned antifoggant can be added after the completion of the chemical sensitization. Specifically, methods described in JP-A-5-45833 and 62-40446 can be used.

At the time of the chemical sensitization, the pH is preferably 5.3 to 10.5, and more preferably 5.5 to 8.5, and the pAg is preferably 6.0 to 10.5, and more preferably 6.8 to 9.0.

The coating amount of the light-sensitive silver halide emulsion used in the present invention is generally in the range of 1 mg to 10 g/m$^2$ in terms of silver.

When the photosensitive silver halide used in the present invention is made to have color sensitivities of green sensitivity, red sensitivity, and infrared sensitivity, the photosensitive silver halide emulsion is spectrally sensitized with methine dyes or the like. If required, the blue-sensitive emulsion may be spectrally sensitized in the blue region.

Dyes that can be used include cyanine dyes, merocyanine dyes, composite cyanine dyes, composite merocyanine dyes, halopolar cyanine dyes, hemicyanine dyes, styryl dyes, and hemioxonol dyes.

Specifically, sensitizing dyes described, for example, in U.S. Pat. No. 4,617,257 and JP-A-59-180550, 64-13546, 5-45828, and 5-45834 can be mentioned.

These sensitizing dyes can be used singly or in combination, and a combination of these sensitizing dyes is often used, particularly for the purpose of adjusting the wavelength of the spectral sensitivity, and for the purpose of supersensitization.

Together with the sensitizing dye, a dye having no spectral sensitizing action itself, or a compound that does not substantially absorb visible light and that exhibits supersensitization, may be included in the emulsion (e.g. those described, for example, in U.S. Pat. No. 3,615,641 and JP-A-63-23145).

The time when these sensitizing dyes are added to the emulsion may be at a time of chemical ripening or before or after chemical ripening. Further, the sensitizing dye may be added before or after the formation of nuclei of the silver halide grains, in accordance with U.S. Pat. Nos. 4,183,756 and 4,225,666. Further, these sensitizing dyes and supersensitizers may be added in the form of a solution of an organic solvent, such as methanol, or in the form of a dispersion of gelatin, or in the form of a solution of a surface-active agent. Generally the amount of the sensitizing dye to be added is of the order of $10^{-8}$ to $10^{-2}$ mol per mol of the silver halide.

These additives used in the above process, and conventionally known additives for photography that can be used in the processing sheets and the light-sensitive materials of the present invention, are described in the above Research Disclosure No. 17643, Research Disclosure No. 18715, and Research Disclosure No. 307105, whose particular parts are given below in a table.

| Additive | RD 17643 | RD 18716 | RD 307105 |
|---|---|---|---|
| 1 Chemical sensitizers | p. 23 | p. 648 (right column) | p. 866 |
| 2 Sensitivity-enhancing agents | — | p. 648 (right column) | |
| 3 Spectral sensitizers and Supersensitizers | pp. 23–24 | pp. 648 (right column)–649 (right column) | pp. 866–868 |
| 4 Fluorescent whitening agents | p. 24 | p. 648 (right column) | p. 868 |
| 5 Antifogging agents and Stabilizers | pp. 24–25 | p. 649 (right column) | pp. 868–870 |
| 6 Light absorbers, Filter dyes, and UV Absorbers | pp. 25–26 | pp. 649 (right column)–650 (left column) | p. 873 |
| 7 Image-dye stabilizers | p. 25 | p. 650 (left column) | p. 872 |
| 8 Hardeners | p. 26 | p. 651 (left column) | pp. 874–875 |
| 9 Binders | p. 26 | p. 651 (left column) | pp. 873–874 |
| 10 Plasticizers and Lubricants | p. 27 | p. 650 (right column) | p. 876 |
| 11 Coating aids and Surface-active agents | pp. 26–27 | p. 650 (right column) | pp. 875–876 |
| 12 Antistatic agents | p. 27 | p. 650 (right column) | pp. 876–877 |
| 13 Matting agents | — | — | pp. 878–879 |

As the binder of the constitutional layer of the light-sensitive material, a hydrophilic binder is preferably used. Examples thereof include those described in the above-mentioned Research Disclosures and JP-A-64-13546, pages (71) to (75). Specifically, a transparent or semitransparent hydrophilic binder is preferable, and examples include proteins, such as gelatin and gelatin derivatives; cellulose derivatives; such natural compounds as polysaccharides, including starches, acacia, dextrans, and pullulan; and such synthetic polymer compounds as polyvinyl alcohols, polyvinyl pyrrolidones, and acrylamide polymers. Highly water-absorptive polymers described, for example, in U.S. Pat. No. 4,960,681 and JP-A-62-245260; that is, homopolymers of vinyl monomers having —COOM or —$SO_3$M (M represents a hydrogen atom or an alkali metal), or copolymers of these vinyl monomers, or this vinyl monomer(s) with another vinyl monomer (e.g., those comprising sodium methacrylate or ammonium methacrylate, including Sumika Gel L-5H, trade name, manufactured by Sumitomo Chemical Co., Ltd.) can also be used. Two or more of these binders can be combined and used. Particularly, combinations of gelatin with the above binders are preferable. As the gelatin, lime-processed gelatin, acid-processed gelatin, or de-ashed gelatin, wherein the contents of calcium, etc., are reduced, can be selected to meet various purposes, and combinations of these gelatins are also preferably used.

In the present invention, the light-sensitive silver halide emulsion may be used together with an organic metal salt as an oxidizing agent. Among the organic metal salts, organosilver salt is particularly preferably used.

As the organic compound that can be used to form the above organosilver salt oxidizing agent, benzotriazoles, aliphatic acids, and other compounds, as described in U.S. Pat. No. 4,500,626, columns 52 to 53, can be mentioned. Also useful is acetylene silver described in U.S. Pat. No. 4,775,613. Organosiliver salts may be used in the form of a combination of two or more.

The above organosilver salts may be used additionally in an amount of generally 0.01 to 10 mol, and preferably 0.01 to 1 mol, per mol of the light-sensitive silver halide. Suitably the total coating amount of the light-sensitive silver halide emulsion plus the organosilver salt is generally 0.05 to 10 g/$m^2$, and preferably 0.1 to 4 g/$m^2$, in terms of silver.

In the light-sensitive material of the present invention, use can be made of a compound to attain both the activation of development and the stabilization of an image. Specific compounds that can be preferably used are described in U.S. Pat. No. 4,500,626 columns 51 to 52. Further, use can be made of a compound capable of fixing a silver halide, as described in Japanese patent application No.6-206331.

As the hardener used in constitutional layers of the light-sensitive material, can be mentioned hardeners described, for example, in the above Research Disclosures, U.S. Pat. No. 4,678,739, column 41; U.S. Pat. No. 4,791,042, and JP-A-59-116655, 62-245261, 61-18942, and 4-218044. More specifically, aldehyde-series hardeners (e.g. formaldehyde), aziridine-series hardeners, epoxy-series hardeners, vinyl sulfone-series hardeners (e.g. N,N'-ethylene-bis(vinylsulfonylacetamide)ethane), N-methylol-series hardeners (e.g. dimethylol urea), or polymer hardeners (e.g. compounds described, for example, in JP-A-62-234157) can be mentioned.

These hardeners are used in an amount of 0.001 to 1 g, and preferably 0.005 to 0.5 g, per g of the coated gelatin. The layer into which the hardeners are added may be any of layers that constitute the photographic material or the dye-fixing material, or the hardener may be divided into two or more parts, which are added into two or more layers.

In the constitutional layers of the photographic material of the present invention, various antifoggants or photographic stabilizers and their precursors can be used. Specific examples thereof include compounds described, for example, in the above-mentioned Research Disclosures, U.S. Pat. Nos. 5,089,378, 4,500,627, and 4,614,702, JP-A-64-13546 (pages (7) to (9), (57) to (71), and (81) to (97)), U.S. Pat. Nos. 4,775,610, 4,626,500, and 4,983,494, JP-A-62-174747, 62-239148, 63-264747, 1-150135, 2-110557, and 2-178650, and Research Disclosure No. 17,643 (1978), pages (24) to (25).

These compounds are preferably used in an amount of $5\times10^{-6}$ to $1\times10^{-1}$ mol, and more preferably $1\times10^{-5}\times1\times10^{-2}$ mol, per mol of silver.

In the constitutional layers of the photographic material of the present invention, use can be made of various surface-active agents for various purposes of, for example, serving as a coating aid, improving releasability and slipping property, preventing electrification, or accelerating development. Specific examples of the surface-active agents are described, for example, in the above Research Disclosures and JP-A-62-173463 and 62-183457.

In the case of a heat development photographic material, also preferably an organofluoro compound is contained in the constitutional layer, for example, for the purposes of improving slipping properties, preventing electrification, and improving releasability. Typical examples of the organofluoro compound are hydrophobic fluoro compounds, including solid fluoro compound resins, such as ethylene tetrafluoride resins, or oily fluoro compounds, such as fluoro oils; or fluorine-containing surface-active agents described, for example, in JP-B-57-9053, column 8 to column 17, JP-A-61-20944 and 62-135826.

In the photographic material of the present invention, a matting agent can be used for the purpose of adhesion prevention, improvement of slipping property, matting, etc. Example matting agents include compounds, including silicon dioxide, polyolefins, polymethacrylates, and the like, as described in JP-A-61-88256, page (29), as well as compounds, including benzoguanamine resin beads, polycarbonate resin beads, ABS resin beads, and the like, described in JP-A-63-274944 and 63-274952. Other matting agents described in the above RD can be used. These matting agents are added into the uppermost layer (protective layer), and also into a lower layer if required.

Further, the constitutional layers of a photographic material may contain a heat solvent, an antifoaming agent, a germ-proofing agent, a mildew-proofing agent, colloidal silica, etc. Specific examples of these additives are described, for example, in JP-A-61-88256, pages (26) to (32); JP-A-3-11338, and JP-B-2-51496.

In the present invention, an image-formation-accelerating agent can be used in the light-sensitive material. Image-formation-accelerating agents function, for example, to accelerate the redox reaction between a silver salt oxidizing agent and a reducing agent, and to accelerate a dye formation reaction, and they are classified, from the physicochemical functional point of view, for example, into bases or base precursors, nucleophilic compounds, high-boiling organic solvents (oils), heat solvents, surfactants, and compounds interactive with silver or silver ions. However, generally these compounds have a composite function, and they usually possess some of the above acceleration effects in combination. The details thereof are described in U.S. Pat. No. 4,678,739, columns 38 to 40.

In a heat development photographic material of the present invention, in order to obtain a constant image all the time against fluctuation of the processing temperature and the processing time at the time of development, various development-stopping agents can be used.

Herein, the term "a development-stopping agent" means a compound that neutralizes bases quickly or reacts quickly with bases after suitable development, to lower the base concentration in the film, to stop the development; or a compound that interacts with silver and silver salts, to inhibit the development. Specific examples include acid precursors that release an acid when heated, electrophilic compounds that undergo a substitution reaction with coexisting bases when heated, nitrogen-containing heterocyclic compounds, mercapto compounds, and their precursors. Details are described in JP-A-62-253159, pages (31) to (32).

Example methods of exposing the photographic material to light and recording the image, include a method wherein a landscape, a man, or the like is directly photographed by a camera or the like; a method wherein a reversal film or a negative film is exposed to light using, for example, a printer, or an enlarging apparatus; a method wherein an original picture is subjected to scanning exposure through a slit by using an exposure system of a copying machine or the like; a method wherein light-emitting diodes and various lasers (e.g. laser diodes and gas lasers) are allowed to emit light, to carry out scanning exposure through image information and electrical signals (methods described, for example, in JP-A-2-129625, 5-176144, 5-199372, 6-127021); and a method wherein image information is outputted to an image display apparatus, such as a CRT, a liquid crystal display, an electroluminescence display, and a plasma display, and exposure is carried out directly or through an optical system.

Light sources that can be used for recording an image on the photographic material, as mentioned above, include natural light and light sources and exposure methods described in U.S. Pat. No. 4,500,626, column 56, and JP-A-2-53378 and 2-54672, such as a tungsten lamp, a light-emitting diode, a laser light source, and a CRT light source.

Image-wise exposure can be carried out by using a wavelength-converting element that uses a nonlinear optical material and a coherent light source, such as laser rays, in combination. Herein the term "nonlinear optical material" refers to a material that can develop nonlinearity of the electric field and the polarization that appears when subjected to a strong photoelectric field, such as laser rays, and inorganic compounds, represented by lithium niobate, potassium dihydrogenphosphate (KDP), lithium iodate, and $BaB_2O_4$; urea derivatives, nitroaniline derivatives, nitropyridine-N-oxide derivatives, such as 3-methyl-4-nitropyridine-N-oxide (POM); and compounds described in JP-A-61-53462 and 62-210432 can be preferably used. As the form of the wavelength-converting element, for example, a single crystal optical waveguide type and a fiber type are known, both of which are useful.

The above image information can employ, for example, image signals obtained from video cameras, electronic still cameras, and the like; television signals, represented by Nippon Television Singo Kikaku (NTSC); image signals obtained by dividing an original picture into a number of picture elements by a scanner or the like; and an image signals produced by a computer, represented by CG or CAD.

In order to process the photographic material of the present invention by heat development, it may be in a form having an electro-conductive heat-generating element layer, which serves as a heating means for heat development. In this case, as the heat-generating element, those described, for example, in JP-A-61-145544 can be employed.

The heating temperature in the heat development step is generally about 60 to 200° C., and preferably about 80 to 180° C. The heating time is generally 0.1 to 60 sec.

Examples of heating methods in the development step include one wherein the photographic material is brought in contact with a heated block or plate; a method wherein the photographic material is brought in contact with a hot plate, a hot presser, a hot roller, a hot drum, a halogen lamp heater, an infrared lamp heater, or a far-infrared lamp heater; and a method wherein the photographic material is passed through a high-temperature atmosphere.

As a method wherein the photographic material and a processing sheet are placed one upon the other, methods described in JP-A-62-253159 and 61-147244, on page (27), can be applied.

The coupler represented by formula (1), (2), or (3) for use in the present invention, exhibits its preferable properties even in the conventional color negative light-sensitive material, color reversal light-sensitive material, and color print light-sensitive material which are subjected to development using the developing solution described in Research Disclosures No. 38957 (1996) and No. 37038 (1995). As various techniques and inorganic or organic materials that can be used for the silver halide photographic emulsion for use in the light-sensitive material of the present invention and the silver halide photographic light-sensitive materials wherein said silver halide photographic emulsion is used, generally those described in the Research Disclosures No. 308119 (1998) and No. 37038 (1995) can be used.

In addition thereto, more specifically, for example, techniques and inorganic or organic materials that can also be used for color photographic light-sensitive materials to which the silver halide photographic emulsion for use in the present invention can be applied, are described in the below-shown sections in EP-A-436 938 (A2) and the below-shown patents cited therein.

| Item | Corresponding section |
|---|---|
| 1) Layer structures | page 146, line 34 to page 147, line 25 |
| 2) Silver halide emulsions | page 147, line 26 to page 148, line 12 |
| 3) Yellow couplers that can be used in combination | page 137, line 35 to page 146, line 33, and page 149, lines 21 to 23 |
| 4) Magenta couplers that can be used in combination | page 149, lines 24 to 28; and EP-A-421, 453 (A1), page 3, line 5 to page 25, line 55 |
| 5) Cyan couplers that can be used in combination | page 149, lines 29 to 33; and EP-A-432, 804, (A2), page 3, line 28 to page 40, line 2 |
| 6) Polymer couplers | page 149, lines 34 to 38; and EP-A-435, 334 (A2), page 113, line 39 to page 123, line 37 |
| 7) Colored couplers | page 53, line 42 to page 137, line 34, and page 149, lines 39 to 45 |
| 8) Other functional couplers that can be used in combination | page 7, line 1 to page 53, line 41, and page 149, line 46 to page 150, line 3; and EP-A-435, 334 (A2), page 3, line 1 to page 29, line 50 |
| 9) Antiseptics and mildew-proofing agents | page 150, lines 25 to 28 |
| 10) Formalin scavengers | page 149, lines 15 to 17 |

-continued

| Item | Corresponding section |
|---|---|
| 11) Other additives that can be used in combination | page 153, lines 38 to 47; and EP-A-421, 453 (A1), page 75, line 21 to page 84, line 56, and page 27, line 40 to page 37, line 40 |
| 12) Dispersion methods | page 150, lines 4 to 24 |
| 13) Supports (Bases) | page 150, lines 32 to 34 |
| 14) Film thickness and film physical properties | page 150, lines 35 to 49 |
| 15) Color-development steps | page 150, line 50 to page 151, line 47 |
| 16) Desilvering steps | page 151, line 48 to page 152, line 53 |
| 17) Automatic processors | page 152, line 54 to page 153, line 2 |
| 18) Washing/stabilizing steps | page 153, lines 3 to 37 |

According to the silver halide color light-sensitive material of the present invention, even when a p-sulfonamidophenol-type developing agent is built-in the light-sensitive material, an image excellent in discrimination can be obtained, and the storage stability of the light-sensitive material before and after processing thereof is excellent, that is both the minimum density and the maximum density are low before processing, while the minimum density is low after processing.

Now, the present invention is described in more detail based on the following examples, but the present invention is not limited to these.

EXAMPLES

Example 1

(Method of Preparing Light-sensitive Silver Halide Emulsions)

The method of preparing the blue-light-sensitive silver halide emulsion (1) is shown below:

0.96 g of gelatin, having an average molecular weight of 12,000, and 1,191 ml of distilled water containing 0.9 g of potassium bromide, were placed in a reaction vessel, and the temperature was elevated to 40° C. 10.5 ml of an aqueous solution (A) containing 0.5 g of silver nitrate, and 10 ml of an aqueous solution (B) containing 0.35 g of potassium bromide, were added to the resulting solution, over 150 sec, with vigorous stirring. 30 sec after the completion of the addition, 12 ml of a 10% aqueous solution of potassium bromide was added, and after 30 sec, the temperature of the reaction solution was raised to 75° C. After 35.0 g of lime-processed gelatin was added, together with 250 ml of distilled water, 39 ml of an aqueous solution (C) containing 10.0 g of silver nitrate, and 30 ml of an aqueous solution (D) containing 6.7 g of potassium bromide, were added, over 3 min 15 sec, with the flow rate of the addition being accelerated. Then, 302 ml of an aqueous solution (E) containing 96.7 g of silver nitrate, and an aqueous solution (F) containing potassium iodide and potassium bromide in a molar ratio of 7:93 (the concentration of potassium bromide: 26%), were added, over 20 min, with the flow rate of the addition being accelerated, so that the silver electric potential of the reaction liquid would become −20 mV to a saturated calomel electrode. Further, 97 ml of an aqueous solution (G) containing 24.1 g of silver nitrate, and a 21.9% aqueous solution (H) of potassium bromide, were added, over 3 min, so that the silver electric potential of the reaction liquid would become 25 mV to the saturated calomel electrode. After the completion of the addition, the temperature was kept at 75° C. for 1 min; then the temperature of the reaction liquid was dropped to 55° C. Then, 15 ml of 1N sodium hydroxide was added. Thereafter, after 2 min, 100 ml of an aqueous solution (I) containing 5 g of silver nitrate, and 200.5 ml of an aqueous solution (J) containing 4.7 g of potassium iodide, were added, over 5 min. After the completion of the addition, 7.11 g of potassium bromide was added, the temperature was kept at 55° C. for 1 min, and then 248 ml of an aqueous solution (K) containing 62 g of silver nitrate, and 231 ml of an aqueous solution (L) containing 48.1 g of potassium bromide, were added, over 8 min. After 30 sec, an aqueous solution containing 0.03 g of sodium ethylthiosulfonate was added. The temperature was then dropped, and then Demol, trade name, manufactured by Kao Corporation, was used to carry out desalting, by causing grains in the resulting emulsion to aggregate and sedimentate. Dispersion was carried out by adding sodium bezenethiosulfonate, phenoxyethanol, a water-soluble polymer (10), and lime-processed gelatin. Chemical sensitization was carried out at 60° C. A dispersion of a sensitizing dye (12) in gelatin was added before the chemical sensitization; then, after a liquid of a mixture of potassium thiocyanate with chloroauric acid was added, sodium thiosulfate and a selenium sensitizer were added, and the chemical sensitization was stopped, using a mercapto compound. The amounts of the sensitizing dyes, the chemical sensitizers, and the mercapto compound were optimized with respect to the sensitization and fogging.

With respect to the obtained grains, tabular grains amounted to over 99% of the total projected area of all grains, the average sphere equivalent diameter (the average diameter of spheres each equivalent to a grain volume) was 1.07 μm, the average thickness was 0.38 μm, the equivalent circle diameter (the diameter of a circle equivalent to the projected area of each grain) was 1.47 μm, and the aspect ratio was 3.9.

Sensitizing dye (12)

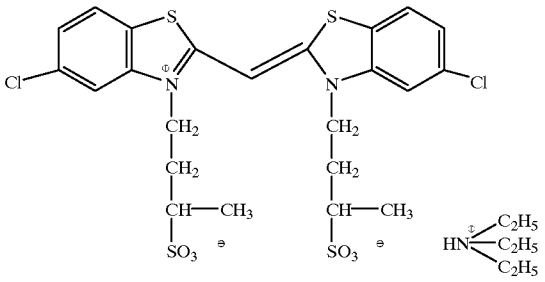

Water-soluble polymer (10)

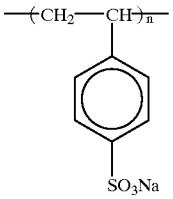

-continued

Selenium sensitizing agent

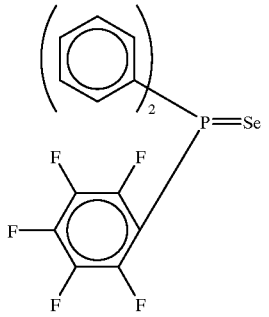

Mercapto compound

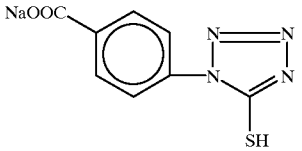

The method of preparing the blue-light-sensitive silver halide emulsion (2) is shown below:

0.96 g of gelatin, having an average molecular weight of 12,000, and 1,191 ml of distilled water containing 0.9 g of potassium bromide, were placed in a reaction vessel, and the temperature was elevated to 40° C. 37.5 ml of an aqueous solution (A) containing 1.5 g of silver nitrate, and 37.5 ml of an aqueous solution (B) containing 1.051 g of potassium bromide, were added to the resulting solution, over 90 sec, with vigorous stirring. 30 sec after the completion of the addition, 12 ml of a 10% aqueous solution of potassium bromide was added, and after 30 sec, the temperature of the reaction solution was raised to 75° C. After 35.0 g of lime-processed gelatin was added, together with 250 ml of distilled water, 116 ml of an aqueous solution (C) containing 29.0 g of silver nitrate, and 91 ml of an aqueous solution (D) containing 20 g of potassium bromide, were added, over 11 min 35 sec, with the flow rate of the addition being accelerated. Then, 302 ml of an aqueous solution (E) containing 96.7 g of silver nitrate, and an aqueous solution (F) containing potassium iodide and potassium bromide in a molar ratio of 3.3:96.7 (the concentration of potassium bromide: 26%), were added, over 20 min, with the flow rate of the addition being accelerated, so that the silver electric potential of the reaction liquid would become 2 mV to a saturated calomel electrode. Further, 97 ml of an aqueous solution (G) containing 24.1 g of silver nitrate, and a 21.9% aqueous solution (H) of potassium bromide, were added, over 3 min, so that the silver electric potential of the reaction liquid would become 0 mV to the saturated calomel electrode. After the completion of the addition, the temperature was kept at 75° C. for 1 min; then the temperature of the reaction liquid was dropped to 55° C. Then, 15 ml of 1N sodium hydroxide was added. Thereafter, after 2 min, 153 ml of an aqueous solution (I) containing 10.4 g of silver nitrate, and 414.5 ml of an aqueous solution (J) containing 9.35 g of potassium iodide, were added, over 5 min. After the completion of the addition, 7.11 g of potassium bromide was added, the temperature was kept at 55° C. for 1 min, and then 228 ml of an aqueous solution (K) containing 57.1 g of silver nitrate, and 201 ml of an aqueous solution (L) containing 43.9 g of potassium bromide, were added, over 8 min. After 30 sec,. an aqueous solution containing 0.04 g of sodium ethylthiosulfonate was added. The temperature was then dropped, and then desalting and dispersion were carried out in the same manner as in the blue-light-sensitive silver halide emulsion (1). Chemical sensitization was carried out in the same manner as the blue-light-sensitive silver halide emulsion (1), except that the selenium sensitizer was not added. The sensitizing dyes, and the mercapto compound to stop the chemical sensitization, were almost proportional to surface area of the emulsion grains.

With respect to the obtained grains, tabular grains amounted to over 99% of the total projected area of all grains, the average sphere equivalent diameter was 0.66 μm, the average thickness was 0.17 μm, the equivalent circle diameter was 1.05 μm, and the aspect ratio was 6.3.

The method of preparing the blue-light-sensitive silver halide emulsion (3) is shown below:

17.8 g of lime-processed gelatin, and 1,345 ml of distilled water containing 6.2 g of potassium bromide and 0.46 g of potassium iodide, were placed in a reaction vessel, and the temperature was elevated to 45° C. While this solution was stirred vigorously, 70 ml of an aqueous solution (A) containing 11.8 g of silver nitrate, and 70 ml of an aqueous solution (B) containing 3.8 g of potassium bromide, were added, over 45 sec. After the temperature of the reaction solution was kept at 45° C. for 4 min, the temperature of the reaction liquid was elevated to 63° C. After 24 g of lime-processed gelatin was added, together with 185 ml of distilled water, 208 ml of an aqueous solution (C) containing 73 g of silver nitrate, and a 24.8% aqueous solution (D) of potassium bromide, were added, over 13 min, with the flow rate of the addition being accelerated, so that the silver electric potential of the reaction liquid would become 0 mV to a saturated calomel electrode. After the completion of the addition, the temperature of the reaction liquid was kept at 63° C. for 2 min, and then the temperature was dropped to 45° C. Then, 15 ml of 1N sodium hydroxide was added. After 2 min, 60 ml of an aqueous solution (E) containing 8.4 g of silver nitrate, and 461 ml of an aqueous solution (F) containing 8.3 g of potassium bromide were added, over 5 min. Further, 496 ml of an aqueous solution (G) containing 148.8 g of silver nitrate, and a 25% aqueous solution (H) of potassium bromide, were added, over 47 min, so that the silver electric potential of the reaction liquid would become 90 mV to the saturated calomel electrode. 30 sec after the completion of the addition, an aqueous solution containing 2 g of potassium bromide and 0.06 g sodium ethylthiosulfonate was added. After the temperature was lowered, desalting, dispersion, and chemical sensitization were carried out in the same manner as in the blue-light-sensitive silver halide emulsion (2). The grains of the obtained emulsion were hexagonal tabular grains having an average grain size of 0.44 μm, in terms of the diameters equivalent to spheres, an average thickness of 0.2 μm, an equivalent circle diameter of 0.53 μm, and an average grain aspect ratio of 2.6.

The method of preparing the green-light-sensitive silver halide emulsion (4) is shown below:

0.96 g of gelatin, having an average molecular weight of 12,000, and 1,191 ml of distilled water containing 0.9 g of potassium bromide, were placed in a reaction vessel, and the temperature was elevated to 40° C. 17.5 ml of an aqueous solution (A) containing 0.7 g of silver nitrate, and 17.5 ml of an aqueous solution (B) containing 1.051 g of potassium bromide, were added to the resulting solution, over 120 sec, with vigorous stirring. 30 sec after the completion of the addition, 12 ml of a 10% aqueous solution of potassium bromide was added, and after 30 sec, the temperature of the reaction solution was raised to 75° C. After 35.0 g of lime-processed gelatin was added together with 250 ml of distilled water, 56 ml of an aqueous solution (C) containing 19.0 g of silver nitrate, and 461 ml of an aqueous solution (D) containing 10 g of potassium bromide, were added, over 7 min 35 sec, with the flow rate of the addition being accelerated. Then, 302 ml of an aqueous solution (E) containing 96.7 g of silver nitrate, and an aqueous solution (F) containing potassium iodide and potassium bromide in a molar ratio of 3.3:96.7 (the concentration of potassium bromide: 26%), were added, over 20 min, with the flow rate of the addition being accelerated, so that the silver electric potential of the reaction liquid would become 0 mV to a saturated calomel electrode. Further, 97 ml of an aqueous solution (G) containing 24.1 g of silver nitrate, and a 21.9% aqueous solution (H) of potassium bromide, were added, over 3 min, so that the silver electric potential of the reaction liquid would become 0 mV to the saturated calomel electrode. After the completion of the addition, the temperature was kept at 75° C. for 1 min, the temperature of the reaction liquid was dropped to 55° C. Thereafter, 122 ml of an aqueous solution (I) containing 8.3 g of silver nitrate, and 322 ml of an aqueous solution (J) containing 7.48 g of potassium iodide, were added, over 5 min. After the completion of the addition, 7.11 g of potassium bromide was added, and the temperature was kept at 55° C. for 1 min; then 228 ml of an aqueous solution (K) containing 62.8 g of silver nitrate, and 201 ml of an aqueous solution (L) containing 48.3 g of potassium bromide, were added, over 8 min. The temperature was then dropped, and desalting and dispersion were carried out in the same manner as in the blue-light-sensitive silver halide emulsion (1). Chemical sensitization was carried out in the same manner as the blue-light-sensitive silver halide emulsion (1), except that the gelatin dispersion of a mixture of sensitizing dyes (13), (14), and (15) was added in place of the sensitizing dye (12).

With respect to the obtained grains, tabular grains amounted to over 99% of the total projected area of all grains, the average sphere equivalent diameter was 0.85 μm, the average thickness was 0.26 μm, the equivalent circle diameter was 1.25 μm, and the aspect ratio was 4.8.

Sensitizing dye (13) for green-sensitive emulsion

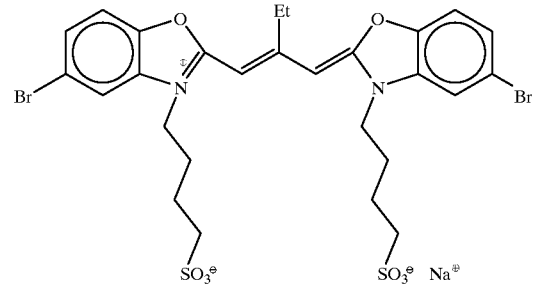

Sensitizing dye (14) for green-sensitive emulsion

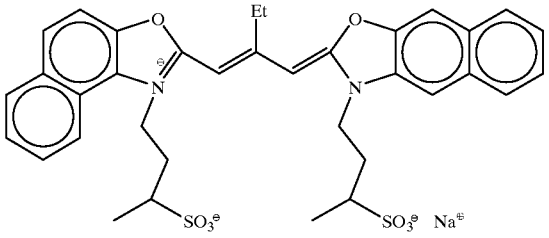

-continued

Sensitizing dye (15) for green-sensitive emulsion

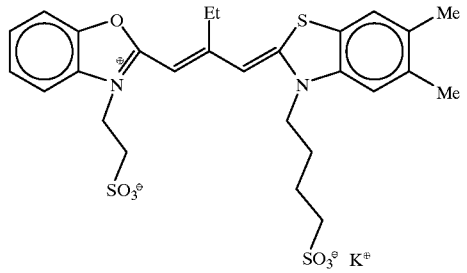

The method of preparing the green-light-sensitive silver halide emulsion (5) is shown below:

Desalting and dispersion were carried out in the same manner as in the blue-light-sensitive silver halide emulsions, except that sodium hydroxide and sodium ethylthiosulfonate were not added, during grain formation. Chemical sensitization was carried out in the same manner as in the green-light-sensitive silver halide emulsion (4).

With respect to the obtained grains, tabular grains amounted to over 99% of the total projected area of all grains, the average sphere equivalent diameter was 0.66 μm, the average thickness was 0.17 μm, the equivalent circle diameter was 1.05 μm, and the aspect ratio was 6.3.

The method of preparing the green-light-sensitive silver halide emulsion (6) is shown below:

Grain formation, desalting, and dispersion were carried out in the same manner as in the blue-light-sensitive silver halide emulsion (3), except that sodium hydroxide was not added and 4 mg of sodium ethylthiosulfonate was added, during grain formation. Chemical sensitization was carried out in the same manner as in the green-light-sensitive silver halide emulsion (4), except that the selenium sensitizer was not added.

With respect to the obtained emulsion, the grains obtained were hexagonal-tabular grains, having the average grain size corresponding to the sphere equivalent diameter of 0.44 μm, the average thickness of 0.2 μm, the equivalent circle diameter of 0.53 μm, and the average aspect ratio of grains of 2.6.

The method of preparing the red-light-sensitive silver halide emulsion (7) is shown below:

The red-light-sensitive silver halide emulsion (7) was prepared in the same manner as the green-light-sensitive silver halide emulsion (4), except that a gelatin dispersion of the sensitizing dye (16), and a gelatin dispersion of a mixture of the sensitizing dyes (17) and (18) were added in place of the sensitizing dyes at the chemical sensitization. With respect to the obtained grains, tabular grains amounted to over 99% of the total projected area of all grains, the average sphere equivalent diameter was 0.85 μm, the average thickness was 0.26 μm, the equivalent circle diameter was 1.25 μm, and the aspect ratio was 4.8.

Sensitizing dye (16) for red-sensitive emulsion

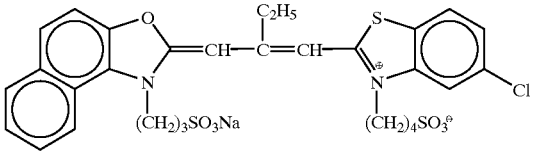

-continued

Sensitizing dye (17) for red-sensitive emulsion

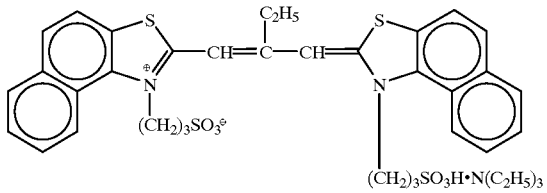

Sensitizing dye (18) for red-sensitive emulsion

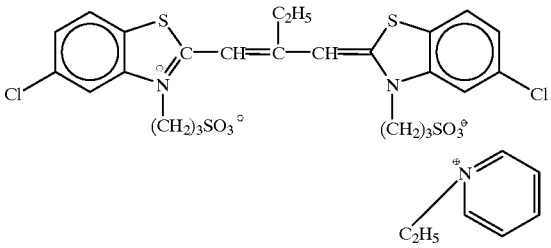

The method of preparing the red-light-sensitive silver halide emulsion (8) is shown below:

The red-light-sensitive silver halide emulsion (8) was prepared in the same manner as the green-light-sensitive silver halide emulsion (5), except that a gelatin dispersion of the sensitizing dye (16), and a gelatin dispersion of a mixture of the sensitizing dyes (17) and (18) were added in place of the sensitizing dyes at the chemical sensitization.

With respect to the obtained grains, tabular grains amounted to over 99% of the total projected area of all grains, the average sphere equivalent diameter was 0.66 μm, the average thickness was 0.17 μm, the equivalent circle diameter was 1.05 μm, and the aspect ratio was 6.3.

The method of preparing the red-light-sensitive silver halide emulsion (9) is shown below;

The red-light-sensitive silver halide emulsion (9) was prepared in the same manner as the green-light-sensitive silver halide emulsion (6), except that a gelatin dispersion of the sensitizing dye (16), and a gelatin dispersion of a mixture of the sensitizing dyes (17) and (18) were added in place of the sensitizing dyes at the chemical sensitization.

With respect to the obtained emulsion, the grains obtained were hexagonal-tabular grains, having the average grain size represented by the sphere-equivalent diameter of 0.44 μm, the average thickness of 0.2 μm, the equivalent circle diameter of 0.53 μm, and the average grain aspect ratio of 2.6.

<Method of Preparing Zinc Hydroxide Dispersion>

31 g of zinc hydroxide powder, whose primary particles had a particle size of 0.2 μm, as a dispersant, 1.6 g of carboxymethylcellulose and 0.4 g of sodium polyacrylate; 8.5 g of lime-processed ossein gelatin, and 158.5 ml of water were mixed, and this mixture was dispersed for 1 hour in a mill using glass beads. After the dispersion, the glass beads were separated by filtering, to obtain 188 g of a dispersion of zinc hydroxide.

<Method of Preparing Emulsified Dispersions of Color-developing Agent and Coupler>

Each of the oil-phase components having the composition shown in Table 1, and each of the aqueous-phase components having the composition shown in Table 1, were dissolved, to form uniform solutions, at 60° C. The oil-phase components and the aqueous-phase components in each case were combined and dispersed in a 1-liter stainless container, using a dissolver having a disperser with a diameter of 5 cm, for 20 min at 10,000 rpm. Then, as an additional water, warm water in the amount shown in Table 1 was added thereto, and they were mixed for 10 min at 2,000 rpm. In this way, emulsified dispersions of three couplers: cyan, magenta, and yellow couplers, were prepared.

TABLE 1

| | Cyan | Magenta | Yellow |
|---|---|---|---|
| Oil phase | | | |
| Cyan coupler C-1 | 3.58 g | — | — |
| Magenta coupler CM-1 | — | 2.63 g | — |
| Yellow coupler Y-1 | — | — | 3.01 g |
| Color-developing agent D-8 | 1.49 g | 2.25 g | — |
| Color-developing agent D-15 | 0.73 g | — | — |
| Color-developing agent D-29 | — | — | 2.42 g |
| Tricresyl phosphate | 2.75 g | 2.5 g | 3.83 g |
| Ethyl acetate | 6 ml | 6 ml | 6 ml |
| Cyclohexanone | 6 ml | 6 ml | 6 ml |
| Aqueous phase | | | |
| Lime-processed gelatin | 4 g | 4 g | 4 g |
| Sodium dodecylbenzene sulfonate | 0.27 g | 0.27 g | 0.27 g |
| Water | 53 ml | 53 ml | 53 ml |
| Additional water | 28 ml | 30 ml | 29 ml |

Color-developing agent D-29

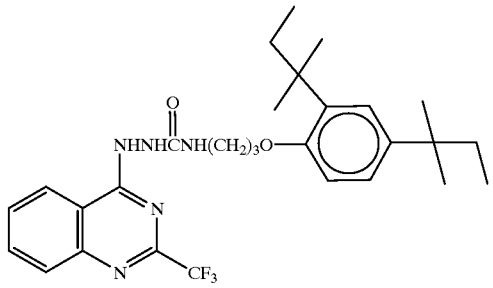

Cyan coupler C-1

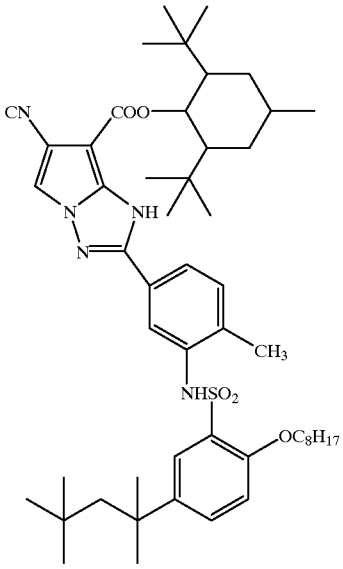

-continued

Magenta coupler CM-1

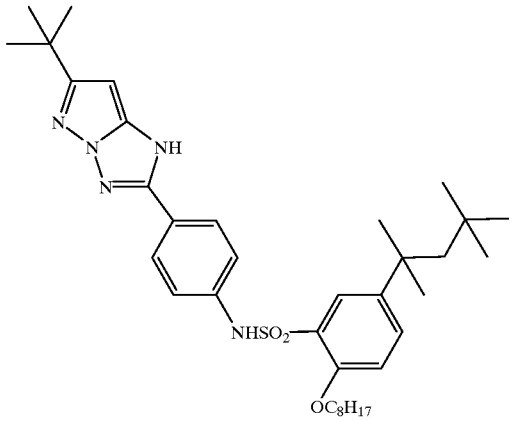

Yellow coupler Y-1

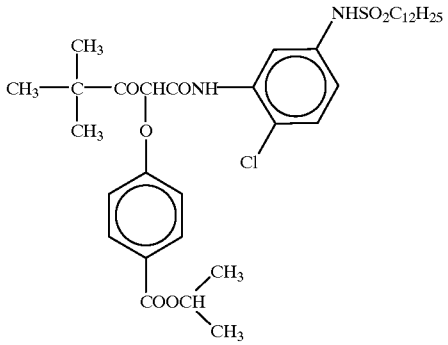

<Preparation of Dye Compositions for Yellow Filter Layer, Magenta Filter Layer, and Antihalation Layer>

The dye compositions were prepared as emulsified dispersions as follows and were added.

7.1 g of Yellow Dye (YF-1) was dissolved in 6.6 g of tricresyl phosphate, 30 cc of ethyl acetate, and 30 cc of cyclohexanone; the solution was charged into 135 g of a 7.8% aqueous gelatin solution containing 0.75 g of sodium dodecylbenzenesulfonate, and the resulting mixture was stirred using a dissolver stirrer at 10,000 rpm for 20 min, to be emulsified and dispersed. After the dispersion, distilled water was added to bring the total weight to 260 g, and they were mixed at 2,000 rpm for 10 min, to prepare a dye dispersion for a yellow filter layer.

A dye dispersion for a magenta filter layer was prepared in the same manner as above, except that the dye was changed to Magenta Dye (MF-1), in an amount of 6.1 g.

Further, a dye dispersion for an antihalation layer was prepared in the same manner as above, except that the dye was changed to Cyan Dye (CF-1), in an amount of 8.9 g.

YF-1

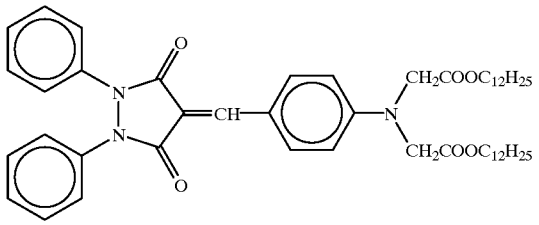

MF-1

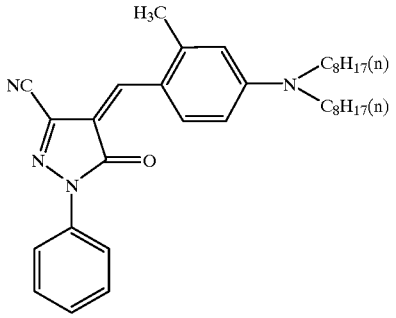

CF-1

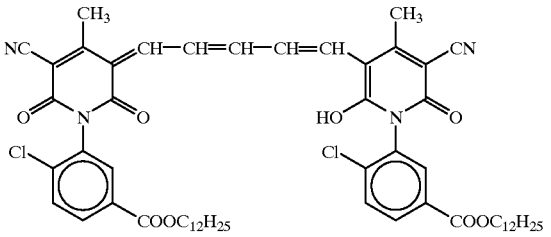

(Preparation of a Support)

The support that was used in the present example was prepared as follows:

100 weight parts of polyethylene-2,6-naphthalate(PEN) polymer, and 2 weight parts of Tinuvin P. 326 (trade name, manufactured by Ciba-Geigy Co.), as an ultraviolet absorbing agent, were dried, then melted at 300° C.; subsequently they were extruded through a T-type die, and stretched 3.3 times in the lengthwise direction at 140° C., and then 3.3 times in the width direction at 130° C.; and further they were thermally fixed for 6 seconds at 250° C., and PEN film having a thickness of 92 μm was obtained. To the PEN film, appropriate amounts of a blue dye, a magenta dye, and a yellow dye (I-1, I-4, I-6, I-24, I-26, I-27, II-5, as described in Kokai Giho: Kogi No. 94-6023) were added, wherein the density of a yellow dye would be 0.01, the density of a magenta dye would be 0.08, and the density of a cyan dye would be 0.09. Further, this film was wound around a stainless steel core (spool) having a diameter of 20 cm, and thermal history was imparted thereto at 113° C. for 30 hours, to obtain a support having suppressed core-set-curl.

(Coating of an Undercoat Layer)

After both surfaces of the said support were subjected to corona discharge, UV discharge, and glow discharge treatments, each side of the support was coated with an undercoat solution having a composition of gelatin (0.1 g/m$^2$), sodium α-sulfo-di-2-ethylhexylsuccinate (0.01 g/m$^2$), salicylic acid (0.025 g/m$^2$), PQ-1 (0.005 g/m$^2$), and PQ-2 (0.006 g/m$^2$) (10 cc/m$^2$, a bar coater was used). The undercoat layer was provided on the side that was heated at a higher temperature at the time of stretching. Drying was carried out at 115° C. for 6 minutes (the roller and the transportation apparatus in the drying zone all were set at 115° C.).

(Coating of a Backing Layer)

1) Coating of an Antistatic Layer

A dispersion of a fine grain powder of a composite stannic oxide-antimony oxide having an average grain diameter of 0.005 μm, and a specific resistance of 5 Ω·cm (secondary aggregation grain diameter of about 0.08 μm) (0.0027 g/m$^2$), gelatin (0.03 g/m$^2$) ($CH_2{=}CHSO_2CH_2CH_2NHCO)_2CH_2$ (0.02 g/m$^2$), poly(polymerization degree: 10)oxyethylene-p-nonylphenol (0.005 g/m$^2$), PQ-3 (0.008 g/m$^2$), and resorsine, were coated.

2) Coating of a Magnetic Recording Layer

3-Poly(polymerization degree: 15 )oxyethylene-propyloxytrimethoxysilan (15 weight% )-coated Co-Γ-iron oxide (specific surface area, 43 m$^2$/g; major axis, 0.14 μm; minor axis, 0.03 μm; saturation magnetization, 89 emu/g, $Fe^{2+}/Fe^{3}$+=6/94; the surface was treated with 2 wt % respectively, based on iron oxide, of aluminum oxide and silicon oxide) (0.06 g/m$^2$), diacetylcellulose (a dispersion of the iron oxide was carried out by an open kneader and a sand mill) (1.15 g/m$^2$), and the hardener PQ-4 (0.075 g/m$^2$), PQ-5 (0.004 g/m$^2$) were coated using acetone, methylethylketone, cyclohexanone, and dibutylphthalate as solvents, by means of a bar coater, to obtain a magnetic recording layer having a thickness of 1.2 μm. $C_6H_{13}CH(OH)C_{10}H_{20}COOC_{40}H_{81}$ (50 g/m$^2$), as a slipping agent, silica grains (average grain diameter 1.0 μm), as a matting agent, and aluminum oxide (ERC-DBM, trade name, manufactured by Reynolds Metal Co., average grain diameter 0.44 μm), as an abrasive, were added thereto, to give a coverage of 5 mg/m$^2$ and 15 mg/m$^2$, respectively. Drying was conducted at 115° C. for 6 min (the roller and the transportation apparatus in the drying zone all were set at 115° C.). The increment of the color density of DB of the magnetic recording layer was about 0.1 when X-light (blue filter) was used. The saturation magnetization moment of the magnetic recording layer was 4.2 emu/g, the coercive force was 7.3×10$^4$ A/m, and the squareness ratio was 65%.

3) Preparation of a Slipping Layer

Hydroxyethyl cellulose (25 mg/m$^2$), PQ-6 (7.5 mg/m$^2$), PQ-7 (1.5 mg/m$^2$), polydimethylcyloxane (1.5 mg/m$^2$) were coated. When adding the mixture, the mixture was dissolved in a solution of xylene and propyleneglycol monomethylether (1/1) at 105° C., and this solution was poured into a 10-fold volume of propyleneglycol monomethylether (normal temperature) and dispersed. This was further dispersed in acetone, and the obtained dispersion (average grain diameter: 0.01 μm) was added to the coating solution. The slipping layer was dried at 115° C. for 6 minutes (the roller and the transportation apparatus in the drying zone all were set at 115° C.). The slipping layer showed excellent performances of the coefficient of dynamic friction: 0.10 (a stainless steel hard ball of 5 mmϕ, diameter, load: 100 g, speed: 6 cm/min), and of the static friction coefficient: 0.09 (clip method). The sliding property of the slipping layer with the surface of the emulsion, which described above, was also excellent, such that the coefficient of dynamic friction was 0.18.

PQ-1

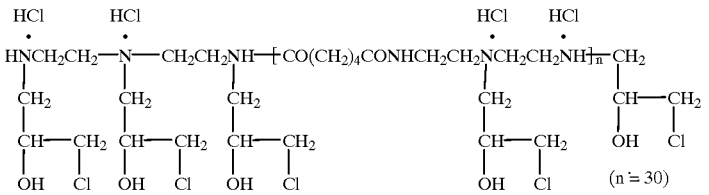

PQ-2

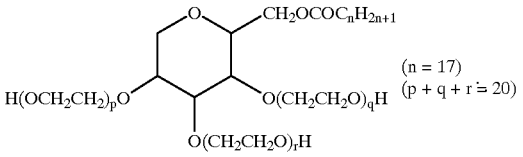

PQ-3

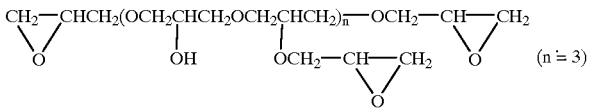

PQ-4

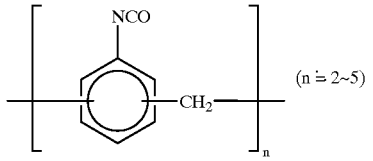

PQ-5

$(CH_3O)_3SiCH_2CH_2CH_2O(CH_2CH_2O)_nCH_3$ (n ≒ 7.3)

PQ-6

$C_{50}H_{101}(CH_2CH_2O)_nH$ (n ≒ 16)

PQ-7

$C_8F_{17}SO_2N(C_3H_7)(CH_2CH_2O)_n(CH_2)_4SO_3Na$ (n ≒ 4)

The light-sensitive material Sample 101 having multilayer constitution shown in Table 2 was prepared using the above materials and the support.

TABLE 2

Light-sensitive material 101

| Layer Configuration | Main material | Coated amount (g/m²) |
|---|---|---|
| Thirteenth layer | Gelatin | 0.89 |
| Protective layer | Matting agent (silica) | 0.02 |
| Twelfth layer | Gelatin | 0.86 |
| Intermediate layer | Zinc hydroxide | 0.34 |
| Eleventh layer | Gelatin | 0.86 |
| Yellow color-forming layer (High-sensitivity) | Blue-light-sensitive silver halide emulsion (1) | 0.50 (in terms of silver) |
| | Yellow coupler (Y-1) | 0.29 |
| | Color-developing agent (D-29) | 0.23 |
| | Tricresyl phosphate | 0.36 |
| Tenth layer | Gelatin | 1.44 |
| Yellow color-forming layer (Low-sensitivity) | Blue-light-sensitive silver halide emulsion (2) | 0.25 (in terms of silver) |
| | Blue-light-sensitive silver halide emulsion (3) | 0.25 (in terms of silver) |
| | Yellow coupler (Y-1) | 0.45 |
| | Color-developing agent (D-29) | 0.36 |
| | Tricresyl phosphate | 0.56 |
| Ninth layer | Gelatin | 0.21 |
| Interlayer | Yellow dye YF-1 | 0.14 |

TABLE 2-continued

Light-sensitive material 101

| Layer Configuration | Main material | Coated amount (g/m²) |
|---|---|---|
| Yellow-filter layer | Tricresyl phosphate | 0.13 |
| Eighth layer | Gelatin | 0.43 |
| Magenta color-forming layer (High-sensitivity) | Green-light-sensitive silver halide emulsion (4) | 0.55 (in terms of silver) |
| | Magenta coupler (CM-1) | 0.04 |
| | Color-developing agent (D-8) | 0.03 |
| | Tricresyl phosphate | 0.04 |
| Seventh layer | Gelatin | 0.5 |
| Magenta color-forming layer (Medium-. sensitivity) | Green-light-sensitive silver halide emulsion (5) | 0.35 (in terms of silver) |
| | Magenta coupler (CM-1) | 0.07 |
| | Color-developing agent (D-8) | 0.06 |
| | Tricresyl phosphate | 0.07 |
| Sixth layer | Gelatin | 0.52 |
| Magenta color-forming layer (Low-sensitivity) | Green-light-sensitive silver halide emulsion (6) | 0.34 (in terms of silver) |
| | Magenta coupler (CM-1) | 0.19 |
| | Color-developing agent (D-8) | 0.16 |
| | Tricresyl phosphate | 0.18 |
| Fifth layer | Gelatin | 1.15 |
| Interlayer | Magenta dye MF-1 | 0.1 |
| Magenta-filter layer | Zinc hydroxide | 2.03 |
| | Tricresyl phosphate | 0.1 |

TABLE 2-continued

Light-sensitive material 101

| Layer Configuration | Main material | Coated amount ($g/m^2$) |
|---|---|---|
| Fourth layer | Gelatin | 0.96 |
| Cyan color-forming layer (High-sensitivity) | Red-light-sensitive silver halide emulsion (7) | 1.05 (in terms of silver) |
| | Cyan coupler (C-1) | 0.07 |
| | Color-developing agent (D-8) | 0.03 |
| | Color-developing agent (D-15) | 0.014 |
| | Tricresyl phosphate | 0.05 |
| Third layer | Gelatin | 0.24 |
| Cyan color-forming layer (Medium-sensitivity) | Red-light-sensitive silver halide emulsion (8) | 0.27 (in terms of silver) |
| | Cyan coupler (C-1) | 0.054 |
| | Color-developing agent (D-8) | 0.022 |
| | Color-developing agent (D-15) | 0.011 |
| | Tricresyl phosphate | 0.04 |
| Second layer | Gelatin | 0.73 |
| Cyan color-forming layer (Low-sensitivity) | Red-light-sensitive silver halide emulsion (9) | 0.55 (in terms of silver) |
| | Cyan coupler (C-1) | 0.32 |
| | Color-developing agent (D-8) | 0.13 |
| | Color-developing agent (D-15) | 0.065 |
| | Tricresyl phosphate | 0.025 |
| First layer | Gelatin | 0.24 |
| Antihalation layer | Cyan dye CF-1 | 0.2 |
| | Tricresyl phosphate | 0.15 |
| | Undercoat layer | |
| | PEN base (92 $\mu$m) | |
| | Undercoat layer | |
| | Antistatic layer | |
| | Magnetic recording layer | |
| | Slipping layer | |

Note:
The above coated layers on the side of the light-sensitive layers were hardened by 0.1 $g/m^2$ of Hardener (H-1).
H-1 $CH_2{=}CH{-}SO_2{-}CH_2{-}SO_2{-}CH{=}CH_2$ Further, the first-processing member R-1 having constitution shown in Table 3, and the second-processing member R-2 having constitution shown in Table 4, were prepared.

TABLE 3

First processing member R-1

| Layer Configuration | Main added material | Added amount ($g/m^2$) |
|---|---|---|
| Fourth layer | Gelatin | 0.22 |
| | k-carrageenan | 0.06 |
| | Silicone oil | 0.02 |
| | Matting agent (PMMA) | 0.4 |
| Third layer | Gelatin | 0.24 |
| | Hardener (H-2) | 0.18 |
| Second layer | Gelatin | 2.41 |
| | Dextran | 1.31 |
| | Mordant (P-1) | 2.44 |
| | Guanidine picolinic acid | 5.82 |
| | Potassium quinolinic acid | 0.45 |
| | Sodium quinolinic acid | 0.36 |
| First layer | Gelatin | 0.19 |
| | Hardener (H-2) | 0.18 |
| | Undercoat layer | |
| | PET base (63 $\mu$m) | |

H-2

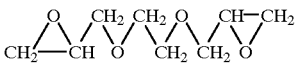

-continued

P-1

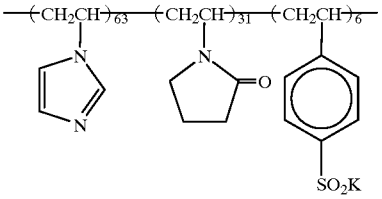

TABLE 4

Second processing member R-2

| Layer Configuration | Main added material | Added amount ($g/m^2$) |
|---|---|---|
| Fourth layer | Gelatin | 0.49 |
| | Matting agent (silica) | 0.01 |
| Third layer | Gelatin | 0.24 |
| | Hardener (H-3) | 0.25 |
| Second layer | Gelatin | 4.89 |
| | Polyacrylic acid (20% neutralization product) | 2.31 |
| | Silver halide solvent | 5.77 |
| First layer | Gelatin | 0.37 |
| | Hardener (H-.3) | 0.58 |
| | Gelatin Undercoat layer | |
| | PET base (63 $\mu$m) | |

H-3

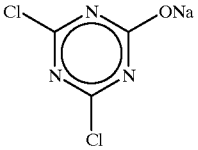

Then, Light-Sensitive Material Samples 102 to 116 were prepared in the same manner as above, except that Magenta Coupler CM-1 in each of the sixth, seventh, and eighth layers in Table 2 was changed as shown in Table 5, in an equimolar amount.

After the above Light-Sensitive Materials 101 to 116 were exposed to white light, each of them was provided with water of 40° C., in an amount of 15 $cc/m^2$ (corresponding to 45% of the maximum swell), and then each was placed on First Processing Member R-1, followed by heating from the backing surface of the light-sensitive material, for 17 sec, by a heat drum at 83° C. Then, First Processing Member R-1 was peeled off from the light-sensitive material 101, and after the light-sensitive material was provided with water, in an amount of 15 $cc/m^2$, at 40° C., again, it was placed on Second Processing Member R-2 and was heated for 10 sec at 83° C. Second Processing Member R2 was peeled off from the light-sensitive material, and the maximum density (Dmax) and the minimum density (Dmin) were found, using an X-lite 304, trade name, manufactured by X-lite Co.

The raw stock storability and the image preservability were evaluated by the method shown below:

With respect to the raw stock storability, the unexposed light-sensitive material was allowed to stand in the presence of formalin in an amount of 20 ppm for 30 days; then, after it was processed in the above manner, the increase in the yellow component of the minimum density and the decrease in the magenta density of the maximum density were found.

Further, with respect to the image preservability, the light-sensitive material processed in the above manner was allowed to stand at 60° C./70% RH for 30 days, and then the increase in the yellow component of the minimum density was found.

The results are shown in Table 5. It can be understood that, in the light-sensitive materials of the present invention in which the compound for use in the present invention were used, the stability in storage (the increase in the yellow component of the minimum density section and the decrease in the magenta component of the maximum density) before and after processing could be remarkably improved.

TABLE 5

| Light-sensitive material | Photographic properties | | Storage stability before processing | | Storage stability after processing | |
|---|---|---|---|---|---|---|
| | Dmin | Dmax | Dmin | Dmax | Dmin | Remarks |
| 101 CM-1 | 0.50 | 3.22 | 1.03 | 2.40 | 1.51 | Comparative example |
| 102 M-2 | 0.38 | 3.42 | 0.11 | 0.31 | 0.20 | This invention |
| 103 M-5 | 0.32 | 3.41 | 0.10 | 0.18 | 0.15 | This invention |
| 104 M-13 | 0.33 | 3.39 | 0.07 | 0.20 | 0.08 | This invention |
| 105 M-18 | 0.31 | 3.38 | 0.07 | 0.21 | 0.09 | This invention |
| 106 M-24 | 0.31 | 3.38 | 0.08 | 0.19 | 0.10 | This invention |
| 107 M-25 | 0.30 | 3.42 | 0.10 | 0.22 | 0.18 | This invention |
| 108 M-27 | 0.31 | 3.41 | 0.09 | 0.21 | 0.09 | This invention |
| 109 M-37 | 0.30 | 3.40 | 0.08 | 0.17 | 0.08 | This invention |
| 110 M-39 | 0.30 | 3.39 | 0.11 | 0.22 | 0.10 | This invention |
| 111 M-50 | 0.31 | 3.44 | 0.15 | 0.21 | 0.16 | This invention |
| 112 CM-2 | 0.56 | 3.25 | 1.14 | 2.02 | 1.23 | Comparative example |
| 113 CM-3 | 0.48 | 3.19 | 0.92 | 2.25 | 1.38 | Comparative example |
| 114 CM-4 | 0.59 | 3.36 | 1.16 | 2.51 | 1.63 | Comparative example |
| 115 CM-5 | 0.42 | 2.72 | 0.73 | 1.51 | 0.68 | Comparative example |
| 116 CM-6 | 0.47 | 2.91 | 0.88 | 1.82 | 0.92 | Comparative example |

Comparative compound CM-1
(Compound M-1 described in JP-A-110608)

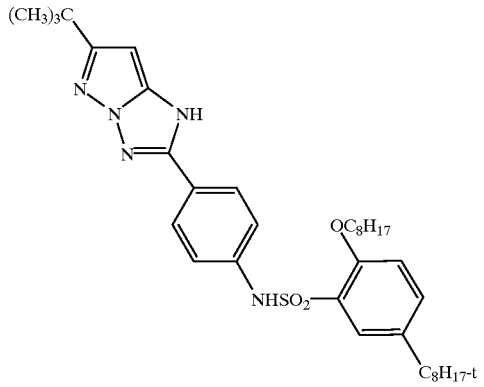

-continued

Comparative compound CM-2
(Compound C-22 described in EP-0764876)

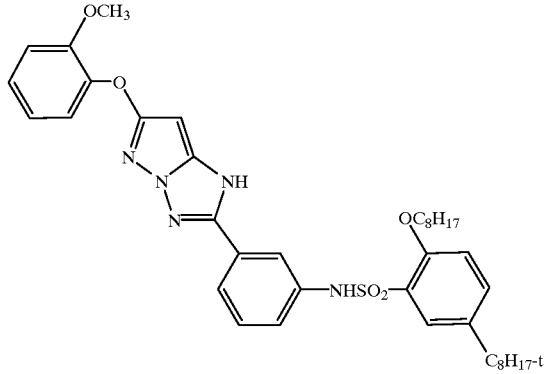

Comparative compound CM-3
(Compound M-7 described in JP-A-9-34071, in which the split-off atom (group) is changed to H).

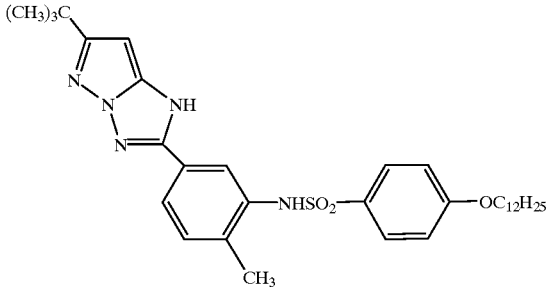

Comparative compound CM-4
(Compound N-32 described in JP-A-5-100382)

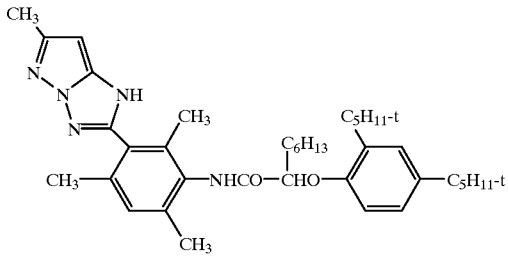

Comparative compound CM-5
(Compound (35) described in JP-A-9-50101)

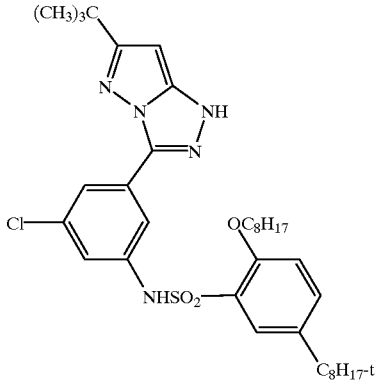

-continued

Comparative compound CM-6
(Compound N-26 described in JP-A-5-100382)

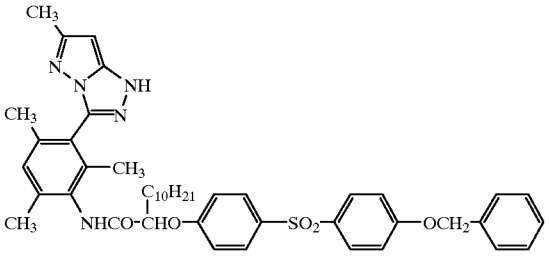

Example 2

(Preparation of Sample 201)

Layers having the below-shown compositions were formed on a cellulose triacetate film support, having a thickness of 127 μm, that had been provided an undercoat, to prepare a multi-layer color light-sensitive material, which was named Sample 201. Each figure represents the added amount per square meter. In passing, it should be noted that the effect of the added compounds is not limited to the described use.

| | | |
|---|---|---|
| First Layer (Halation-preventing layer) | | |
| Black colloidal silver | | 0.10 g |
| Gelatin | | 1.90 g |
| Ultraviolet ray absorbent U-1 | | 0.20 g |
| Ultraviolet ray absorbent U-3 | | 0.060 g |
| Ultraviolet ray absorbent U-4 | | 0.15 g |
| High-boiling organic solvent Oil-1 | | 0.15 g |
| Solid dispersion of fine crystals of Dye E-1 | | 0.10 g |
| Second Layer (Intermediate layer) | | |
| Gelatin | | 0.40 g |
| Compound Cpd-C | | 5.0 mg |
| Compound Cpd-J | | 6.0 mg |
| Compound Cpd-K | | 5.0 mg |
| High-boiling organic solvent Oil-3 | | 0.10 g |
| Dye D-4 | | 0.80 mg |
| Third Layer (Intermediate layer) | | |
| Silver iodobromide emulsion of fine grains, surface and inner part of which was fogged (av. grain diameter: 0.06 μm, deviation coefficient: 18%, AgI content: 1 mol %) | silver | 0.050 g |
| Yellow colloidal silver | silver | 0.020 g |
| Gelatin | | 0.40 g |
| Fourth Layer (Low-sensitivity red-sensitive emulsion layer) | | |
| Emulsion A | silver | 0.33 g |
| Emulsion B | silver | 0.42 g |
| Gelatin | | 0.75 g |
| Coupler ExC-1 | | 0.13 g |
| Coupler ExC-2 | | 0.07 g |
| Coupler ExC-8 | | 0.010 g |
| Compound Cpd-C | | 5.0 mg |
| Compound Cpd-J | | 3.0 mg |
| High-boiling organic solvent Oil-2 | | 0.10 g |
| High-boiling organic solvent Oil-1 | | 0.05 g |
| Additive P-1 | | 0.10 g |
| Fifth Layer (Medium-sensitivity red-sensitive emulsion layer) | | |
| Emulsion B | silver | 0.25 g |
| Emulsion C | silver | 0.15 g |
| Gelatin | | 0.80 g |
| Coupler EXC-1 | | 0.15 g |
| Coupler ExC-2 | | 0.10 g |
| Coupler ExC-3 | | 0.05 g |
| High-boiling organic solvent Oil-2 | | 0.12 g |
| High-boiling organic solvent Oil-1 | | 0.05 g |
| Additive P-1 | | 0.10 g |
| Sixth Layer (High-sensitivity red-sensitive emulsion layer) | | |
| Emulsion D | silver | 0.40 g |
| Gelatin | | 1.30 g |
| Coupler ExC-1 | | 0.05 g |
| Coupler ExC-2 | | 0.05 g |
| Coupler ExC-3 | | 0.75 g |
| Additive P-1 | | 0.10 g |
| Seventh Layer (Intermediate layer) | | |
| Gelatin | | 0.60 g |
| Additive M-1 | | 0.30 g |
| Compound Cpd-I | | 2.6 mg |
| Dye D-5 | | 0.020 g |
| Dye D-6 | | 0.010 g |
| Compound Cpd-J | | 5.0 mg |
| Compound Cpd-K | | 3.0 mg |
| High-boiling organic solvent Oil-3 | | 0.050 g |
| High-boiling organic solvent Oil-1 | | 0.020 g |
| Eighth Layer (Intermediate layer) | | |
| Silver iodobromide emulsion, surface and inner part of which was fogged (av. grain diameter: 0.06 μm, deviation coefficient: 16%, AgI content: 0.3 mol %) | silver | 0.010 g |
| Yellow colloidal silver | silver | 0.020 g |
| Gelatin | | 1.20 g |
| Additive P-1 | | 0.05 g |
| Color-mixing inhibitor Cpd-A | | 0.12 g |
| High-boiling organic solvent Oil-3 | | 0.10 g |
| Ninth Layer (Low-sensitivity green-sensitive emulsion layer) | | |
| Emulsion E | silver | 0.25 g |
| Emulsion F | silver | 0.30 g |
| Emulsion G | silver | 0.35 g |
| Gelatin | | 1.00 g |
| Coupler ExC-4 | | 0.05 g |
| Coupler ExC-7 | | 0.17 g |
| Compound Cpd-B | | 0.030 g |
| Compound Cpd-D | | 0.020 g |
| Compound Cpd-E | | 0.020 g |
| Compound Cpd-F | | 0.040 g |
| Compound Cpd-J | | 10 mg |
| Compound Cpd-L | | 0.02 g |
| High-boiling organic solvent Oil-1 | | 0.03 g |
| High-boiling organic solvent Oil-2 | | 0.25 g |
| Tenth Layer (Medium-sensitivity green-sensitive emulsion layer) | | |
| Emulsion G | silver | 0.20 g |
| Emulsion H | silver | 0.20 g |
| Gelatin | | 0.60 g |
| Coupler ExC-4 | | 0.05 g |
| Coupler ExC-7 | | 0.10 g |
| Compound Cpd-B | | 0.030 g |
| Compound Cpd-D | | 0.020 g |
| Compound Cpd-E | | 0.020 g |
| Compound Cpd-F | | 0.050 g |
| High-boiling organic solvent Oil-2 | | 0.012 g |
| Eleventh Layer (High-sensitivity green-sensitive emulsion layer) | | |
| Emulsion I | silver | 0.45 g |
| Gelatin | | 1.00 g |
| Coupler ExC-4 | | 0.33 g |
| Coupler ExC-7 | | 0.12 g |
| Compound Cpd-B | | 0.080 g |
| Compound Cpd-E | | 0.020 g |
| Compound Cpd-F | | 0.045 g |
| Compound Cpd-K | | 5.0 mg |
| High-boiling organic solvent Oil-1 | | 0.020 g |
| High-boiling organic solvent Oil-2 | | 0.020 g |

-continued

| | | |
|---|---|---|
| Twelfth Layer (Intermediate layer) | | |
| Gelatin | | 0.50 g |
| Compound Cpd-L | | 0.05 g |
| High-boiling organic solvent Oil-1 | | 0.05 g |
| Formaldehyde scavenger Cpd-H | | 0.30 g |
| Thirteenth Layer (Yellow filter layer) | | |
| Yellow colloidal silver | silver | 0.012 g |
| Gelatin | | 1.10 g |
| Color-mixing inhibitor Cpd-A | | 0.10 g |
| High-boiling organic solvent Oil-3 | | 0.05 g |
| Fine crystal solid dispersion of Dye E-2 | | 0.035 g |
| Fine crystal solid dispersion of Dye E-3 | | 0.020 g |
| Fourteenth Layer (Intermediate layer) | | |
| Gelatin | | 0.40 g |
| Fifteenth Layer (Low-sensitivity blue-sensitive emulsion layer) | | |
| Emulsion J | silver | 0.27 g |
| Emulsion K | silver | 0.33 g |
| Gelatin | | 0.80 g |
| Coupler ExC-5 | | 0.23 g |
| Coupler ExC-6 | | 0.07 g |
| Coupler ExC-9 | | 0.35 g |
| Compound Cpd-1 | | 0.02 g |
| Sixteenth Layer (Medium-sensitivity blue-sensitive emulsion layer) | | |
| Emulsion L | silver | 0.25 g |
| Emulsion M | silver | 0.25 g |
| Gelatin | | 0.90 g |
| Coupler ExC-5 | | 0.13 g |
| Coupler ExC-6 | | 0.07 g |
| Coupler ExC-9 | | 0.50 g |
| Seventeenth Layer (High-sensitivity blue-sensitive emulsion layer) | | |
| Emulsion N | silver | 0.20 g |
| Emulsion O | silver | 0.20 g |
| Gelatin | | 1.40 g |
| Coupler ExC-5 | | 0.05 g |
| Coupler ExC-6 | | 0.05 g |
| Coupler ExC-9 | | 0.75 g |
| High-boiling organic solvent Oil-2 | | 0.15 g |
| Eighteenth Layer (First protective layer) | | |
| Gelatin | | 0.70 g |
| Ultraviolet ray absorber U-1 | | 0.30 g |
| Ultraviolet ray absorber U-2 | | 0.070 g |
| Ultraviolet ray absorber U-5 | | 0.30 g |
| Color-mixing inhibitor Cpd-A | | 0.10 g |
| Formaldehyde scavenger Cpd-H | | 0.40 g |
| Dye D-1 | | 0.15 g |
| Dye D-2 | | 0.050 g |
| Dye D-3 | | 0.10 g |
| High-boiling organic solvent Oil-3 | | 0.10 g |
| Nineteenth Layer (Second protective layer) | | |
| Yellow colloidal silver | silver | 0.11 mg |
| Silver iodobromide emulsion of fine grains (av. grain diameter: 0.06 μm, AgI content: 1 mol %) | silver | 0.11 g |
| Gelatin | | 0.40 g |
| Twentieth Layer (Third protective layer) | | |
| Gelatin | | 0.40 g |
| Copolymer of methyl methacrylate and methacrylic acid (9:1) (average grain diameter 2.0 μm) | | 0.20 g |
| Copolymer of methyl methacrylate and methacrylic acid (6:4) (average grain diameter 2.3 μm) | | 0.10 g |
| Silicon oil SO-1 | | 0.035 g |
| Surface active agent W-1 | | 3.0 mg |
| Surface active agent W-2 | | 0.030 g |

Further, to all emulsion layers, in addition to the above-described components, additives F-1 to F-8 were added. Further, to each layer, in addition to the above-described components, Gelatin hardener H-1 and Surface active agents W-3, W-4, W-5, and W-6 for coating and emulsifying were added.

Further, as anti-fungal and anti-bacterial agents, phenol, 1,2-benzisothiazoline-3-one, 2-phenoxyethanol, phenethyl alcohol, and p-hydroxybenzoic acid butyl ester were added.

TABLE 6

Silver iodobromide emulsions used for preparation of Samples 201 in this Example were as follows.

| Emulsion | Feature of grain | Average grain-diameter corresponding to sphere (μm) | Deviation coefficient (%) | AgI content (%) |
|---|---|---|---|---|
| A | Monodisperse tetradecahedral grain | 0.24 | 16 | 4.0 |
| B | Monodisperse cubic internal latent image-type grain | 0.29 | 10 | 3.0 |
| C | Monodisperse cubic grain | 0.36 | 10 | 5.0 |
| D | Monodisperse tabular grain, average aspect ratio: 3.0 | 0.65 | 8 | 2.0 |
| E | Monodisperse cubic grain | 0.20 | 17 | 3.5 |
| F | Monodisperse tetradecahedral grain | 0.23 | 16 | 4.0 |
| G | Monodisperse cubic internal latent image-type grain | 0.38 | 11 | 4.0 |
| H | Monodisperse cubic grain | 0.52 | 9 | 3.5 |
| I | Monodisperse tabular grain, average aspect ratio: 5.0 | 0.76 | 10 | 2.0 |
| J | Monodisperse cubic grain | 0.32 | 18 | 4.5 |
| K | Monodisperse tetradecahedral grain | 0.43 | 17 | 4.0 |
| L | Monodisperse tabular grain, average aspect ratio: 5.0 | 0.57 | 10 | 2.0 |
| M | Monodisperse tabular grain, average aspect ratio: 8.0 | 0.65 | 13 | 2.0 |
| N | Monodisperse tabular grain, average aspect ratio: 6.0 | 1.00 | 10 | 1.5 |
| O | Monodisperse tabular grain, average aspect ratio: 9.0 | 1.15 | 15 | 1.5 |

TABLE 7

Spectral sensitization of Emulsions A to I

| Emulsion | Sensitizing dye added | Amount added (g) per mol of silver halide |
|---|---|---|
| A | S-2 | 0.025 |
| | S-3 | 0.25 |
| | S-8 | 0.010 |
| B | S-1 | 0.010 |
| | S-3 | 0.25 |
| | S-8 | 0.010 |
| C | S-1 | 0.010 |
| | S-2 | 0.010 |
| | S-3 | 0.25 |
| | S-8 | 0.010 |
| D | S-2 | 0.010 |
| | S-3 | 0.10 |
| | S-8 | 0.010 |

TABLE 7-continued

Spectral sensitization of Emulsions A to I

| Emulsion | Sensitizing dye added | Amount added (g) per mol of silver halide |
|---|---|---|
| E | S-4 | 0.50 |
| | S-5 | 0.10 |
| F | S-4 | 0.30 |
| | S-5 | 0.10 |
| G | S-4 | 0.25 |
| | S-5 | 0.08 |
| | S-9 | 0.05 |
| H | S-4 | 0.20 |
| | S-5 | 0.060 |
| | S-9 | 0.050 |
| I | S-4 | 0.30 |
| | S-5 | 0.070 |
| | S-9 | 0.10 |

TABLE 8

Spectral sensitization of Emulsions J to N

| Emulsion | Sensitizing dye added | Amount added (g) per mol of silver halide |
|---|---|---|
| J | S-6 | 0.050 |
| | S-7 | 0.20 |
| K | S-6 | 0.05 |
| | S-7 | 0.20 |
| L | S-6 | 0.060 |
| | S-7 | 0.22 |
| M | S-6 | 0.050 |
| | S-7 | 0.17 |
| N | S-6 | 0.040 |
| | S-7 | 0.15 |
| O | S-6 | 0.060 |
| | S-7 | 0.22 |

ExC-1

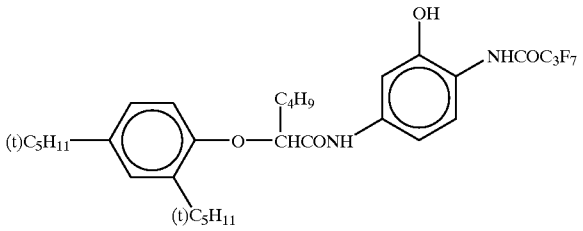

ExC-2

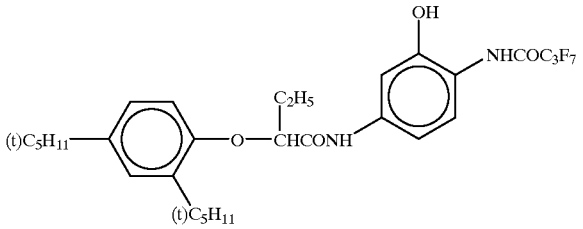

ExC-3

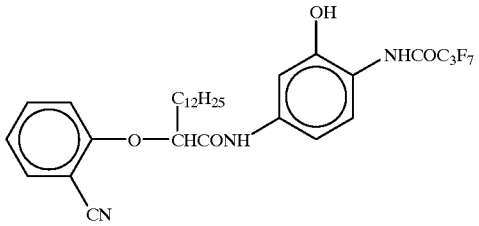

ExC-4

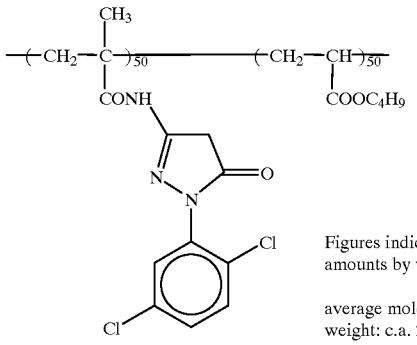

Figures indicate amounts by weight % average molecular weight: c.a. 25,000

-continued
ExC-5
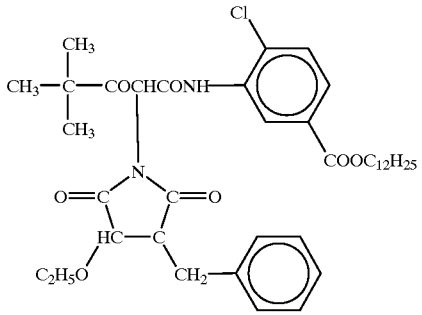
ExC-6
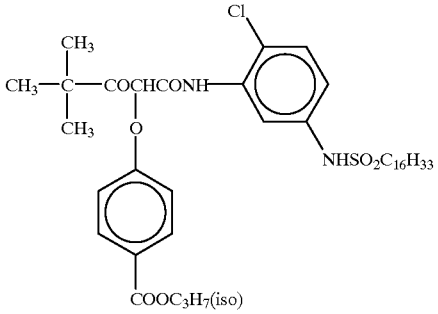
ExC-7
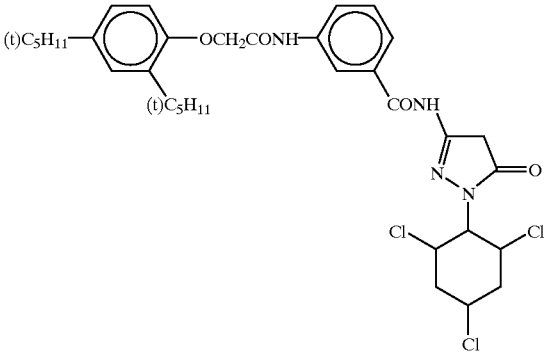
ExC-8
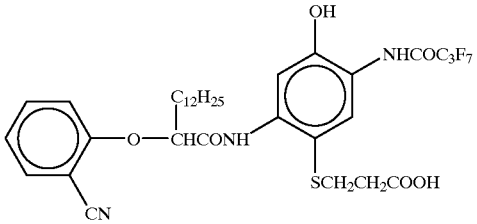
ExC-9
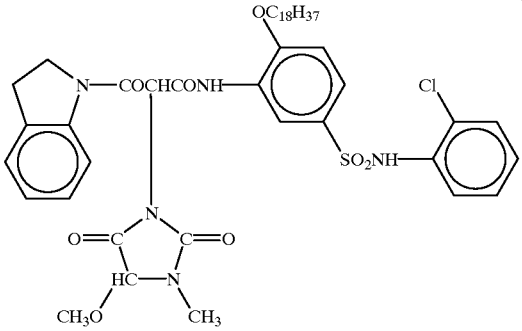
Oil-1
Dibutyl phthalate
Oil-2
Tricresyl phosphate
Oil-3
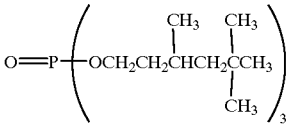
Cpd-A
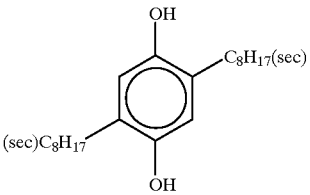
Cpd-B
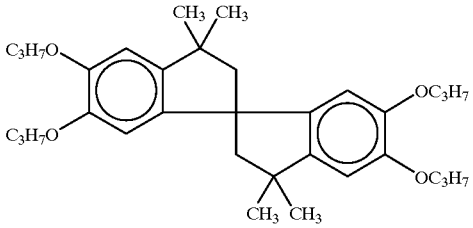

-continued
Cpd-C
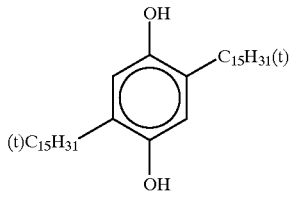
Cpd-D
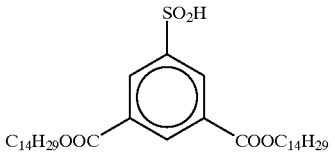
Cpd-E
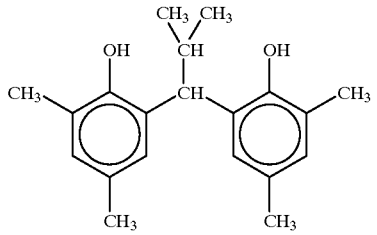
Cpd-F
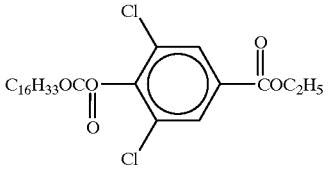
Cpd-H
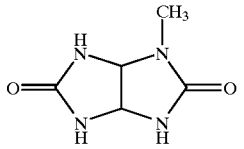
Cpd-I
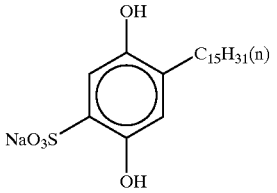
Cpd-J
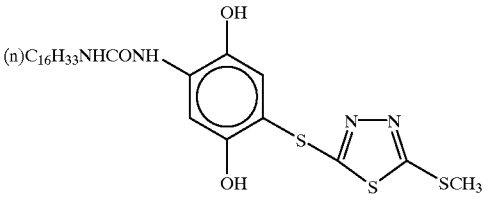
Cpd-K
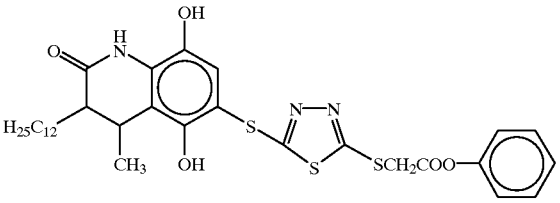
Cpd-L
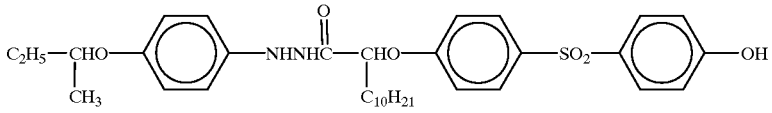
U-1
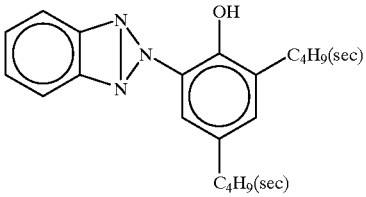
U-2
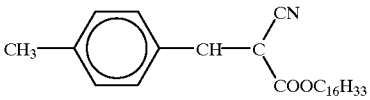
U-3
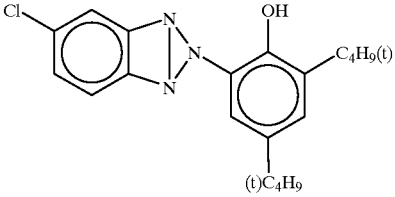
U-4
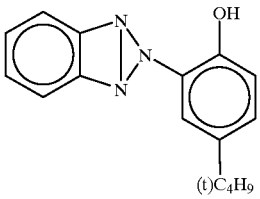

-continued
U-5
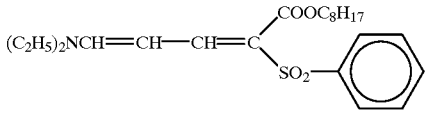
S-1
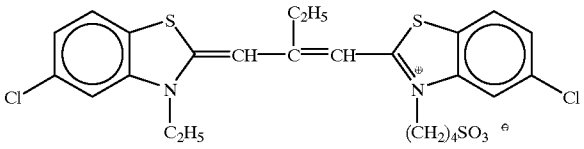
S-2
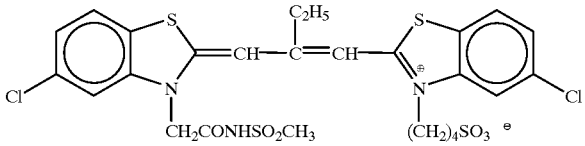
S-3
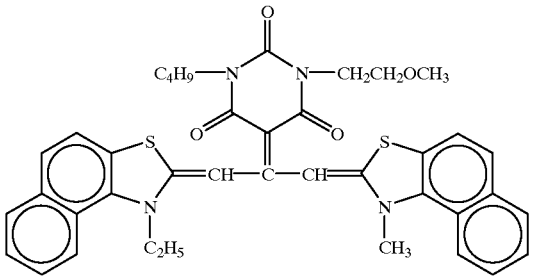
S-4
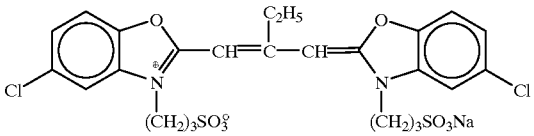
S-5
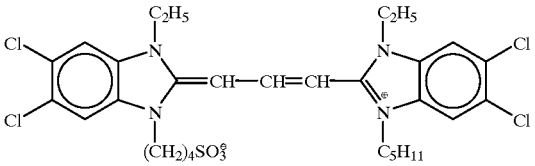
S-6
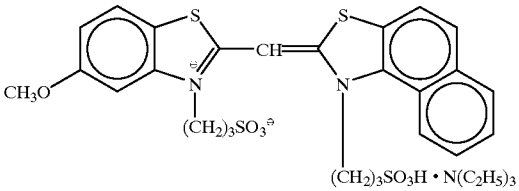
S-7
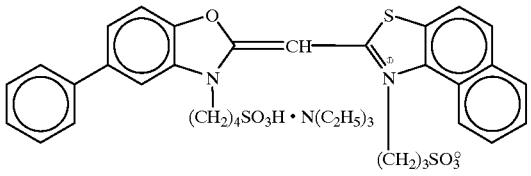
S-8
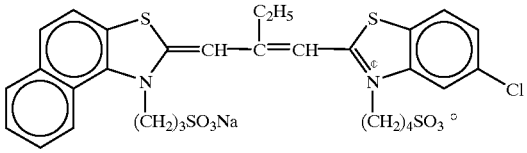
S-9
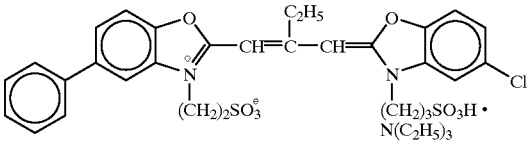
D-1
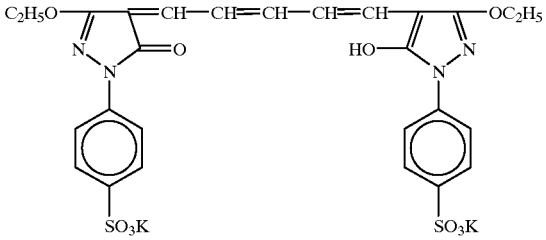
D-2
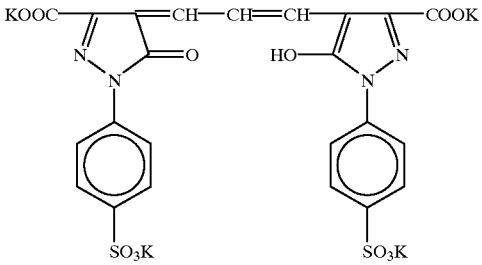

-continued
D-3
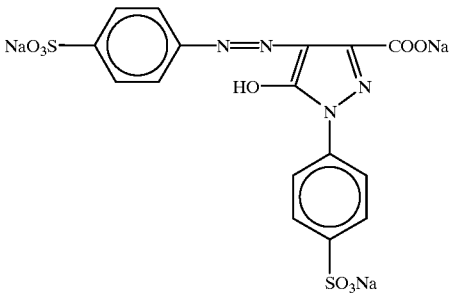
D-4
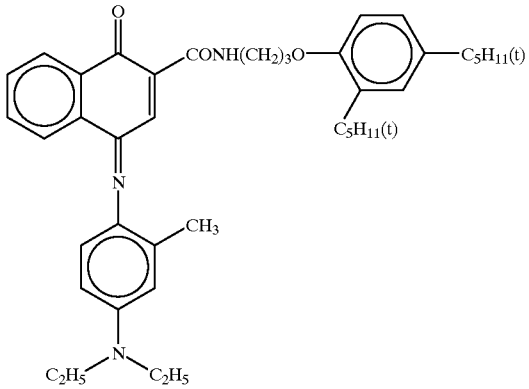
D-5
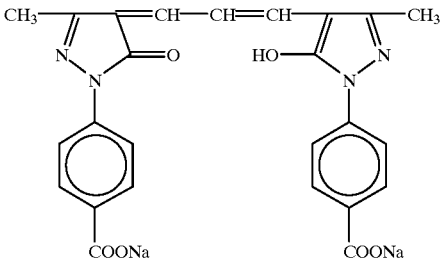
D-6
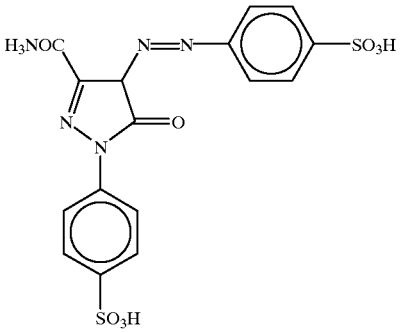
E-1
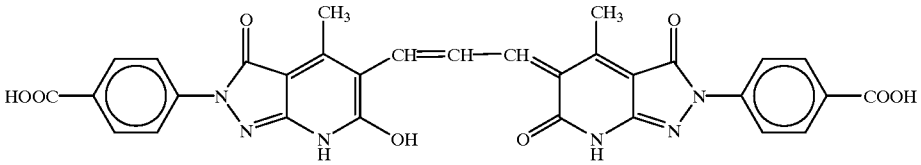
E-2
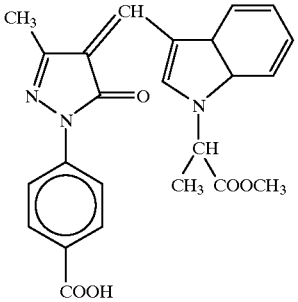
E-3
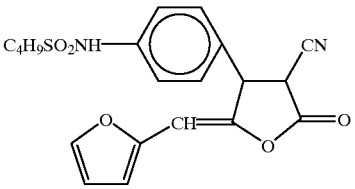
H-1
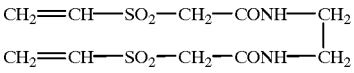
SO-1
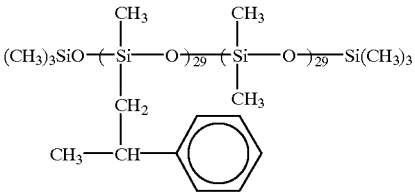
W-1
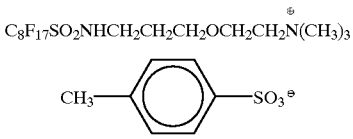
W-2
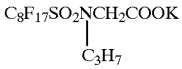

-continued

W-3

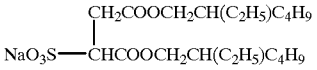

W-4

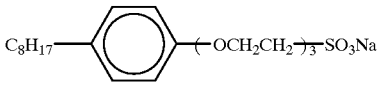

W-5

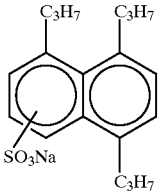

W-6

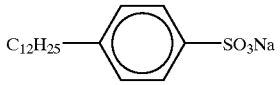

P-1

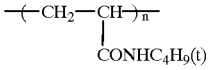

M-1

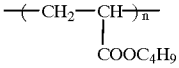

F-1

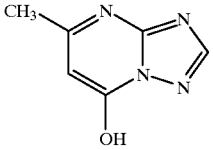

F-2

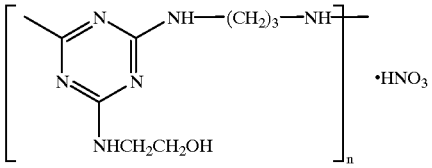

(n = 3 ~ 4)

F-3

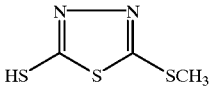

F-4

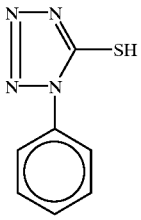

F-5

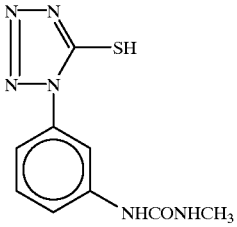

F-6

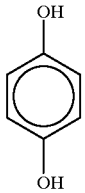

F-7

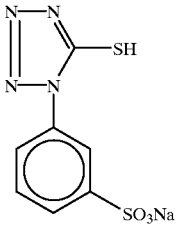

F-8

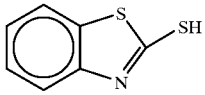

(Preparation of a Dispersion of an Organic Solid Dispersed Dye)

Dye E-1 was dispersed by the following method. That is, to 1430 g of a wet cake of the dye containing 30% of methanol, were added water and 200 g of Pluronic F88 (ethyleneoxide-propyleneoxide block-copolymer), trade name, manufactured by BASF, and the resulting mixture was stirred, to make a slurry having a dye content of 6%. After that, an ULTRAVISCOMILL (UVM-2), trade name, manufactured by IMEX Co., Ltd., was filled with 1700 ml of zirconia beads (average grain diameter, 0.5 mm), through which the thus-obtained slurry was passed and ground at the round speed of about 10 m/sec and a discharge rate of 0.5 liters/min for 8 hrs. After the beads were removed by filtration, the filtrate was added water and it was diluted to be a dye content of 3%, and then it was heated at 90° C. for 10 hours, for stabilization. The average grain diameter of the thus-obtained fine grain dye was 0.60 μm, and the distribution range of the grain diameter (grain diameter standard deviation×100/average grain diameter) was 18%.

In the similar manner, solid dispersions of each Dye E-2 and E-3 were obtained. The average grain size of these dyes in the form of fine grains was 0.54 μm, and 0.56 μm, respectively.

In the present example, the following development process was employed for all samples. In the processing of the samples, the processing solutions that processed Sample 201 whose 50% had been completely exposed to a white light, until the replenishment rate reached 3 times the volume of the tank, were used.

| Processing step | Time | Temperature | Tank volume | Replenisher amount |
|---|---|---|---|---|
| 1st development | 6 min | 38° C. | 12 liters | 2,200 ml/m$^2$ |
| 1st water-washing | 2 min | 38° C. | 4 liters | 7,500 ml/m$^2$ |
| Reversal | 2 min | 38° C. | 4 liters | 1,100 ml/m$^2$ |
| Color-development | 6 min | 38° C. | 12 liters | 2,200 ml/m$^2$ |
| Pre-bleaching | 2 min | 38° C. | 4 liters | 1,100 ml/m$^2$ |
| Bleaching | 6 min | 38° C. | 12 liters | 220 ml/m$^2$ |
| Fixing | 4 min | 38° C. | 8 liters | 1,100 ml/m$^2$ |
| 2nd water-washing | 4 min | 38° C. | 8 liters | 7,500 ml/m$^2$ |
| Final-rinsing | 1 min | 25° C. | 2 liters | 1,100 ml/m$^2$ |

Compositions of each processing solution used were as follows:

| | Tank solution | Replenisher |
|---|---|---|
| First developer | | |
| Pentasodium nitrilo-N,N,N-trimethylenephosphonate | 1.5 g | 1.5 g |
| Pentasodium diethylenetriamine-pentaacetate | 2.0 g | 2.0 g |
| Sodium sulfite | 30 g | 30 g |
| Hydroquinone/potassium monosulfonate | 20 g | 20 g |
| Potassium carbonate | 15 g | 20 g |
| Sodium bicarbonate | 12 g | 15 g |
| 1-Phenyl-4-methyl-4-hydroxymethyl-3-pyrazolydone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1,000 ml | 1,000 ml |
| pH | 9.60 | 9.60 |
| (pH was adjusted by using sulfuric acid or potassium hydroxide) | | |
| Reversal solution (Both tank solution and replenisher) | | |
| Pentasodium nitrilo-N,N,N-trimethylenephosphonate | 3.0 g | |
| Stannous chloride dihydrate | 1.0 g | |
| p-Aminophenol | 0.1 g | |
| Sodium hydroxide | 8 g | |
| Glacial acetic acid | 15 ml | |
| Water to make | 1,000 ml | |
| pH | 6.00 | |
| (pH was adjusted by using acetic acid or sodium hydroxide) | | |
| Color-developer | | |
| Pentasodium nitrilo-N,N,N-trimethylenephosphonate | 2.0 g | 2.0 g |

-continued

| | Tank solution | Replenisher |
|---|---|---|
| Sodium sulfite | 7.0 g | 7.0 g |
| Trisodium phosphate 12-hydrate | 36 g | 36 g |
| Potassium bromide | 1.0 g | — |
| Potassium iodide | 90 mg | — |
| Sodium hydroxide | 3.0 g | 3.0 g |
| Cytrazinic acid | 1.5 g | 1.5 g |
| N-Ethyl-N-(β-methanesulfonamidoethyl)-3-methyl-4-aminoaniline.3/2 sulfate. mono hydrate | 11 g | 11 g |
| 3,6-Dithiaoctane-1,8-diol | 1.0 g | 1.0 g |
| Water to make | 1,000 ml | 1,000 ml |
| pH | 11.80 | 12.00 |
| (pH was adjusted by using sulfuric acid or potassium hydroxide) | | |
| Pre-bleaching solution | | |
| Disodium ethylenediaminetetraacetate dihydrate | 8.0 g | 8.0 g |
| Sodium sulfite | 6.0 g | 8.0 g |
| 1-Thioglycerol | 0.4 g | 0.4 g |
| Formaldehyde.sodium bisulfite adduct | 30 g | 35 g |
| Water to make | 1,000 ml | 1,000 ml |
| pH | 6.30 | 6.10 |
| (pH was adjusted by using acetic acid or sodium hydroxide) | | |
| Bleaching solution | | |
| Disodium ethylenediaminetetraacetate dihydrate | 2.0 g | 4.0 g |
| Iron (III) ammonium ethylenediamine-tetraacetate dihydrate | 120 g | 240 g |
| Potassium bromide | 100 g | 200 g |
| Ammonium nitrate | 10 g | 20 g |
| Water to make | 1,000 ml | 1,000 ml |
| pH | 5.70 | 5.50 |
| (pH was adjusted by using nitric acid or sodium hydroxide) | | |
| Fixing solution (Both tank solution and replenisher) | | |
| Ammonium thiosulfate | 80 g | |
| Sodium sulfite | 5.0 g | |
| Sodium bisulfite | 5.0 g | |
| Water to make | 1,000 ml | |
| pH | 6.60 | |
| (pH was adjusted by using acetic acid or aqueous ammonia) | | |
| Stabilizing solution | | |
| 1,2-Benzoisothiazolin-3-one | 0.02 g | 0.03 g |
| Polyoxyethylene-p-monononyl phenyl ether (av. polymerization degree: 10) | 0.3 g | 0.3 g |
| Polymaleic acid (av. molecular weight 2,000) | 0.1 g | 0.15 g |
| Water to make | 1,000 ml | 1,000 ml |
| pH | 7.0 | 7.0 |

A light-sensitive material was prepared in the same manner as for the above light-sensitive material, except that the magenta coupler in the ninth to the eleventh layers was changed as shown in Table 9, in an amount of 60 mol % in the above light-sensitive material. The thus-prepared light-sensitive material sample was processed in the same manner as described in the above. After the processing, the minimum density (Dmin) and the maximum density (Dmax) of the light-sensitive material were found.

With respect to the raw stock storability, after the light-sensitive material was allowed to stand in the presence of formalin, in an amount of 20 ppm, for 30 days, and then it was processed in the above manner, the increase in the yellow component of Dmin, and the decrease in the magenta component of Dmax, were found.

Further, with respect to the preservability after processing, after the processed light-sensitive material was allowed to stand at 60° C./70% RH for 30 days, the increase in the yellow component of Dmin was measured.

The results are shown in Table 9.

TABLE 9

| Light-sensitive material | Photographic properties Dmin | Photographic properties Dmax | Storage stability before processing Dmin | Storage stability before processing Dmax | Storage stability after processing Dmin | Remarks |
|---|---|---|---|---|---|---|
| 201 (EXC-7) | 0.10 | 3.50 | 0.15 | 2.0 | 0.12 | Comparative example |
| 202 (CM-1) | 0.10 | 3.30 | 0.30 | 0.5 | 0.16 | Comparative example |
| 203 M-2 | 0.10 | 3.52 | 0.12 | 0.22 | 0.10 | This invention |
| 204 M-5 | 0.09 | 3.54 | 0.10 | 0.20 | 0.09 | This invention |
| 205 M-14 | 0.10 | 3.55 | 0.07 | 0.18 | 0.05 | This invention |
| 206 M-17 | 0.09 | 3.54 | 0.08 | 0.19 | 0.04 | This invention |
| 207 M-19 | 0.08 | 3.52 | 0.10 | 0.17 | 0.05 | This invention |
| 208 M-24 | 0.09 | 3.51 | 0.09 | 0.17 | 0.05 | This invention |
| 209 M-41 | 0.08 | 3.52 | 0.08 | 0.17 | 0.09 | This invention |
| 210 M-42 | 0.09 | 3.51 | 0.11 | 0.18 | 0.08 | This invention |
| 211 M-43 | 0.09 | 3.52 | 0.06 | 0.18 | 0.09 | This invention |

As is shown in the results in Table 9, according to the light-sensitive material of the present invention in which the specific compound was used, it can be understood that the photographic performance and the preservability could be remarkably improved, in comparison with Comparative examples.

Having described our invention as related to the present embodiments, it is our intention that the invention not be limited by any of the details of the description, unless otherwise specified, but rather be construed broadly within its spirit and scope as set out in the accompanying claims.

What is claim is:

1. A silver halide color light-sensitive material, which comprises a coupler represented by the following formula (1), (2), or (3) in at least one layer on a base:

Formula (1)

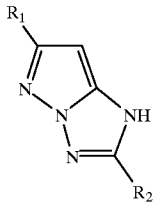

wherein $R_1$ represents a hydrogen atom, a halogen atom, or a substituent, and $R_2$ represents a group represented by the following formula (4), Formula (2)

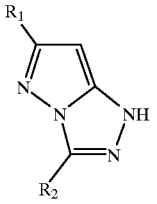

wherein $R_1$ and $R_2$ have the same meanings as those of $R_1$ and $R_2$ in formula (1), Formula (3)

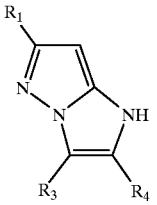

wherein $R_1$ has the same meaning as that of $R_1$ in formula (1), and $R_3$ and $R_4$ each represent a hydrogen atom, a halogen atom, or a substituent, with the proviso that at least one of $R_3$ and $R_4$ represents a group represented by the following formula (4), Formula (4)

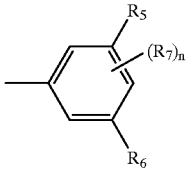

wherein $R_5$ and $R_6$ each represent an alkyl group, an aryl group, a heterocyclic group, an alkoxy group, an aryloxy group, an acyloxy group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl group, an aryloxycarbonyl group, a carbamoyl group, an amino group, an anilino group, a heterocyclic amino group, a carbonamido group, an alkoxycarbonylamino group, an aryloxycarbonylamino group, a ureido group, a sulfonamido group, a sulfamoylamino group, an imido group, an alkylthio group, an arylthio group, a heterocyclic thio group, a sulfinyl group, an alkanesulfonyl group, an arenesulfonyl group, a sulfamoyl group, or a phosphinoylamino group; $R_7$ represents a group capable of substitution on a benzene ring; n is an integer of 0 to 3, and when n is 2 or more, $R_7$'s are the same or different.

2. The silver halide color light-sensitive material as claimed in claim 1, wherein, in the group represented by formula (4), $R_5$ and $R_6$ each represent an alkoxycarbonyl group, a cycloalkyloxycarbonyl group, an aryloxycarbonyl group, a carbamoyl group, a carbonamido group, an alkoxycarbonylamino group, an aryloxycarbonylamino group, a ureido group, a sulfonamido group, a sulfamoylamino group, an imido group, an alkylthio group, an arylthio group, a heterocyclic thio group, an alkanesulfonyl group, an arenesulfonyl group, a sulfamoyl group, or a phosphinoylamino group.

3. The silver halide color light-sensitive material as claimed in claim 1, wherein, in the group represented by formula (4), the total number of carbon atoms in the groups represented by $R_5$ and $R_6$ is 10 or more, but 80 or less.

4. The silver halide color light-sensitive material as claimed in claim 1, wherein, in the coupler represented by formula (1), (2), or (3), $R_1$ represents a hydrogen atom, a halogen atom, an alkyl group, a cycloalkyl group, an alkenyl group, an aryl group, a heterocyclic group, a cyano group, a silyl group, a hydroxyl group, a nitro group, an alkoxy group, a cycloalkyloxy group, an aryloxy group, a heterocyclic oxy group, a silyloxy group, an acyloxy group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl group, an aryloxycarbonyl group, a carbamoyl group, an amino group, an anilino group, a heterocyclic amino group, a carbonamido group, a ureido group, an imido group, an alkoxycarbonylamino group, an aryloxycarbonylamino group, a sulfonamido group, a sulfamoylamono group, an azo group, an alkylthio group, an arylthio group, a heterocyclic thio group, an alkylsulfinyl group, an arenesufinyl group, an alkanesulfonyl group, an arenesulfonyl group, a sulfamoyl group, a sulfo group, a phosphonyl group, or a phosphinoylamino group.

5. The silver halide color light-sensitive material as claimed in claim 1, wherein, in the coupler represented by formula (3), $R_3$ and $R_4$ each represent a hydrogen atom, a halogen atom, an alkyl group, a cycloalkyl group, an alkenyl group, an aryl group, a heterocyclic group, a cyano group, a silyl group, a hydroxyl group, a nitro group, an alkoxy group, a cycloalkyloxy group, an aryloxy group, a heterocyclic oxy group, a silyloxy group, an acyloxy group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl group, an aryloxycarbonyl group, a carbamoyl group, an amino group, an anilino group, a heterocyclic amino group, a carbonamido group, a ureido group, an imido group, an alkoxycarbonylamino group, an aryloxycarbonylamino group, a sulfonamido group, a sulfamoylamono group, an azo group, an alkylthio group, an arylthio group, a heterocyclic thio group, an alkylsulfinyl group, an arenesufinyl group, an alkanesulfonyl group, an arenesulfonyl group, a sulfamoyl group, a sulfo group, a phosphonyl group, or a phosphinoylamino group; with the proviso that at least one of $R_3$ and $R_4$ is a group represented by the formula (4).

6. The silver halide color light-sensitive material as claimed in claim 1, wherein, in the group represented by formula (4), $R_7$ represents a halogen atom, an alkyl group, a cycloalkyl group, an alkenyl group, an aryl group, a heterocyclic group, a cyano group, a silyl group, a hydroxyl group, a nitro group, an alkoxy group, a cycloalkyloxy group, an aryloxy group, a heterocyclic oxy group, a silyloxy group, an acyloxy group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl group, an aryloxycarbonyl group, a carbamoyl group, an amino group, an anilino group, a heterocyclic amino group, a carbonamido group, a ureido group, an imido group, an alkoxycarbonylamino group, an aryloxycarbonylamino group, a sulfonamido group, a sulfamoylamono group, an azo group, an alkylthio group, an arylthio group, a heterocyclic thio group, an alkylsulfinyl group, an arenesufinyl group, an alkanesulfonyl group, an arenesulfonyl group, a sulfamoyl group, a sulfo group, a phosphonyl group, or a phosphinoylamino group.

7. The silver halide color light-sensitive material as claimed in claim 1, wherein the said coupler is a coupler represented by the following formula (5):

Formula (5)

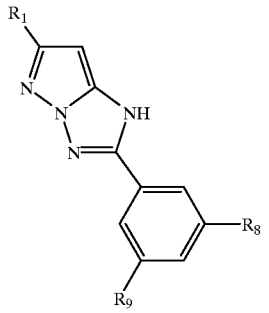

wherein $R_1$ represents an alkyl group, a cycloalkyl group, an alkenyl group, an aryl group, a heterocyclic group, an alkoxy group, or an aryloxy group and $R_8$ and $R_9$ each represent an alkoxycarbonyl group, a cycloalkyloxycarbonyl group, an aryloxycarbonyl group, a carbamoyl group, an amino group, an anilino group, a carbonamido group, an alkoxycarbonylamino group, an aryloxycarbonylamino group, a ureido group, a sulfonamido group, a sulfamoylamino group, an imido group, or a phosphinoylamino group.

8. The silver halide color light-sensitive material as claimed in claim 1, wherein the said coupler is a coupler represented the following formula (6):

Formula (6)

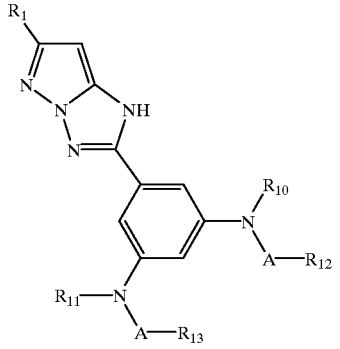

wherein $R_1$ represents a tertiary alkyl group or a tertiary cycloalkyl group, $R_{10}$ and $R_{11}$ each represent a hydrogen atom or an alkyl group, A represents —CO— or —$SO_2$—, and $R_{12}$ and $R_{13}$ each represent an alkyl group or an aryl group.

9. The silver halide color light-sensitive material as claimed in claim 1, wherein the said silver halide color light-sensitive material is a heat development color light-sensitive material having at least a light-sensitive silver halide, a binder, and a color-developing agent, in addition to the coupler represented by the above-described formula (1), (2), or (3), on the base.

10. The silver halide color light-sensitive material as claimed in claim 9, which contains, as the said developing agent, a compound represented by the following formula (7):

Formula (7)

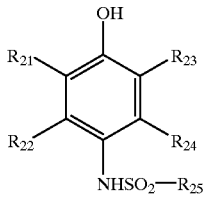

wherein $R_{21}$, $R_{22}$, $R_{23}$, and $R_{24}$ each represent a hydrogen atom or a substituent with the total of the Hammett substituent constant $\sigma_p$ values thereof being 0 or more, and $R_{25}$ represents an alkyl group, an aryl group, or a heterocyclic group.

11. The silver halide color light-sensitive material as claimed in claim 10, wherein, in the compound represented by formula (7), $R_{21}$, $R_{22}$, $R_{23}$, and $R_{24}$ each represent a hydrogen atom, a halogen atom, an alkyl group, an aryl group, a carbonamido group, an alkanesulfonamido group, an arenesulfonamido group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an acyl group, an alkoxycarbonyl group, an aryloxycarbonyl group, an alkylcarbonyl group, an arylcarbonyl group, or an acyloxy group.

12. The silver halide color light-sensitive material as claimed in claim 10, wherein, in the compound represented by formula (7), $R_{21}$, $R_{22}$, $R_{23}$, and $R_{24}$ each represent a halogen atom, an alkyl group, a carbonamido group, an alkanesulfonamido group, an arenesulfonamido group, an alkoxy group, an alkylthio group, an arylthio group, a carbamoyl group, a sulfamoyl group, a cyano group, an alkanesulfonyl group, an arenesulfonyl group, an acyl group, or an alkoxycarbonyl group.

13. The silver halide color light-sensitive material as claimed in claim 10, wherein, in the compound represented by formula (7), $R_{22}$ and $R_{24}$ each represent a hydrogen atom.

14. The silver halide color light-sensitive material as claimed in claim 10, wherein, in the compound represented by formula (7), the sum of the Hammett $\sigma_p$ values of $R_{21}$ to $R_{24}$ is 0.2 or more.

15. The silver halide color light-sensitive material as claimed in claim 10, wherein, in the compound represented by formula (7), $R_{25}$ represents an aryl group.

16. The silver halide color light-sensitive material as claimed in claim 10, wherein, in the compound represented by formula (7), $R_{25}$ represents a group represented by the following formula (8):

Formula (8)

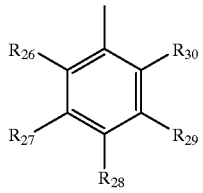

wherein $R_{26}$, $R_{27}$, $R_{28}$, $R_{29}$, and $R_{30}$ each represent a hydrogen atom, a halogen atom, an alkyl group, an aryl group, a carbonadmido group, an alkanesulfonamido group, an arenesulfonamido group, an alkoxy group, an aryloxy group, an alkylthio group, an arylthio group, a carbamoyl group, a sulfamoyl group, a cyano group, an alkanesulfonyl group, an arenesulfonyl group, an alkoxycarbonyl group, an aryloxycarbonyl group, or an acyl group, and at least one of $R_{26}$ to $R_{30}$ represents one of the above atoms or groups other than a hydrogen atom; or $R_{26}$ and $R_{27}$, or $R_{29}$ and $R_{30}$ each may bond together to form a ring.

17. The silver halide color light-sensitive material as claimed in claim 16, wherein, in the group represented by formula (8), $R_{26}$ and/or $R_{30}$ each are not a hydrogen atom.

18. The silver halide color light-sensitive material as claimed in claim 1, wherein an amount to be added of the coupler represented by formula (1), (2), or (3), is about 0.001 to 100 mmol/$m^2$, in terms of the coated amount.

19. The silver halide color light-sensitive material as claimed in claim 1, wherein the coupler represented by formula (1), (2), or (3) is contained in a light-sensitive silver halide emulsion layer.

20. The silver halide color light-sensitive material as claimed in claim 19, wherein the light-sensitive silver halide emulsion layer is a green-sensitive silver halide emulsion layer.

* * * * *